US011713643B2

(12) United States Patent
Mitchell et al.

(10) Patent No.: US 11,713,643 B2
(45) Date of Patent: Aug. 1, 2023

(54) CONTROLLED DEFORMATION AND SHAPE RECOVERY OF PACKING ELEMENTS

(71) Applicant: Weatherford Technology Holdings, LLC, Houston, TX (US)

(72) Inventors: Michael Wilbert Mitchell, Cypress, TX (US); Gary Duron Ingram, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 108 days.

(21) Appl. No.: 17/085,910

(22) Filed: Oct. 30, 2020

(65) Prior Publication Data

US 2022/0136361 A1 May 5, 2022

(51) Int. Cl.
*E21B 33/128* (2006.01)
*E21B 33/12* (2006.01)
(Continued)

(52) U.S. Cl.
CPC ..... *E21B 33/128* (2013.01); *E21B 23/06* (2013.01); *E21B 33/1208* (2013.01);
(Continued)

(58) Field of Classification Search
CPC ..... E21B 33/1208; E21B 33/1293; E21B 33/12; E21B 33/1216
See application file for complete search history.

(56) References Cited

U.S. PATENT DOCUMENTS 2,430,623 A * 11/1947 Taylor, Jr. ..... E21B 33/128 166/131
2,723,721 A * 11/1955 Corsette ..... E21B 33/126 277/335
(Continued)

FOREIGN PATENT DOCUMENTS

GB 2275951 A 9/1994
WO 2003054349 A1 7/2003
(Continued)

OTHER PUBLICATIONS

International Search Report and Written Opinion dated Jan. 10, 2022 for Application No. PCT/US2021/054161.
(Continued)

*Primary Examiner* — Theodore N Yao
(74) *Attorney, Agent, or Firm* — Peter V Schroeder; Booth Albanesi Schroeder PLLC

(57) ABSTRACT

A packer assembly includes a mandrel and a packing element disposed about the mandrel. Upper and lower recovery sleeves are disposed about the mandrel and extend between the mandrel and respective upper and lower ends of the packing element. The upper and lower recovery sleeves each have a recovery profile embedded within the packing element. Upper and lower backup assemblies are movably disposed about the respective upper and lower recovery sleeves, adjacent to the respective upper and lower ends of the packing element. The packer assembly includes at least one release mechanism. When setting the packer assembly in a bore, the packing element is axially compressed
(Continued)

between the upper and lower backup assemblies to contact the bore wall, and the upper and lower backup assemblies splay outwards. Upon release, the packing element and backup assemblies retract, thereby facilitating retrieval of the packer assembly from the bore.

20 Claims, 61 Drawing Sheets

(51) Int. Cl.
*E21B 33/129* (2006.01)
*E21B 23/06* (2006.01)

(52) U.S. Cl.
CPC ..... *E21B 33/129* (2013.01); *E21B 33/1216* (2013.01); *E21B 33/1293* (2013.01)

(56) References Cited

U.S. PATENT DOCUMENTS 2,725,941 A 12/1955 Henshaw
3,044,553 A 7/1962 Bradley
3,083,769 A 4/1963 Brown
4,018,274 A 4/1977 Cochran
4,253,522 A * 3/1981 Setterberg, Jr. ..... E21B 34/14 166/305.1
4,524,981 A 6/1985 Hertz, Jr.
4,554,973 A * 11/1985 Shonrock ..... E21B 33/1216 166/387
4,611,658 A * 9/1986 Salerni ..... E21B 33/1208 166/134
4,903,777 A 2/1990 Jordan, Jr. et al.
5,333,692 A 8/1994 Baugh et al.
5,566,762 A 10/1996 Braddick et al.
5,595,247 A 1/1997 Braddick
5,678,635 A 10/1997 Dunlap et al.
5,941,313 A 8/1999 Arizmendi
5,961,123 A 10/1999 Ingram et al.
6,123,148 A 9/2000 Oneal
6,253,856 B1 7/2001 Ingram et al.
6,257,339 B1 7/2001 Haugen et al.
6,827,150 B2 12/2004 Luke
6,935,431 B2 8/2005 Dewey et al.
7,077,212 B2 7/2006 Roesner et al.
7,347,274 B2 3/2008 Patel et al.
7,363,970 B2 4/2008 Corre et al.
7,591,321 B2 9/2009 Whitsitt et al.
7,654,334 B2 2/2010 Manson
7,836,962 B2 11/2010 Fagley, IV et al.
8,186,446 B2 5/2012 Ingram et al.
8,205,671 B1 6/2012 Branton
8,307,891 B2 11/2012 Bishop et al.
8,393,388 B2 3/2013 Bishop et al.
8,479,809 B2 7/2013 Farquhar
8,602,116 B2 12/2013 Crabb
8,881,836 B2 11/2014 Ingram
9,145,755 B2 9/2015 Farquhar
9,194,204 B2 11/2015 Hiorth et al.
9,267,348 B2 2/2016 Ingram et al.
9,291,044 B2 3/2016 Murphy et al.
9,376,884 B2 6/2016 Clarke
9,506,316 B2 11/2016 Carr et al.
9,534,462 B2 1/2017 Hayter
9,562,413 B2 2/2017 Hiorth
9,739,106 B2 8/2017 Tse
10,024,126 B2 7/2018 Davies et al.
10,024,132 B2 7/2018 Clemens et al.
10,036,221 B2 7/2018 Davies et al.
10,094,198 B2 10/2018 Nguyen et al.
10,138,704 B2 11/2018 Mitchell et al.
10,214,981 B2 2/2019 Davies et al.
10,316,617 B2 6/2019 Davies et al.
10,358,890 B2 7/2019 Zhong et al.
10,364,639 B2 7/2019 Svartvatn et al.
10,370,933 B2 8/2019 Hiorth
10,443,339 B2 10/2019 Yun et al.
10,443,343 B2 10/2019 Doane et al.
10,472,920 B2 11/2019 Farquhar et al.
10,590,732 B2 3/2020 Ingram
10,605,020 B2 3/2020 Davies et al.
10,626,696 B1 4/2020 Branton
10,760,372 B2 9/2020 Scruggs et al.
10,907,441 B2 2/2021 Hou et al.
11,066,896 B2 7/2021 Heiman et al.
2003/0188860 A1 10/2003 Zimmerman et al.
2005/0072579 A1 4/2005 Gambier
2007/0044977 A1* 3/2007 Hendrickson ..... E21B 33/128 166/387
2009/0242215 A1* 10/2009 Eatwell ..... E21B 33/128 166/387
2009/0283279 A1 11/2009 Patel et al.
2012/0217025 A1 8/2012 Shkurti et al.
2013/0068448 A1 3/2013 Hiorth et al.
2013/0186646 A1 7/2013 Xu
2014/0076539 A1 3/2014 Hiorth
2015/0068729 A1 3/2015 Carr et al.
2015/0275619 A1 10/2015 Slup
2016/0369588 A1 12/2016 Davies et al.
2017/0370175 A1 12/2017 Hiorth
2018/0187509 A1* 7/2018 Zhong ..... E21B 33/1208
2018/0209241 A1 7/2018 Farquhar et al.
2019/0162032 A1 5/2019 Davies et al.
2019/0186229 A1 6/2019 Hrupp
2019/0338605 A1 11/2019 Anderson et al.
2019/0352997 A1 11/2019 Brown
2019/0360297 A1* 11/2019 Heiman ..... E21B 33/128
2020/0040692 A1 2/2020 Yun et al.
2020/0165893 A1 5/2020 Varhaug et al.

FOREIGN PATENT DOCUMENTS

WO 2016094502 A1 6/2016
WO 2017034584 A1 3/2017
WO 2019209336 A1 10/2019
WO 2020163301 A1 8/2020

OTHER PUBLICATIONS

International Invitation to Pay Additional Fees and, Where Applicable, Protest Fee dated Jan. 3, 2022 for Application No. PCT/US2021/054162.
International Search Report and Written Opinion dated Feb. 28, 2022 for Application No. PCT/US2021/054162.

* cited by examiner

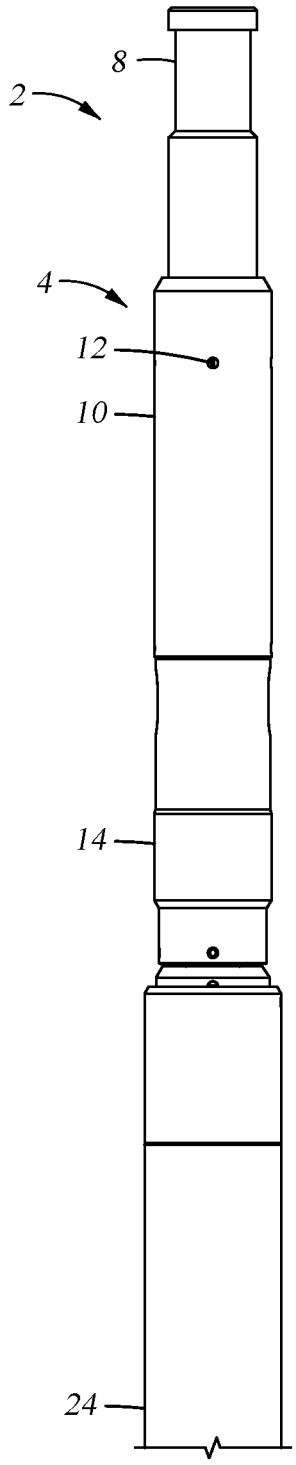
Fig. 2A1
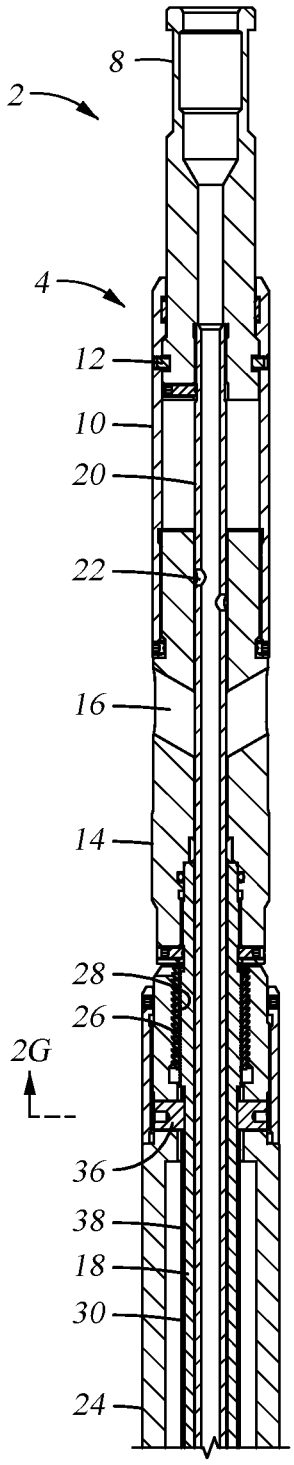
Fig. 2A2
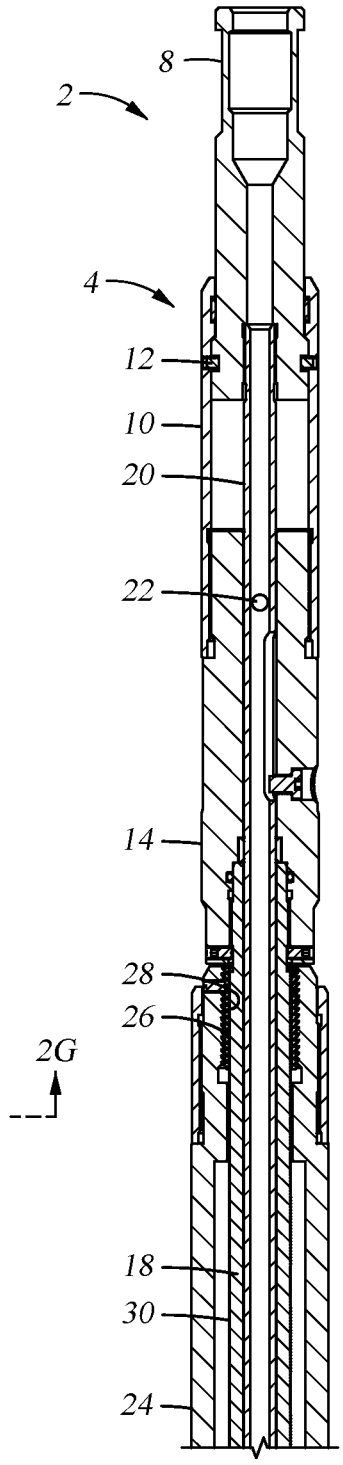
Fig. 2A3

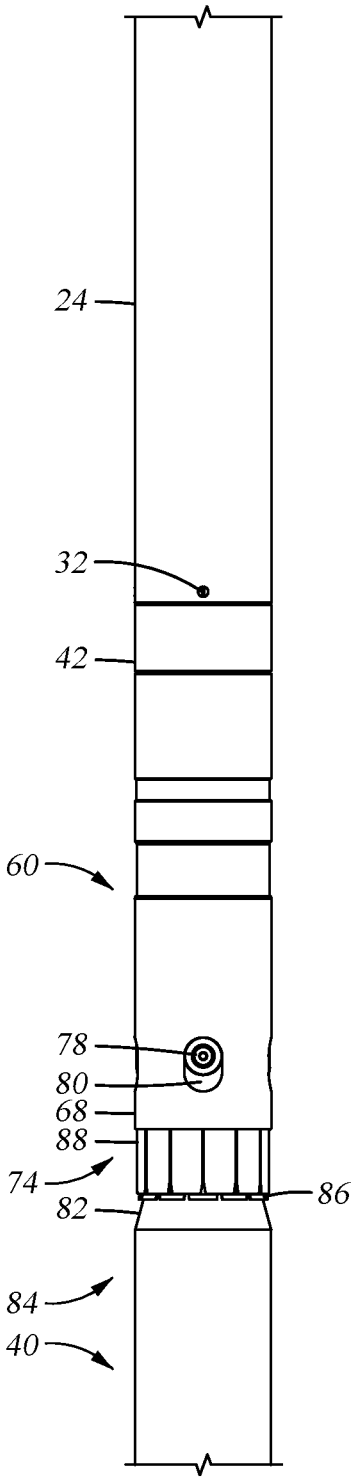
Fig. 2B1
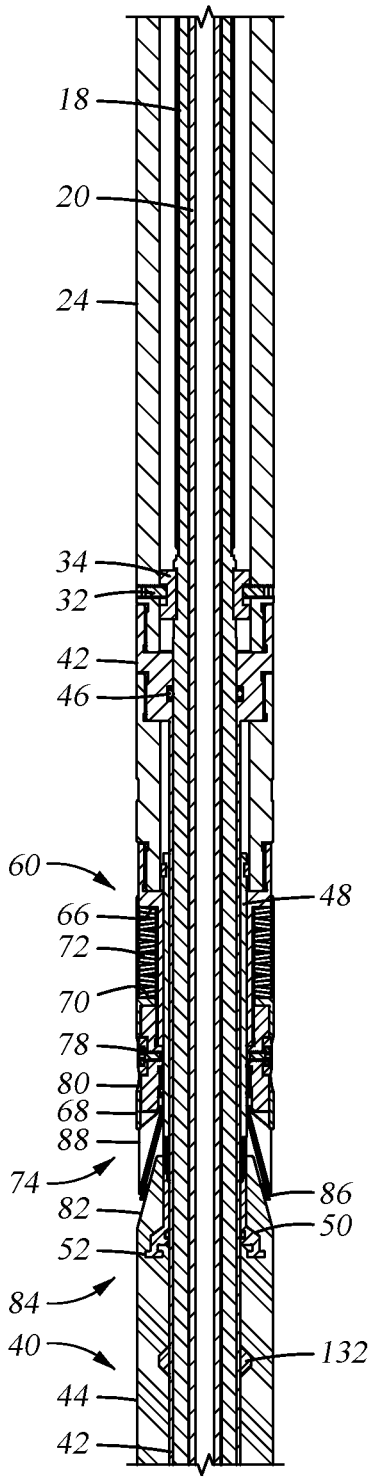
Fig. 2B2
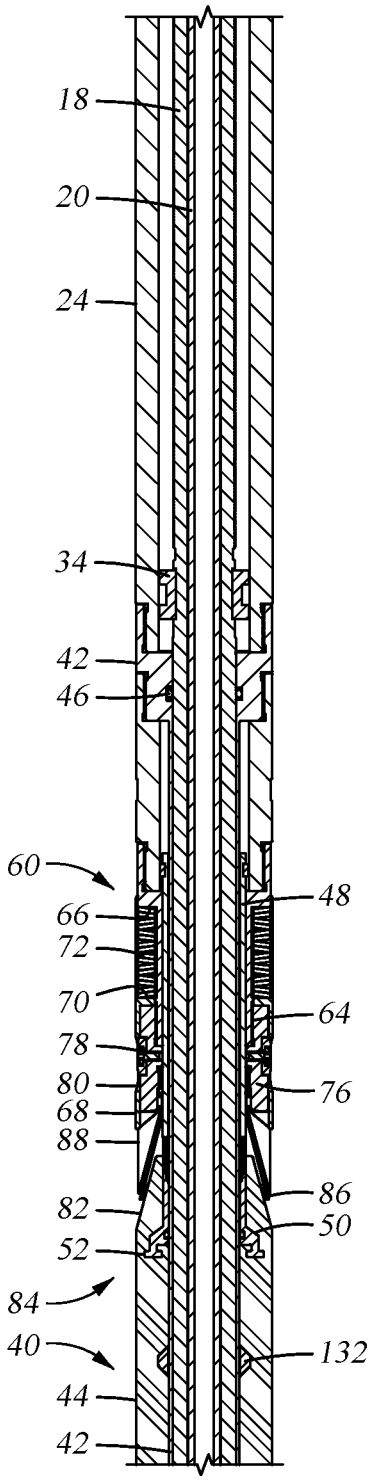
Fig. 2B3

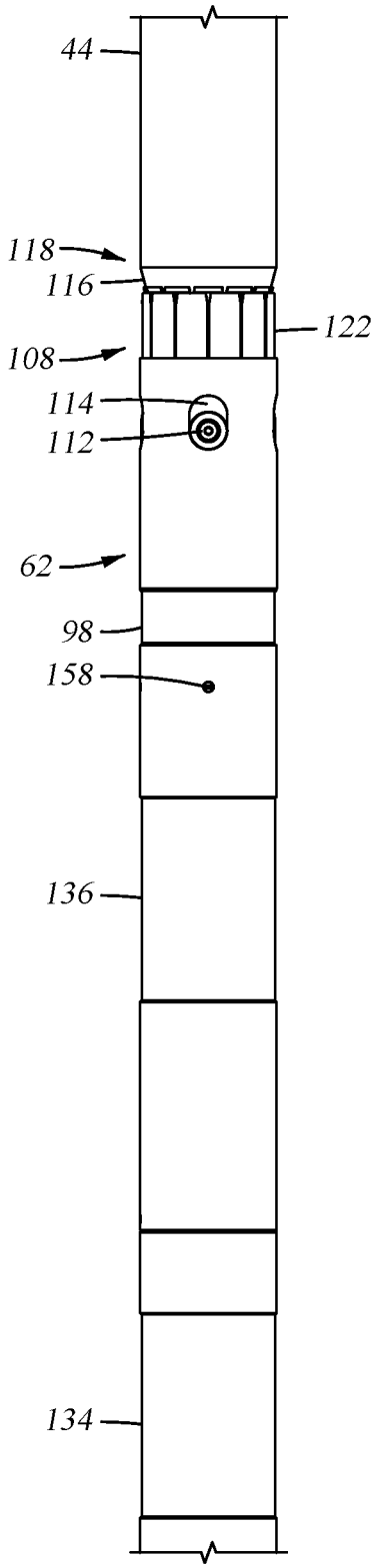
Fig. 2C1
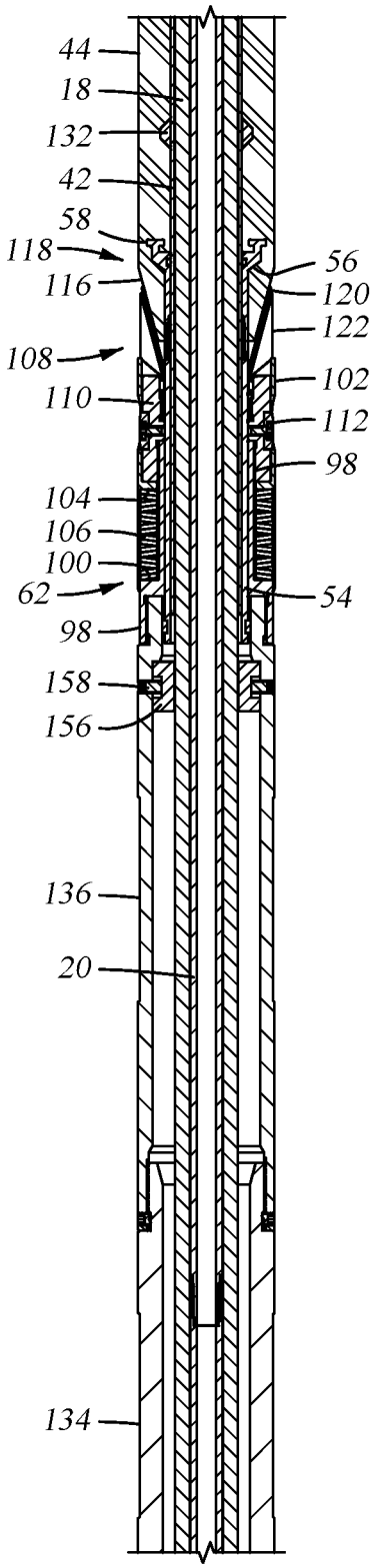
Fig. 2C2
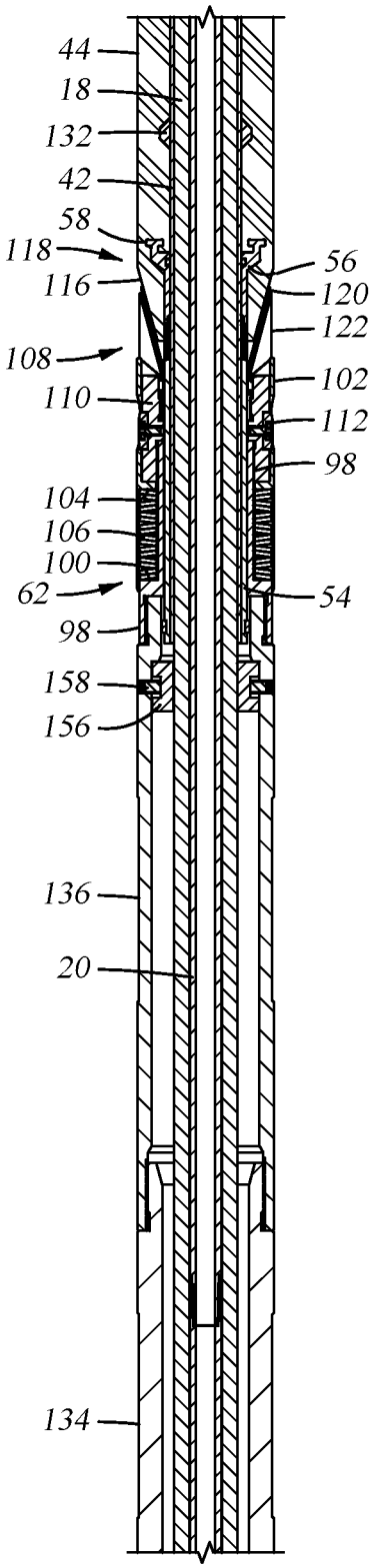
Fig. 2C3

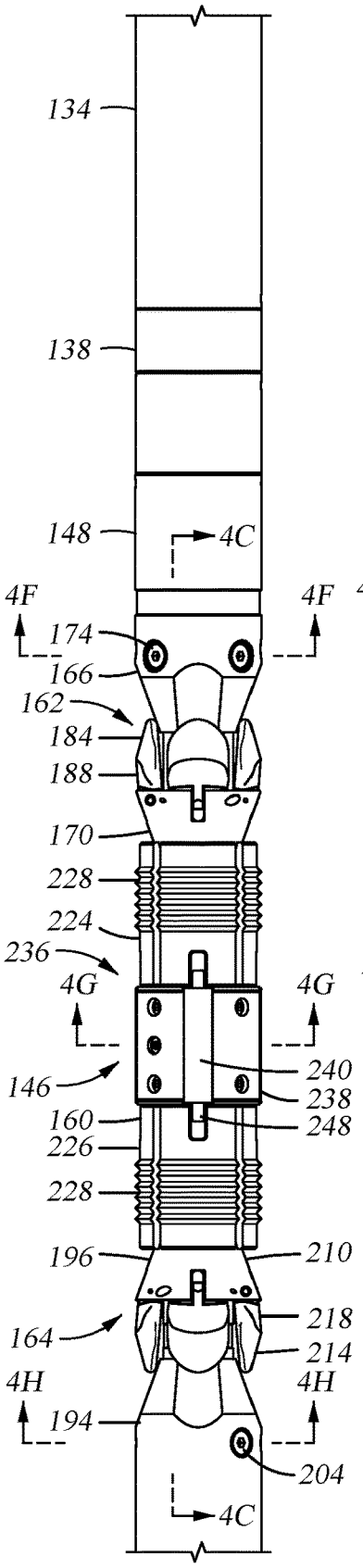
Fig. 2D1
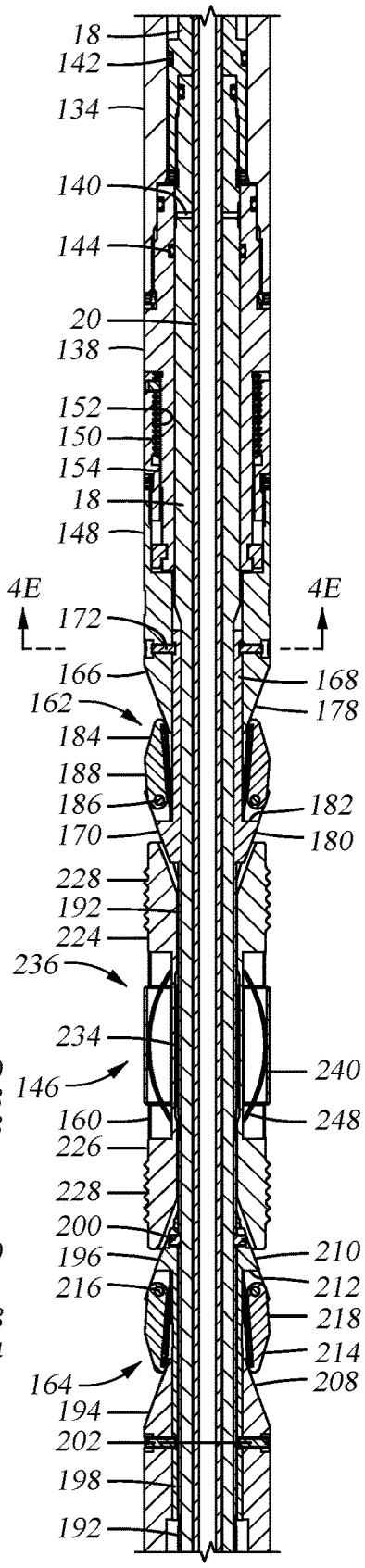
Fig. 2D2
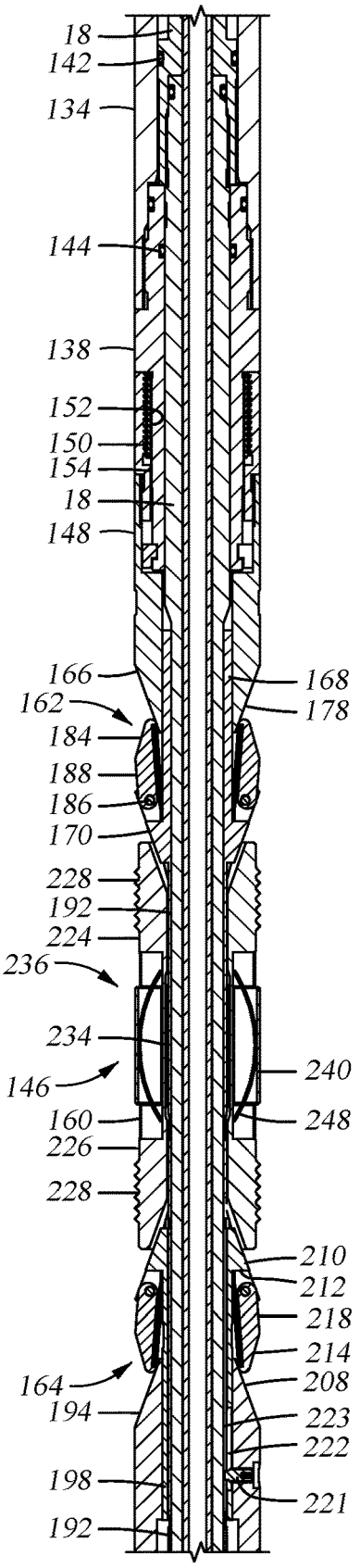
Fig. 2D3

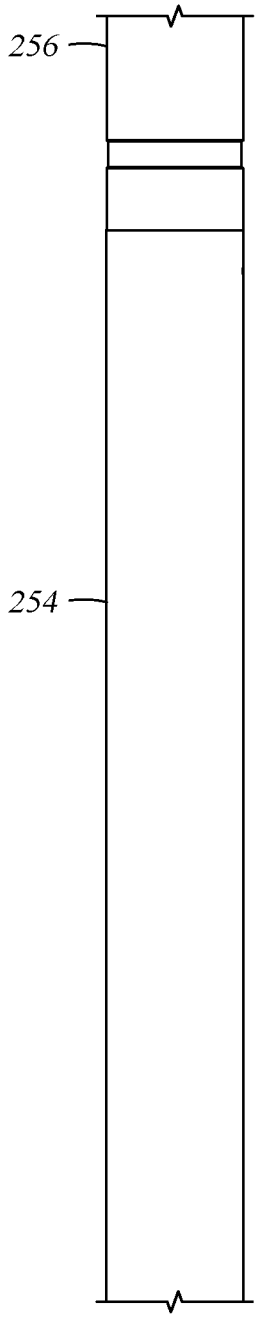
Fig. 2E1
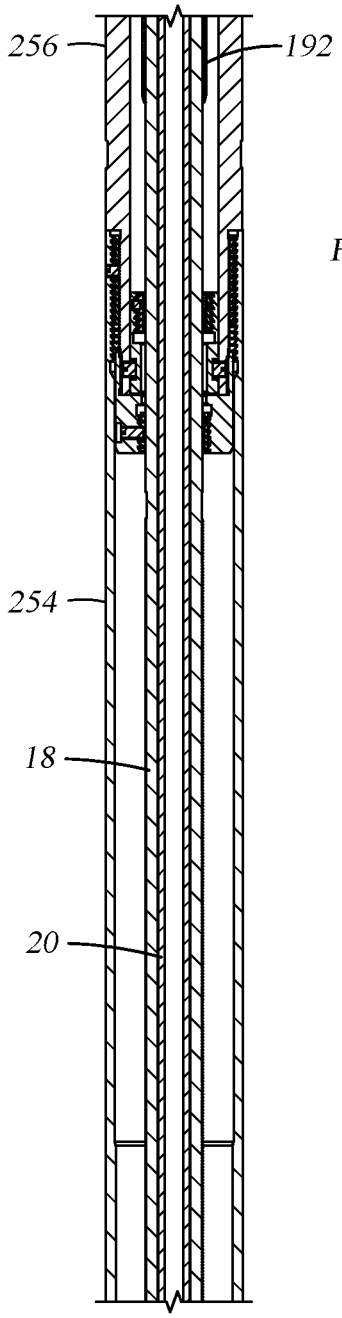
Fig. 2E2
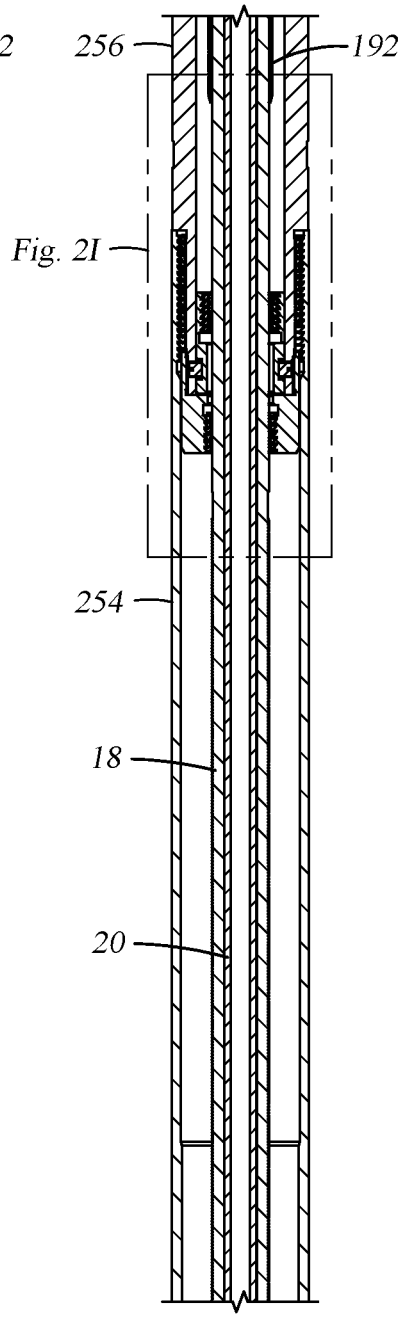
Fig. 2E3

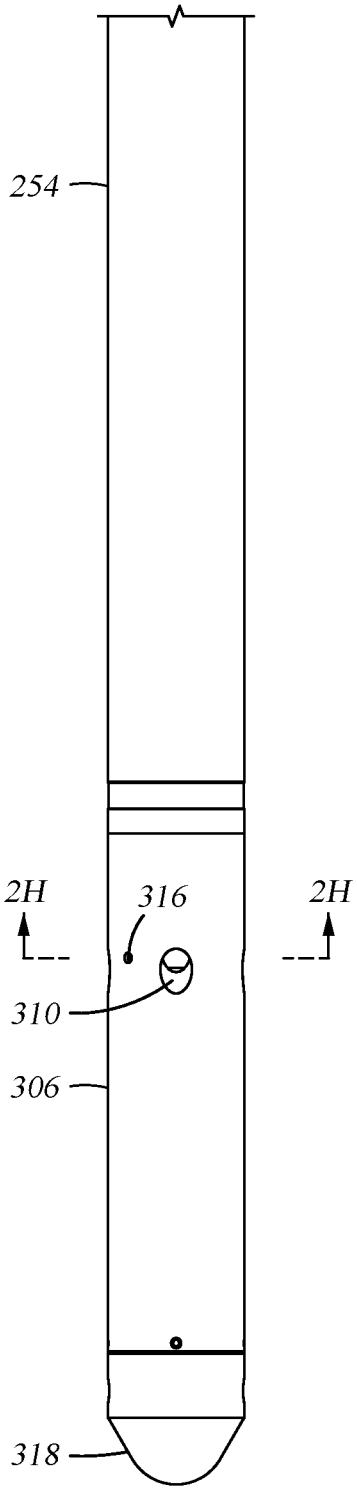
Fig. 2F1
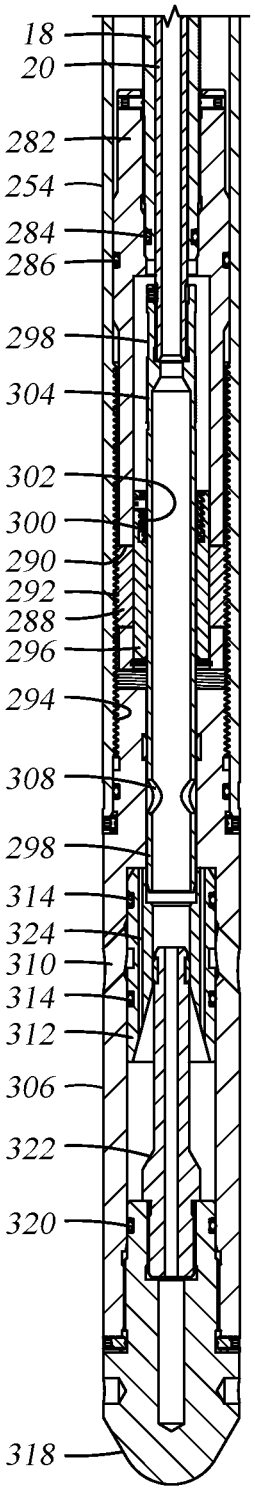
Fig. 2F2
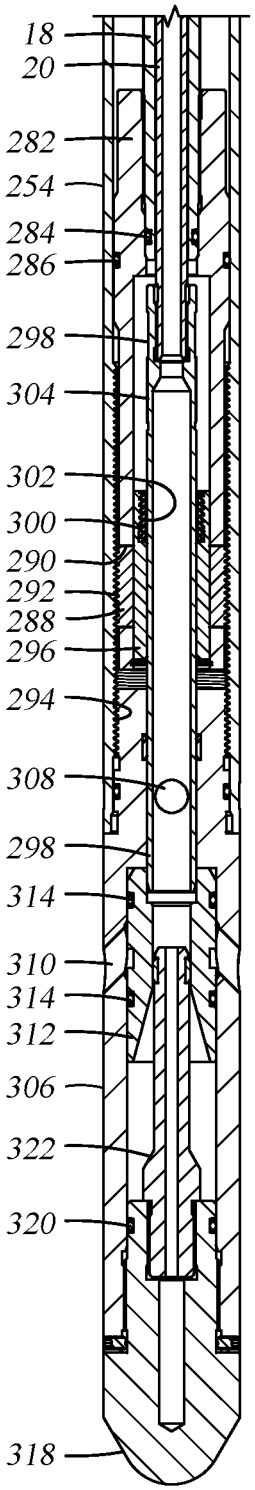
Fig. 2F3

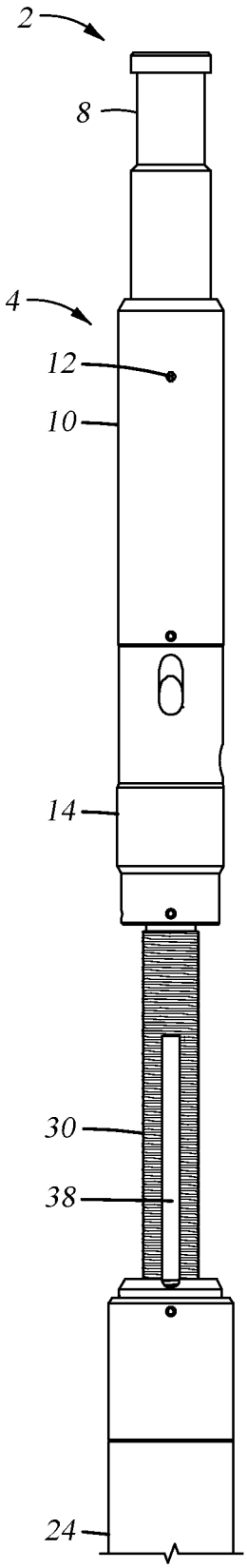
Fig. 6A1
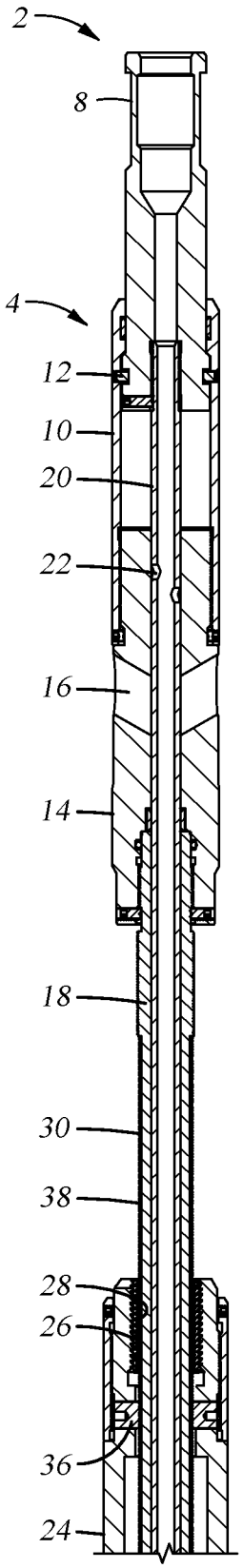
Fig. 6A2
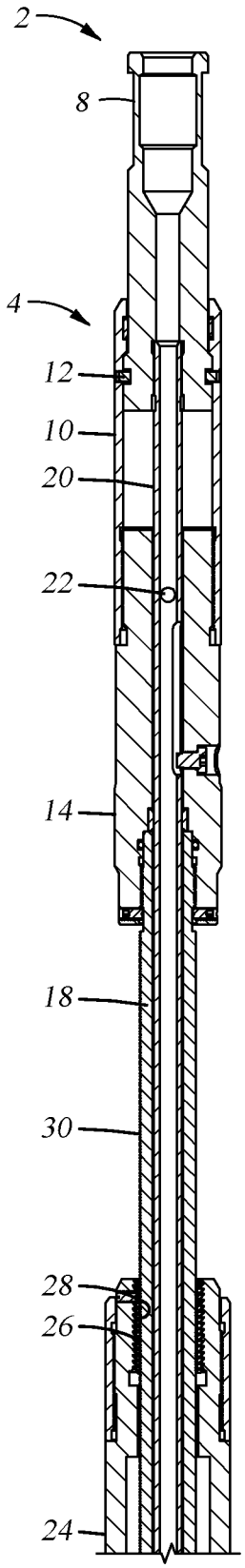
Fig. 6A3

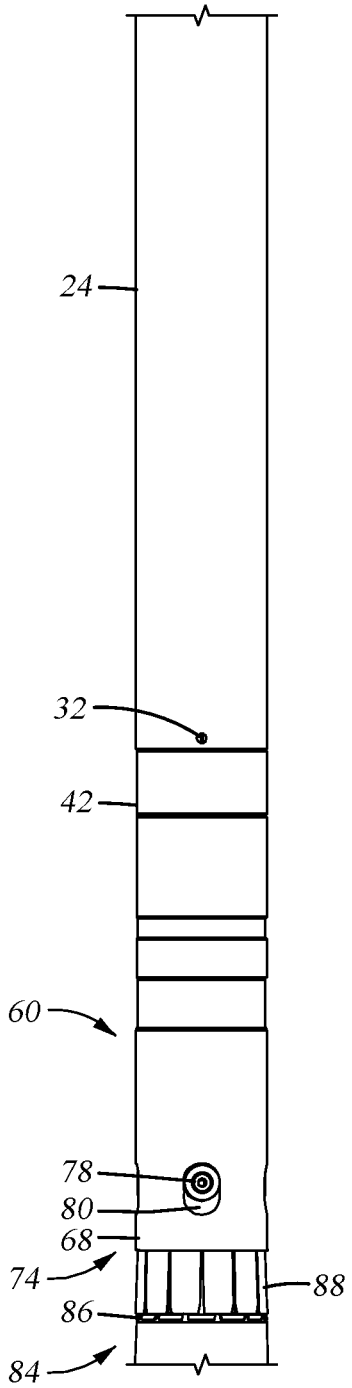
Fig. 6B1
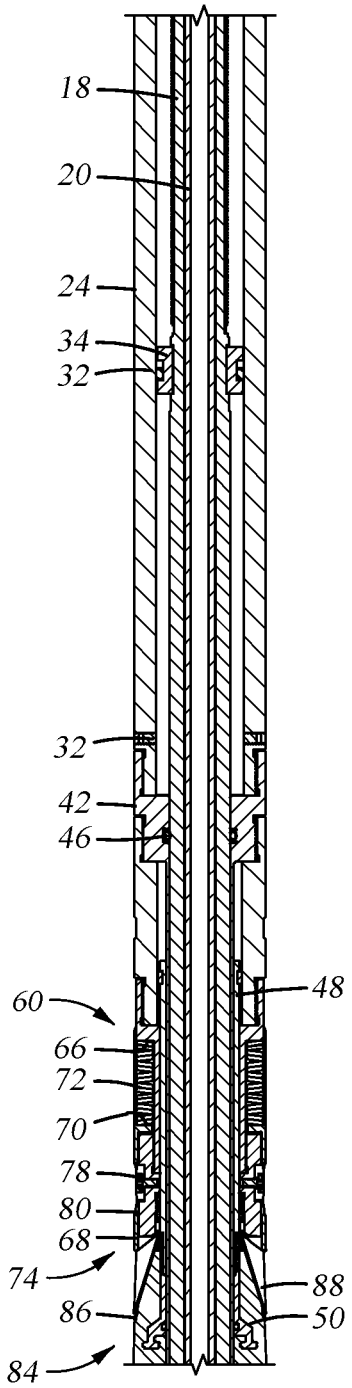
Fig. 6B2
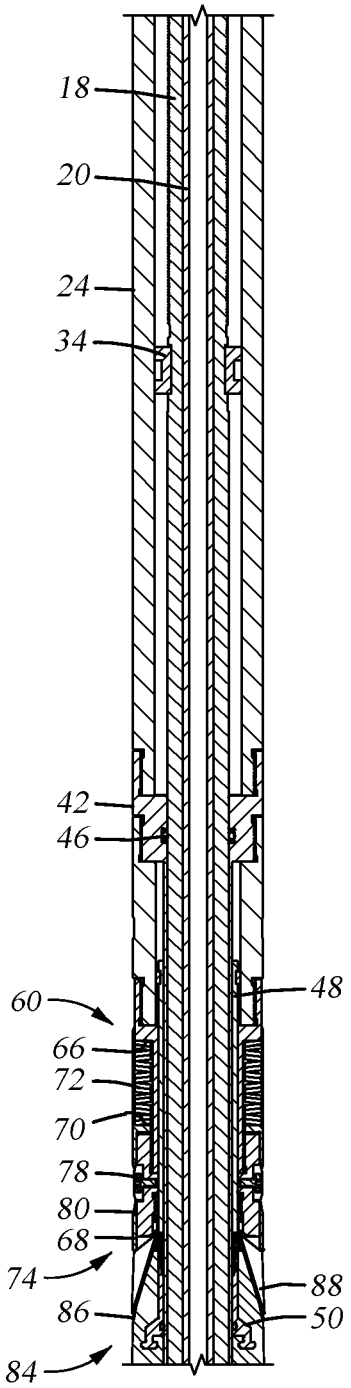
Fig. 6B3

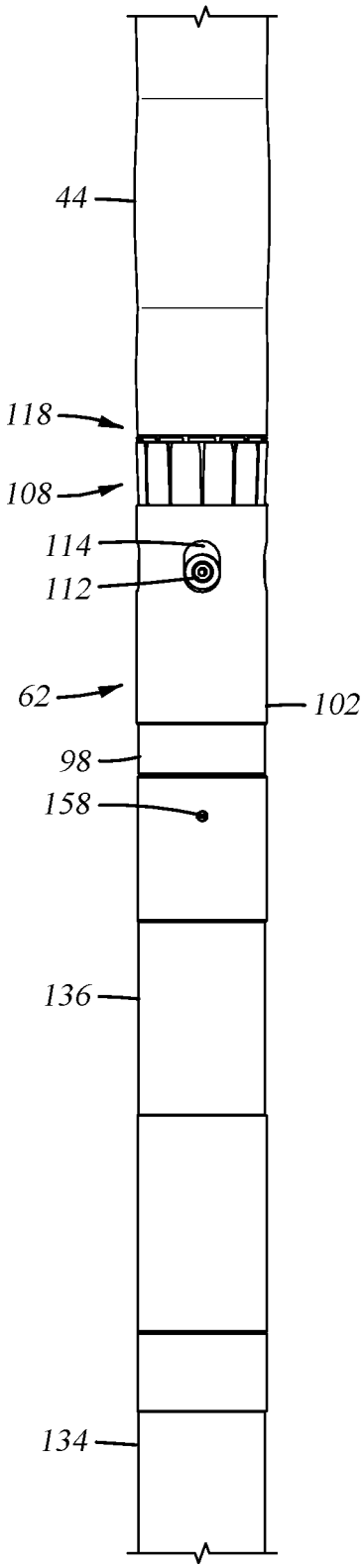
Fig. 6C1
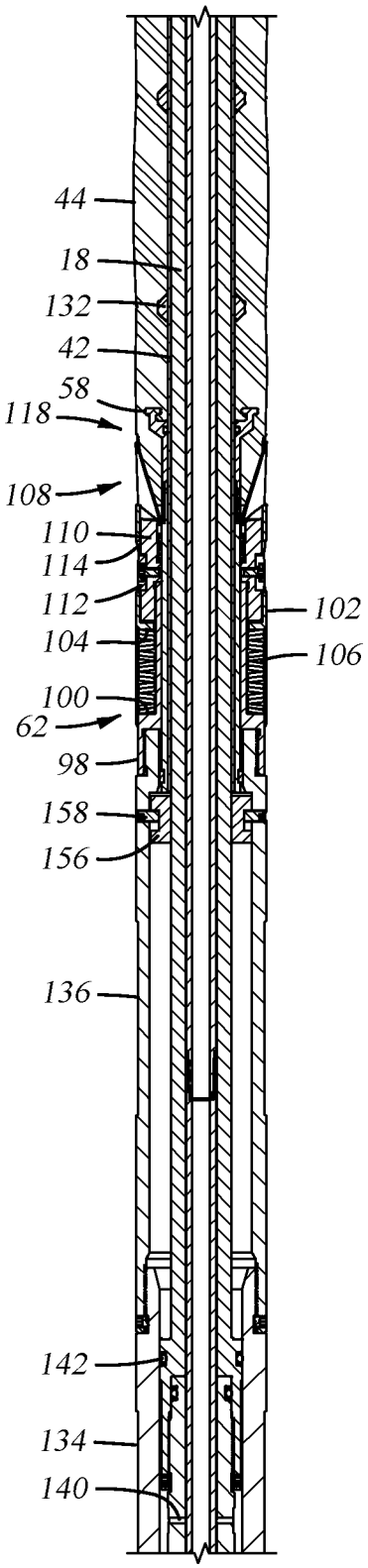
Fig. 6C2
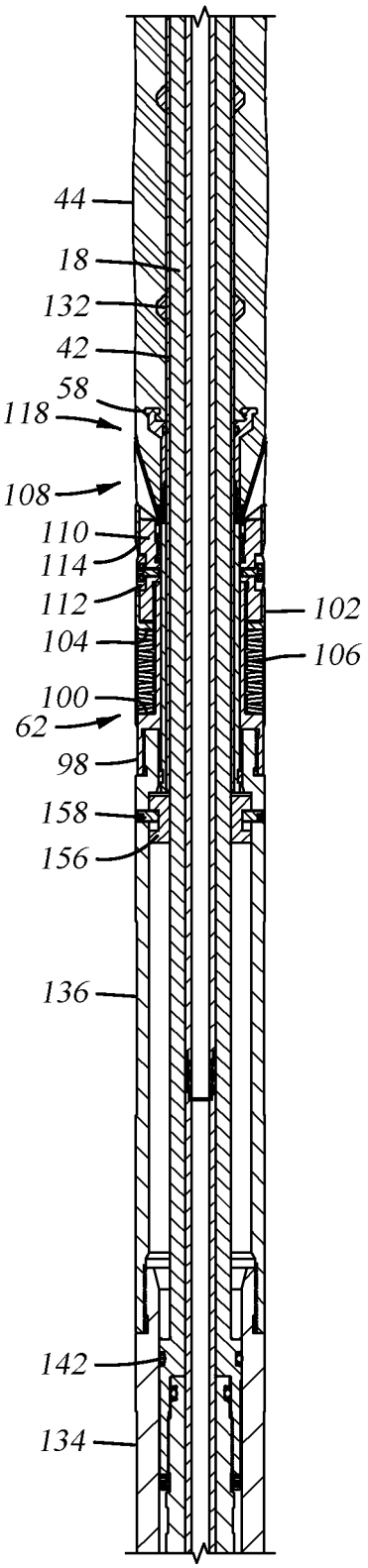
Fig. 6C3

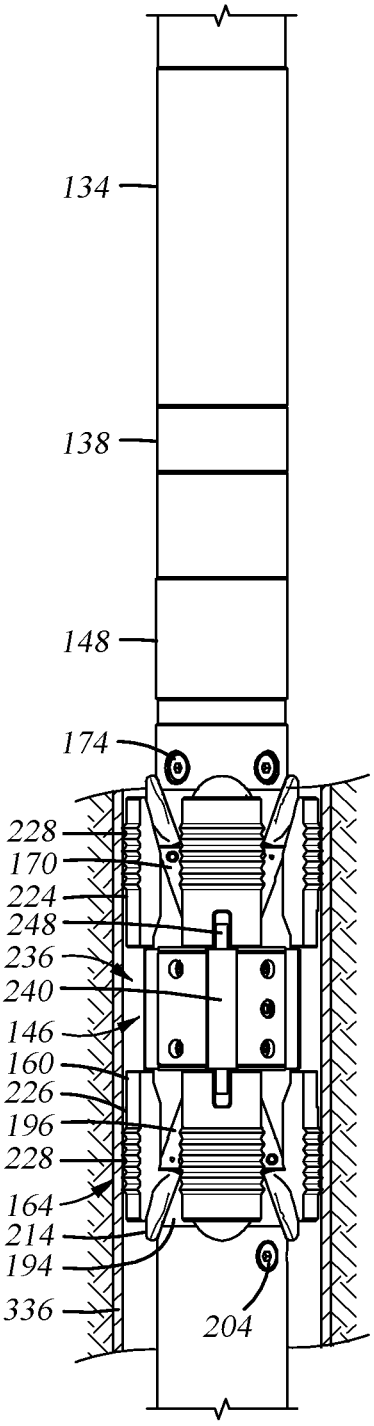
Fig. 6D1
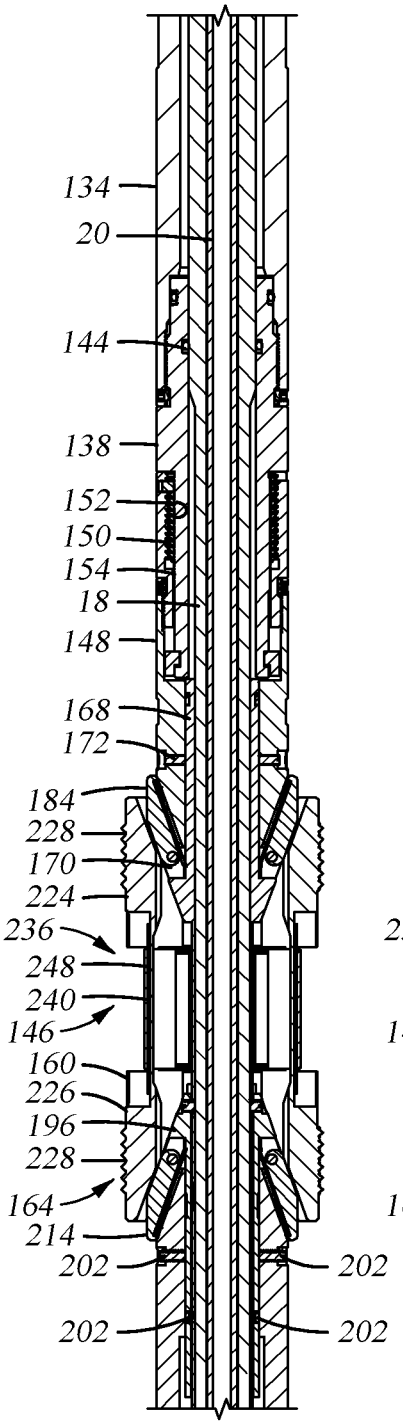
Fig. 6D2
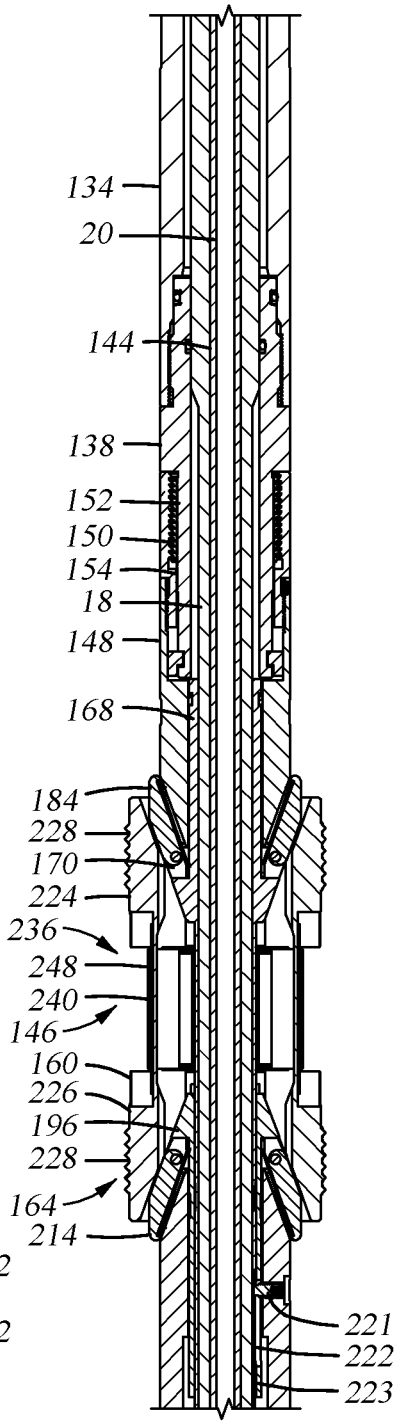
Fig. 6D3

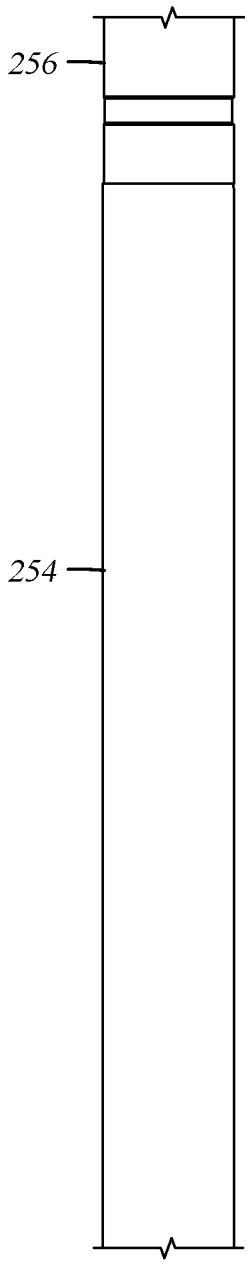
Fig. 6E1
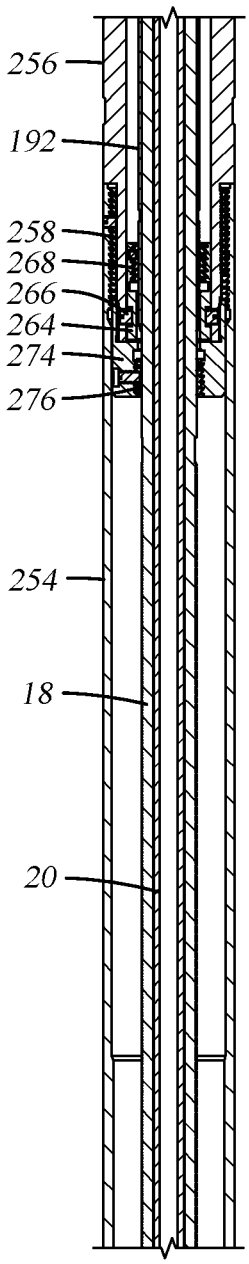
Fig. 6E2
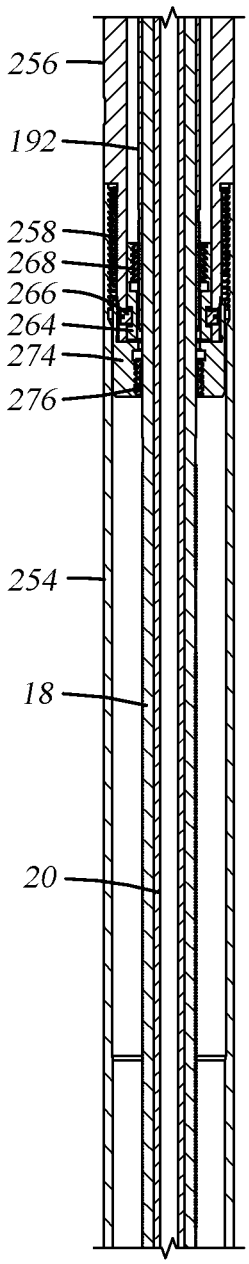
Fig. 6E3

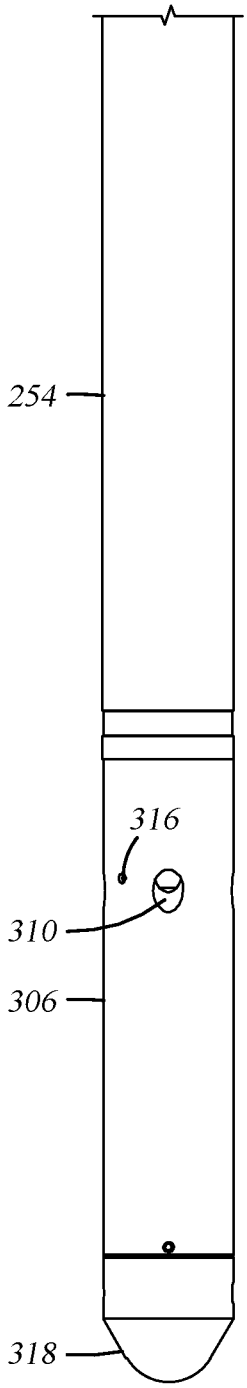
Fig. 6F1
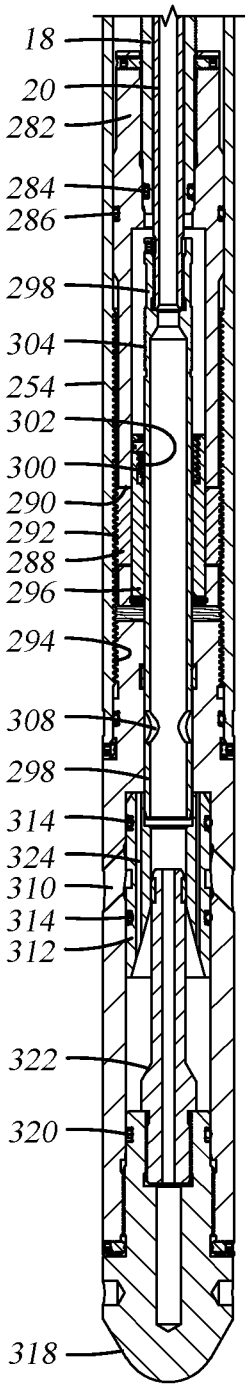
Fig. 6F2
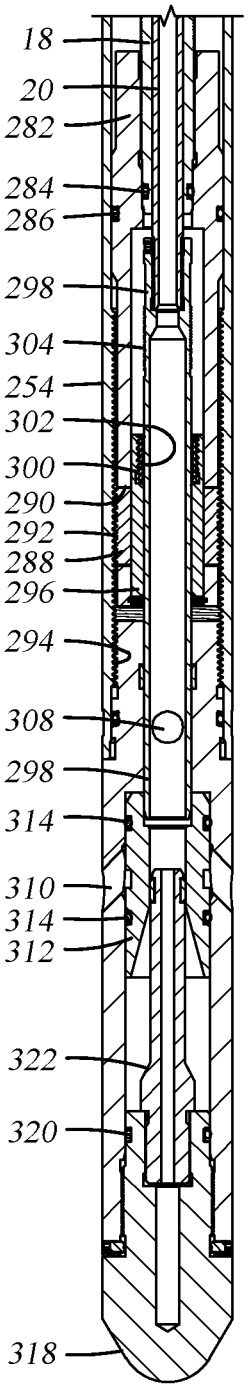
Fig. 6F3

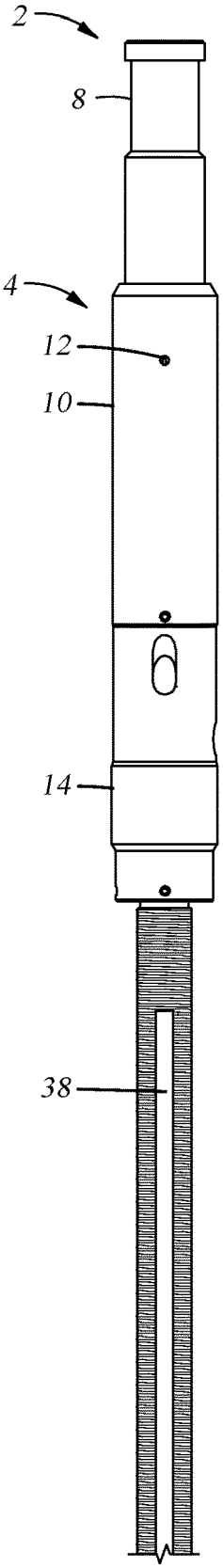
Fig. 7A1
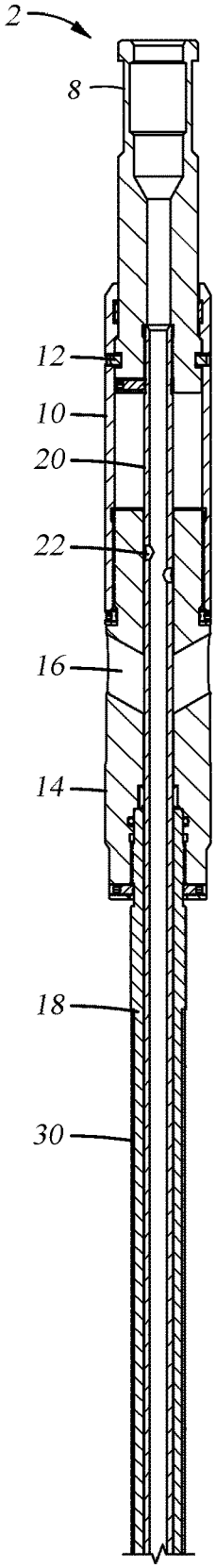
Fig. 7A2
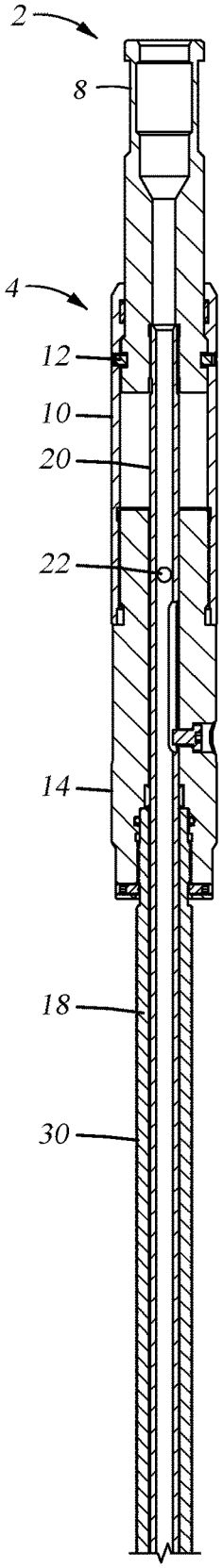
Fig. 7A3

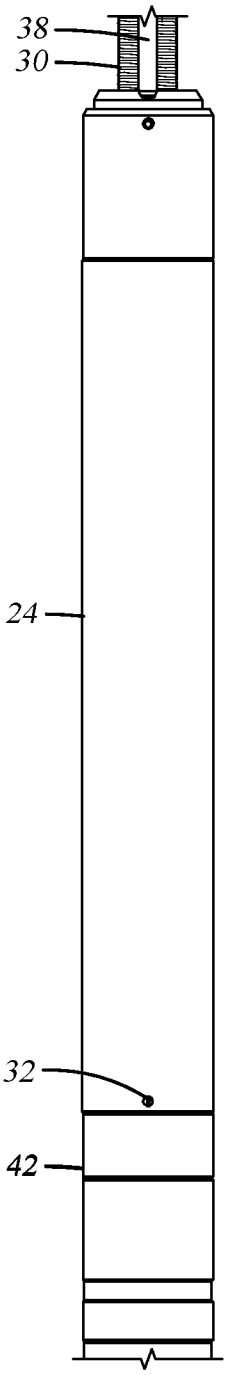
Fig. 7B1
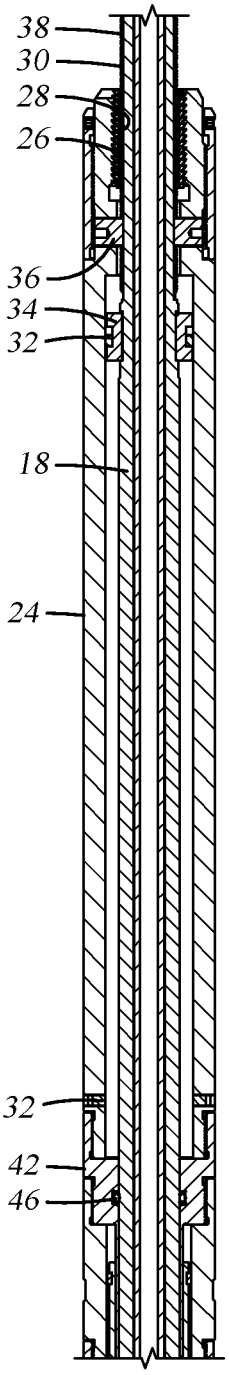
Fig. 7B2
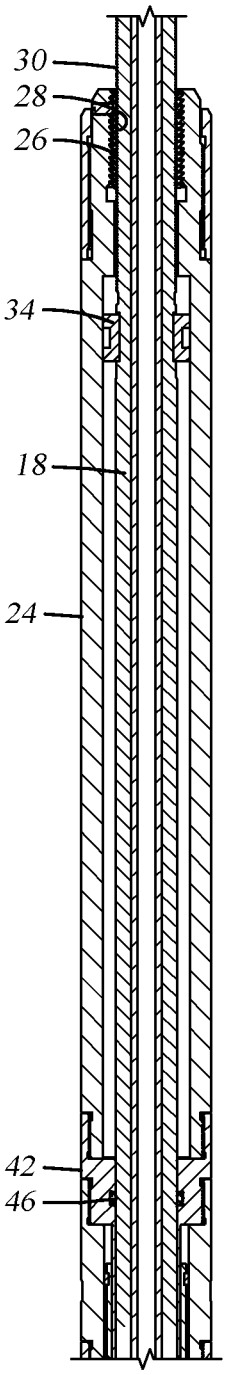
Fig. 7B3

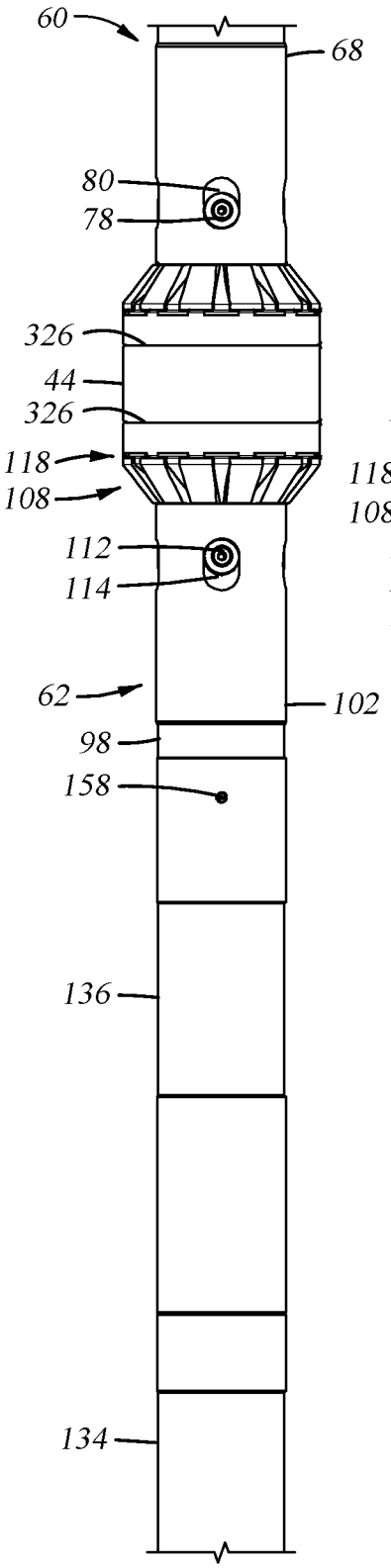
Fig. 7C1
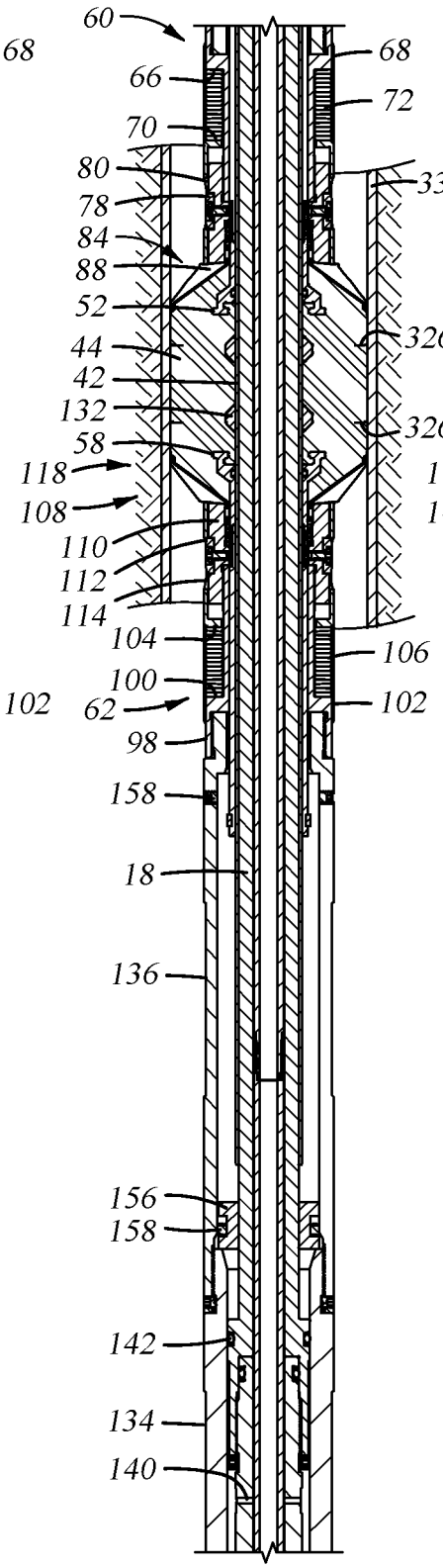
Fig. 7C2
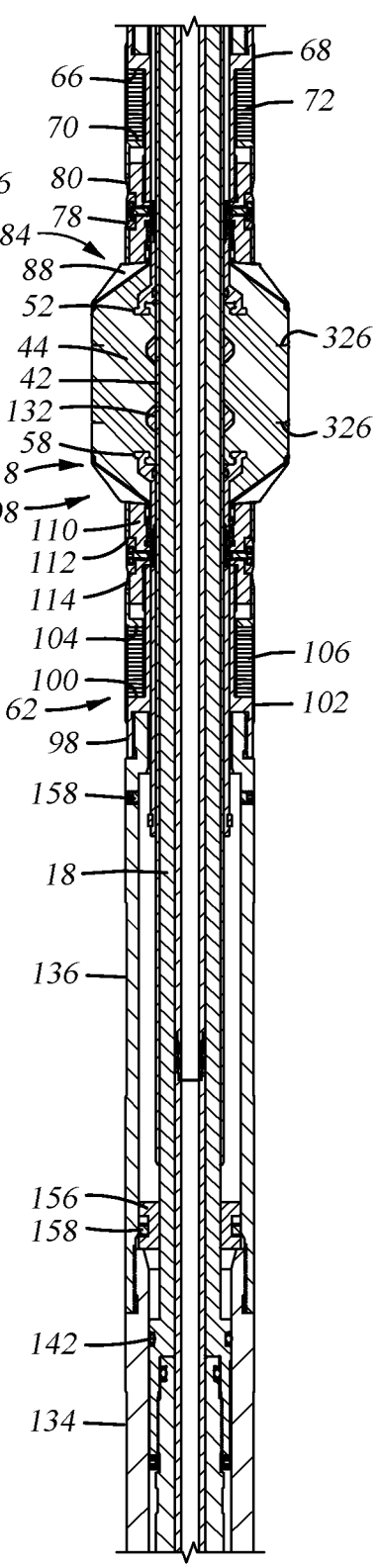
Fig. 7C3

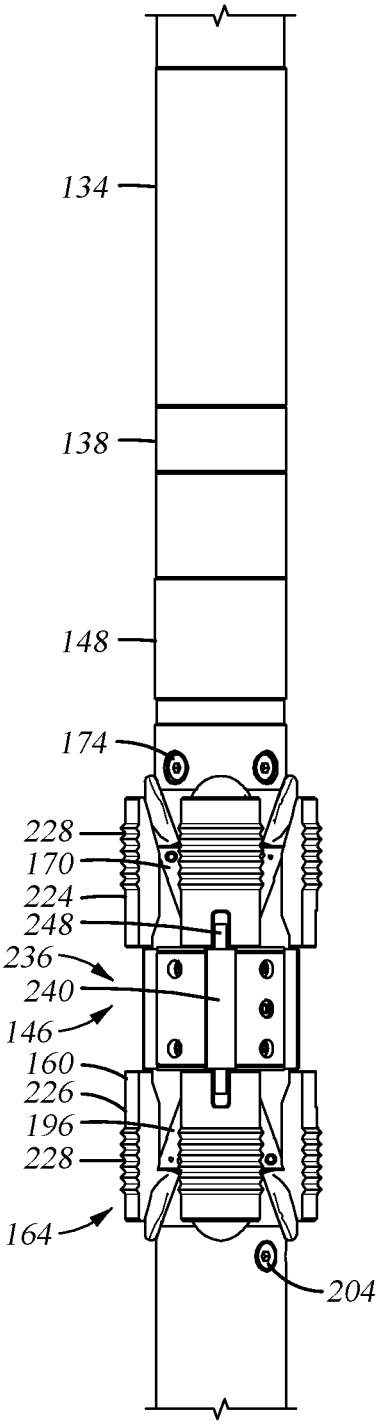
Fig. 7D1
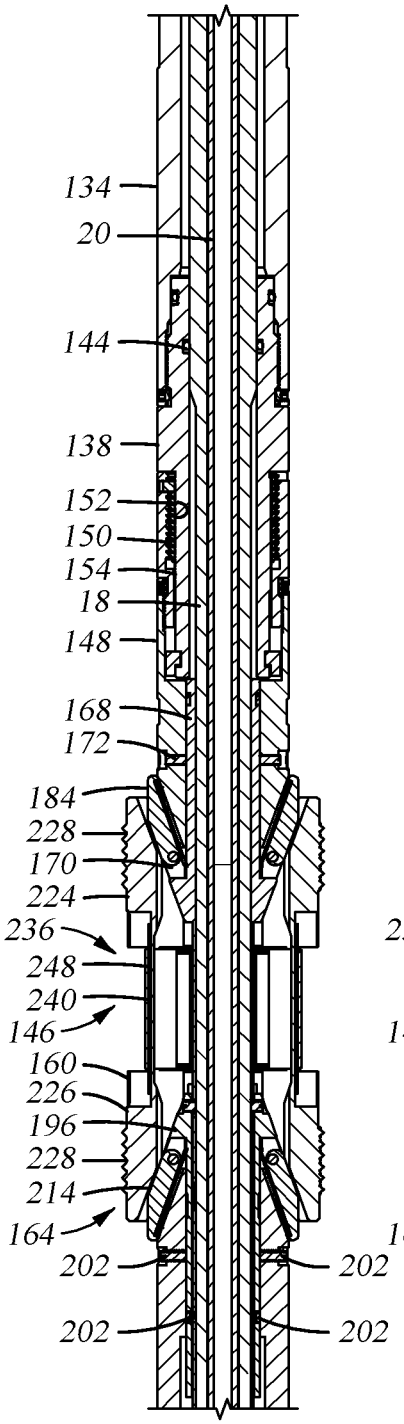
Fig. 7D2
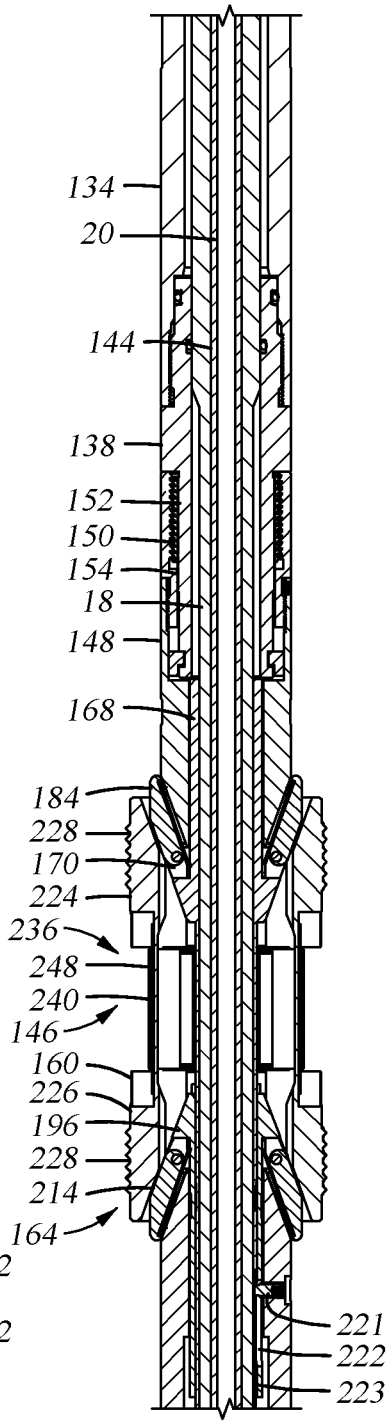
Fig. 7D3

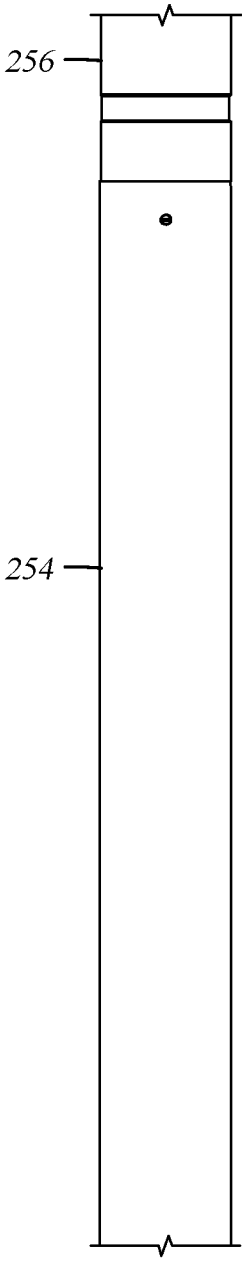
Fig. 7E1
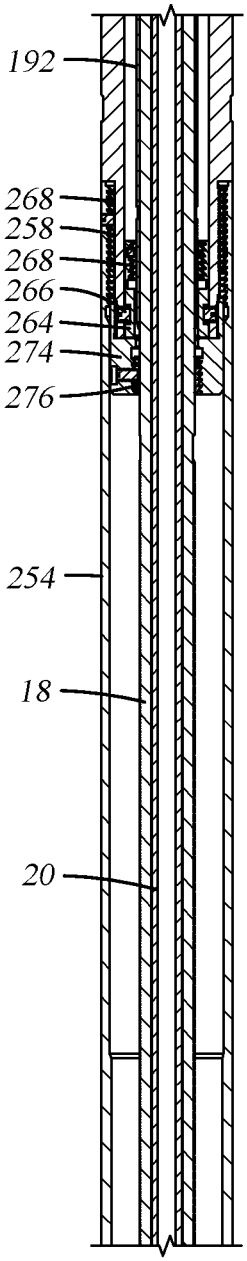
Fig. 7E2
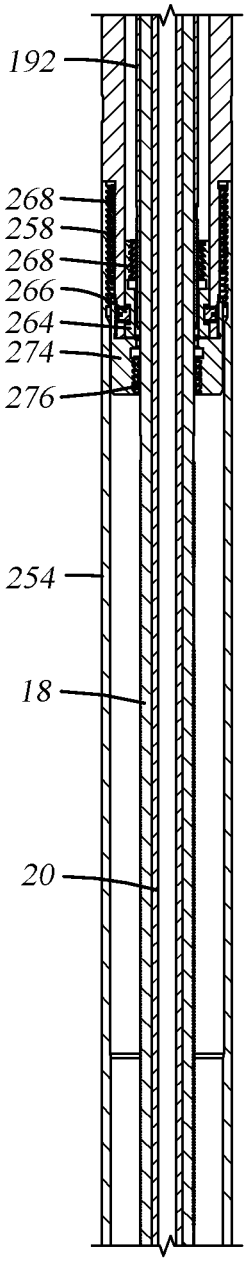
Fig. 7E3

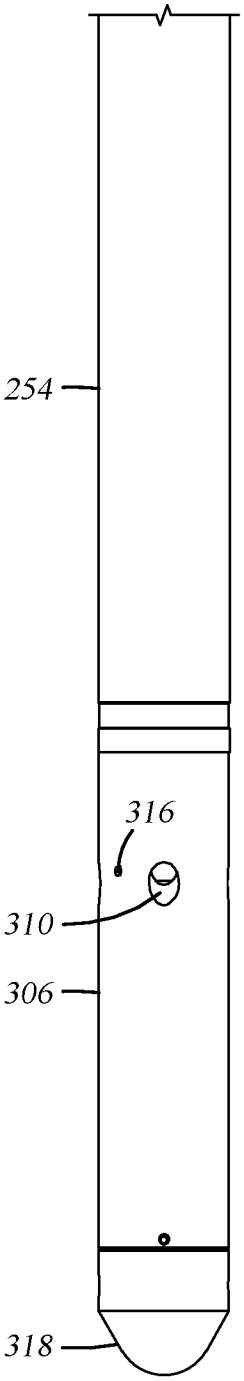
Fig. 7F1
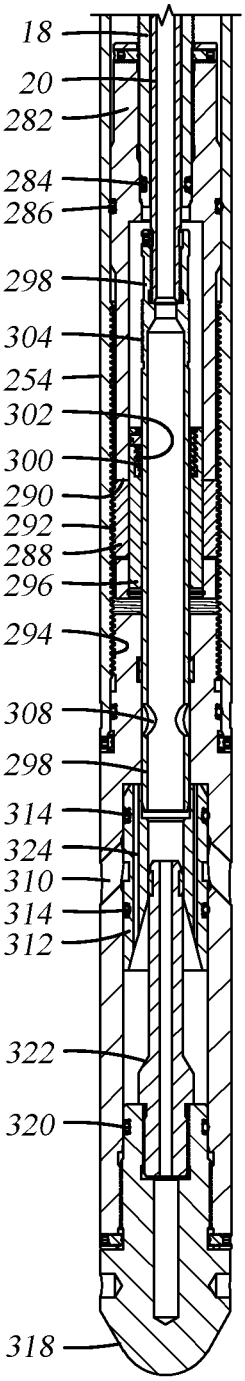
Fig. 7F2
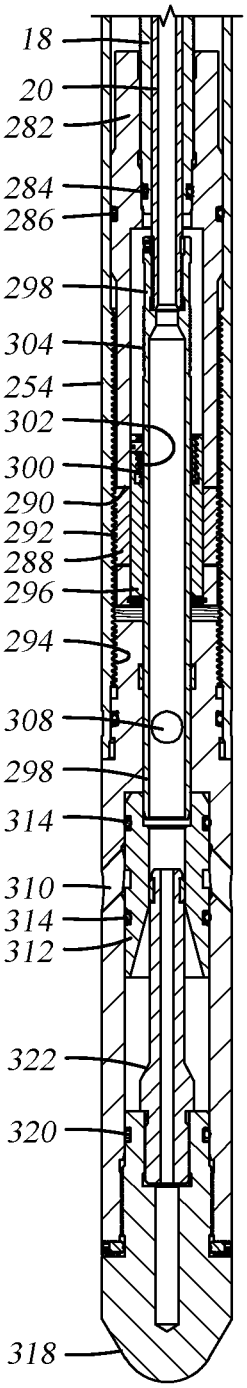
Fig. 7F3

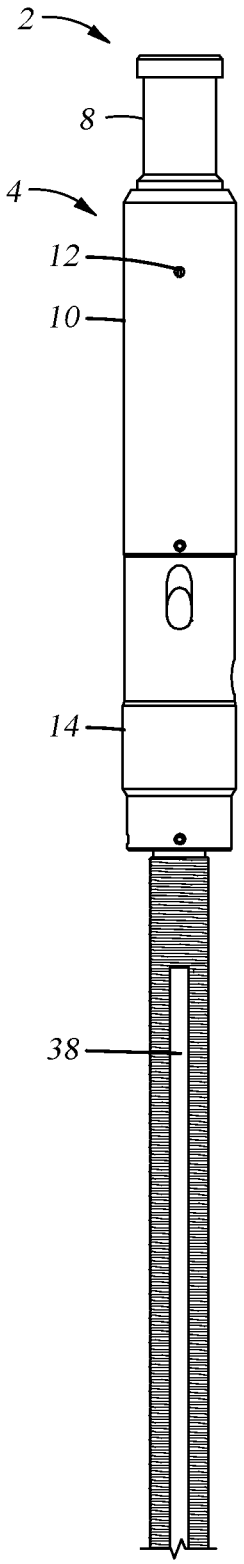
Fig. 8A1
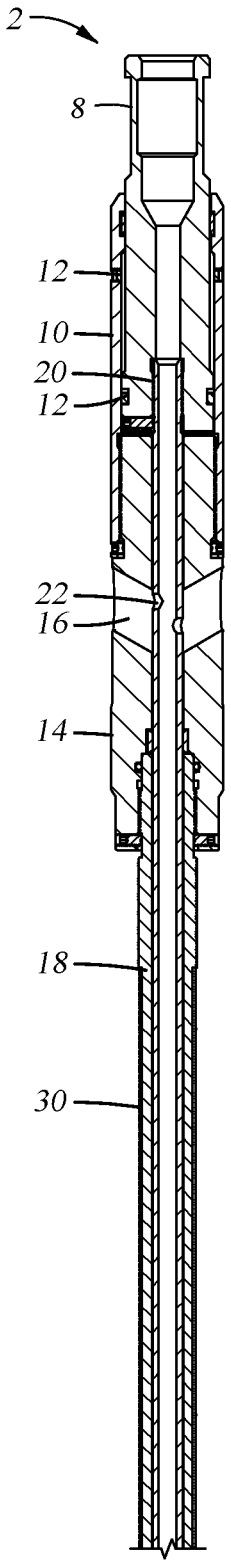
Fig. 8A2
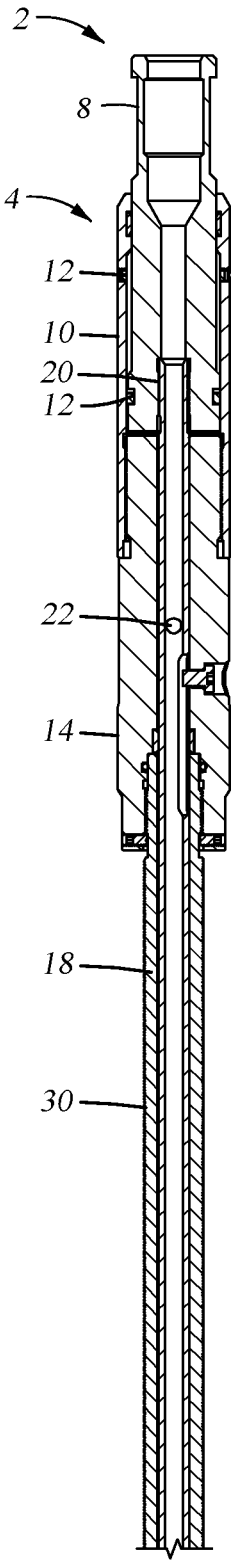
Fig. 8A3

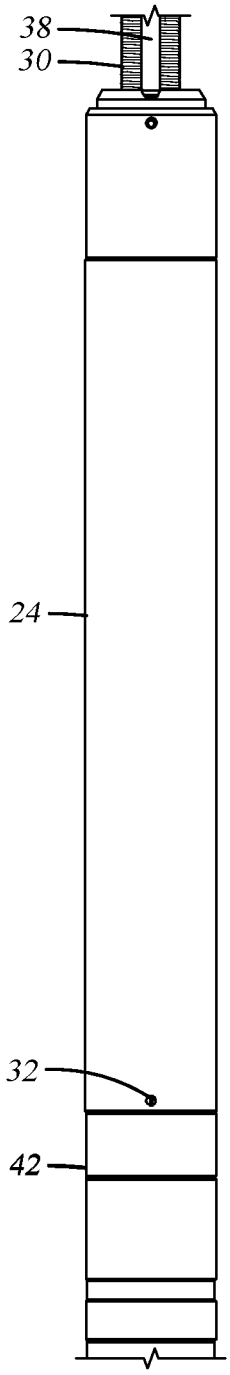
Fig. 8B1
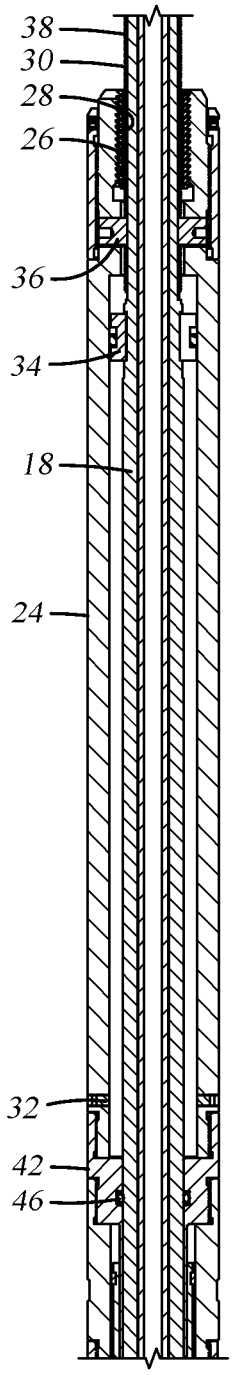
Fig. 8B2
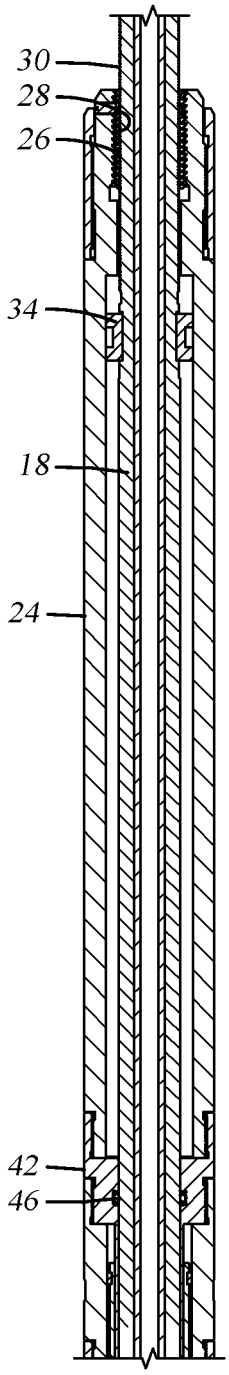
Fig. 8B3

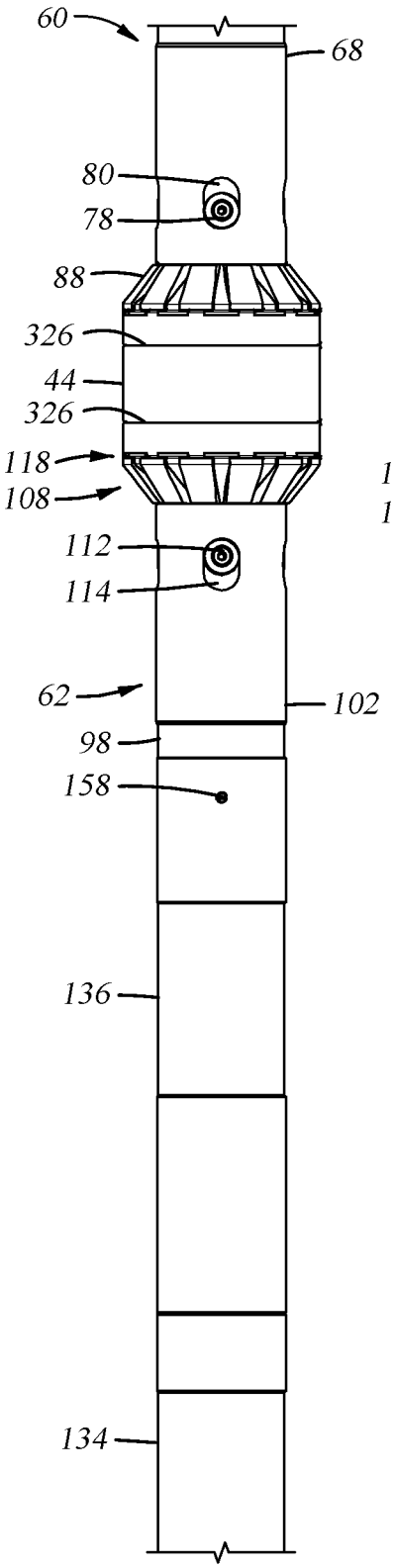
Fig. 8C1
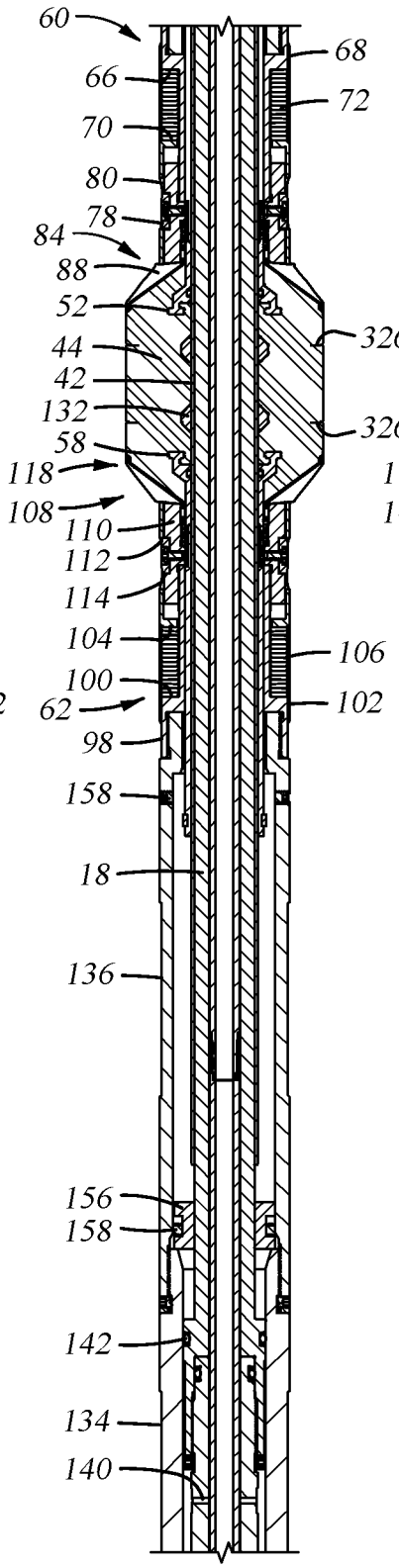
Fig. 8C2
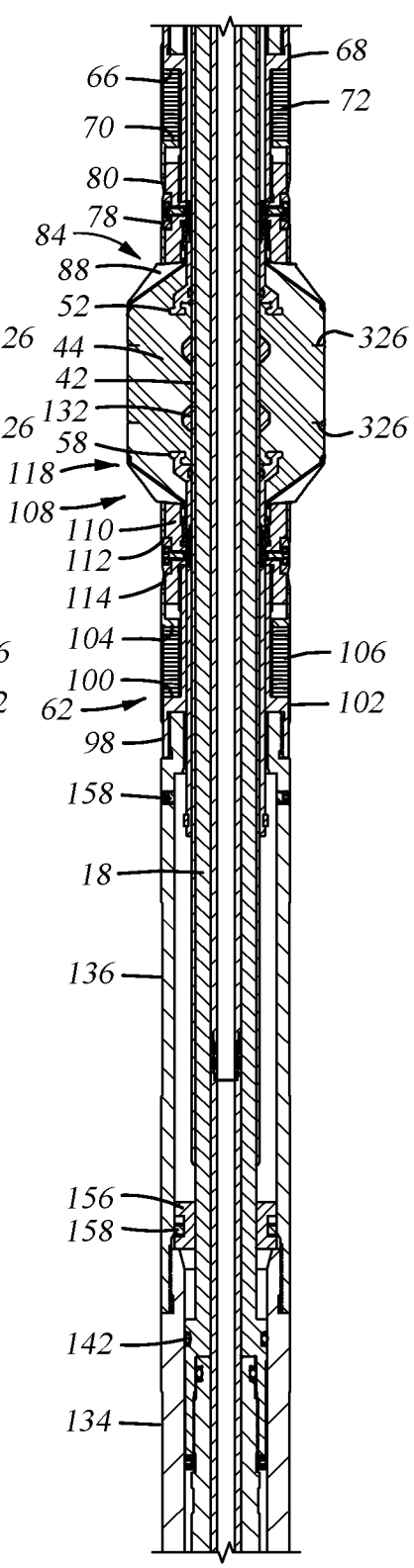
Fig. 8C3

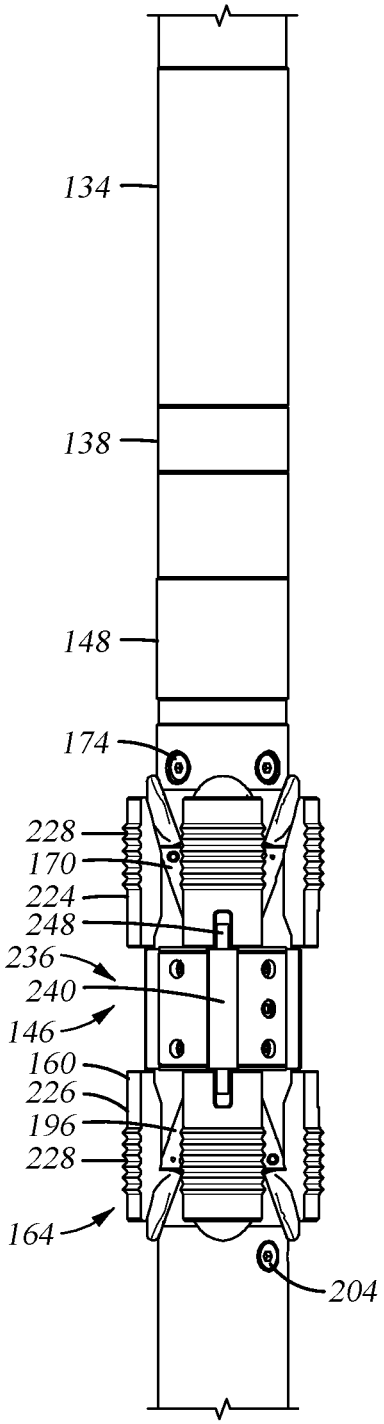
Fig. 8D1
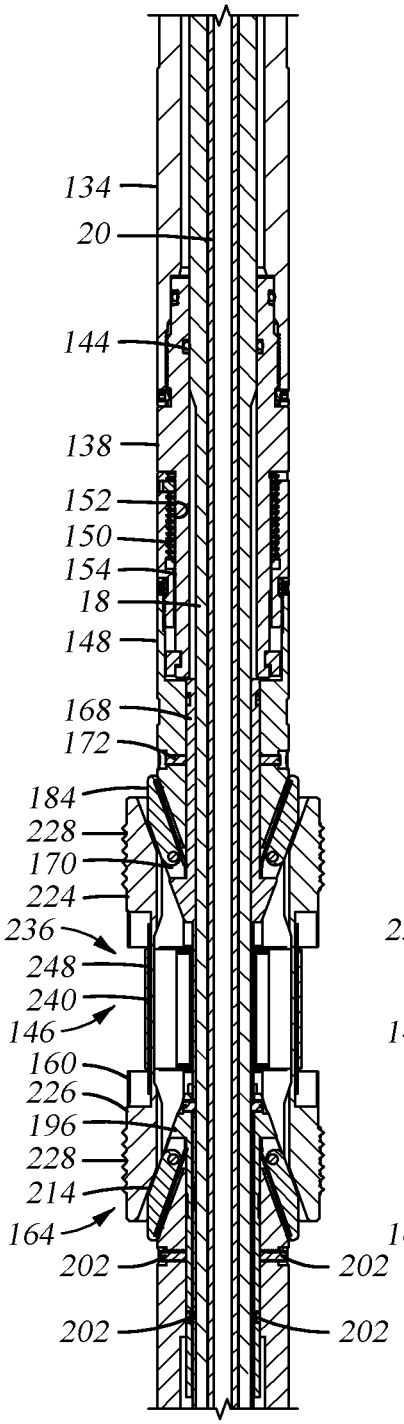
Fig. 8D2
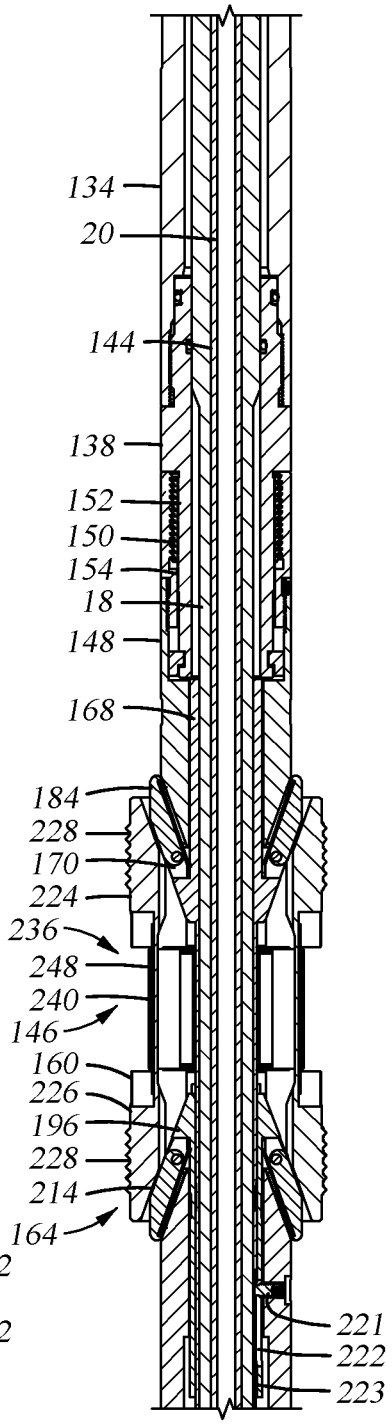
Fig. 8D3

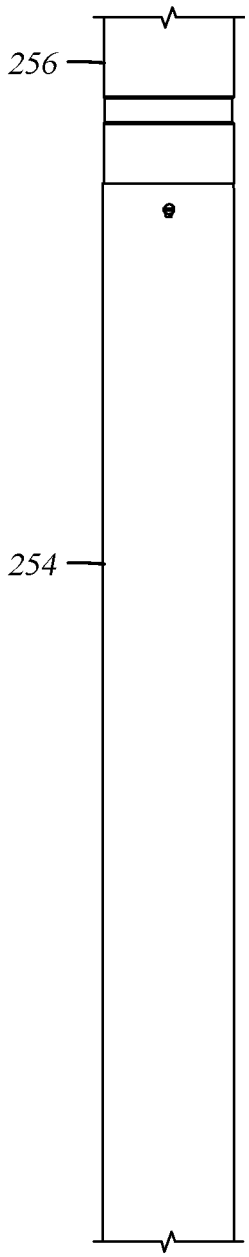
Fig. 8E1
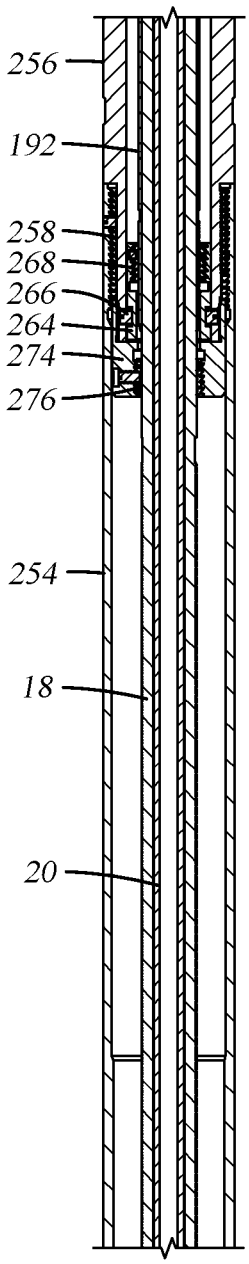
Fig. 8E2
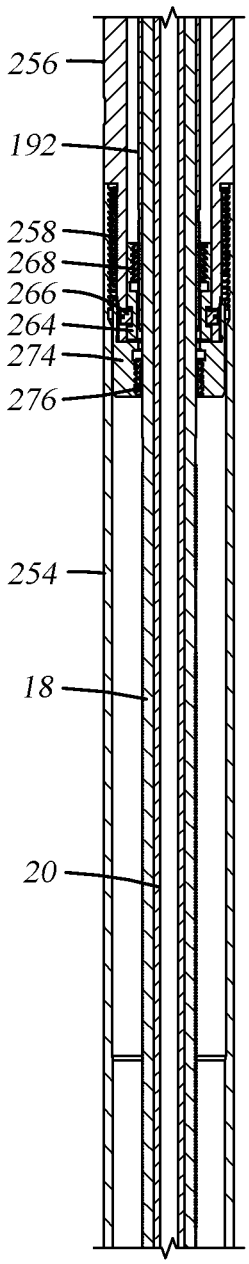
Fig. 8E3

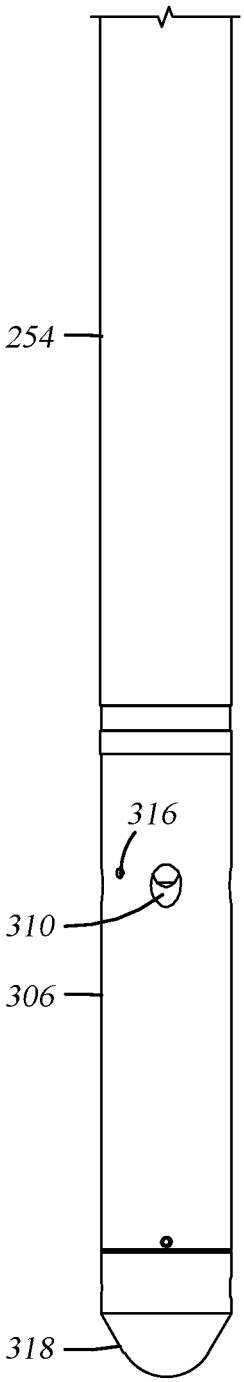
Fig. 8F1
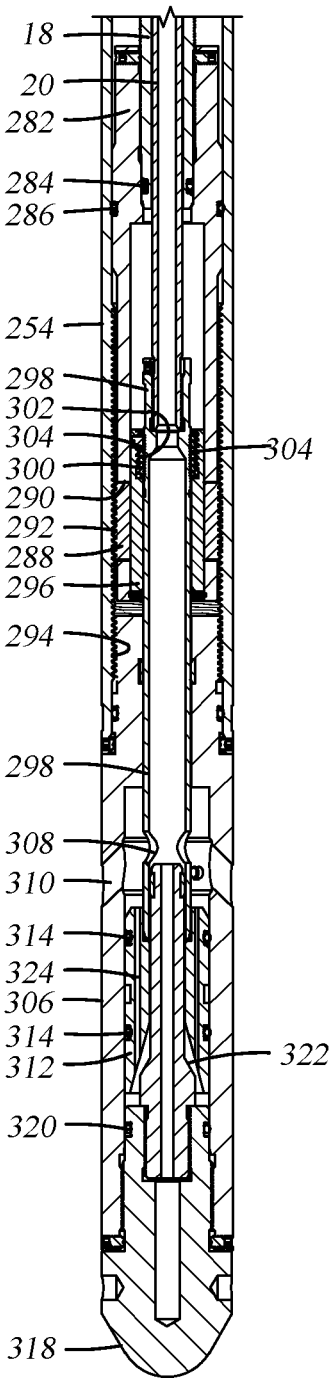
Fig. 8F2
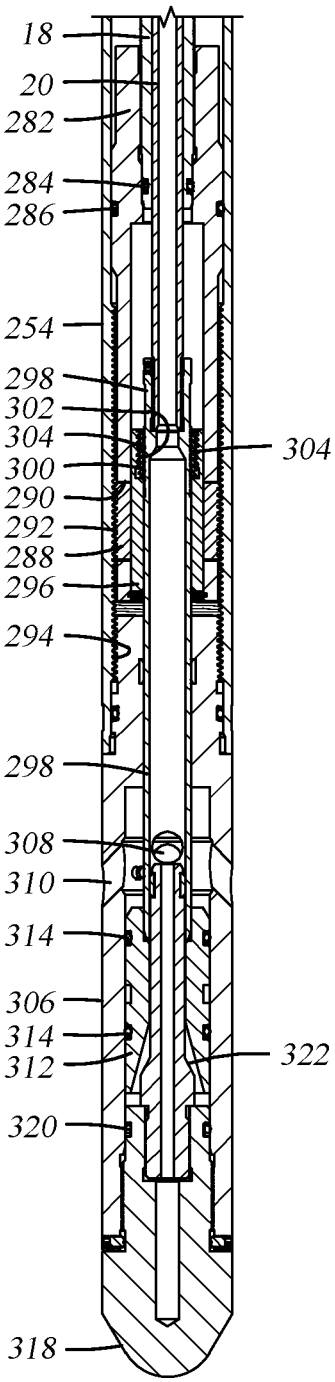
Fig. 8F3

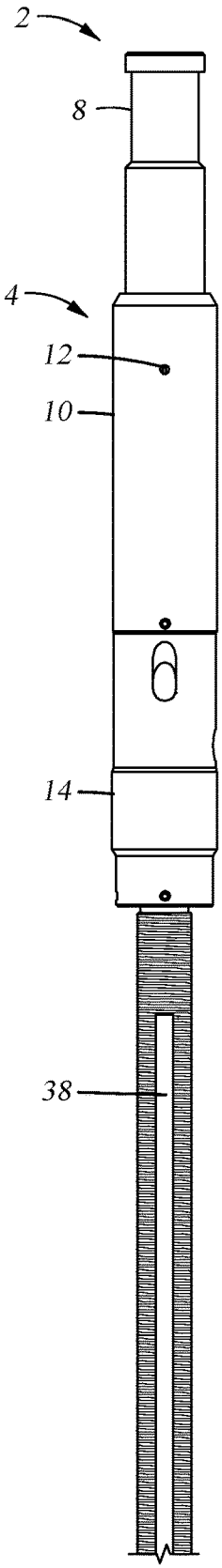
Fig. 9A1
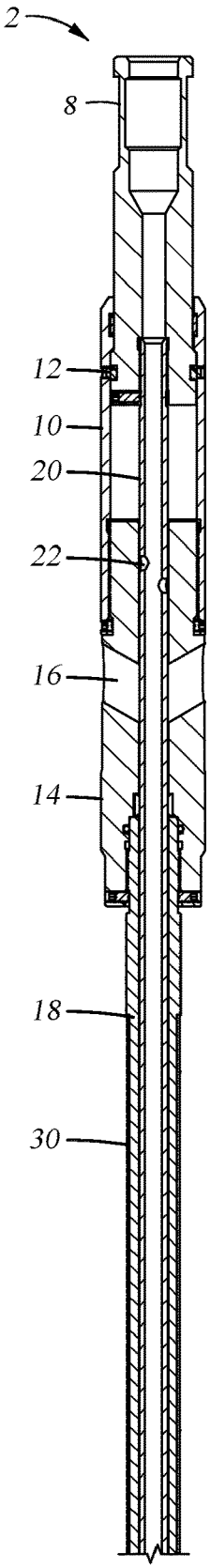
Fig. 9A2
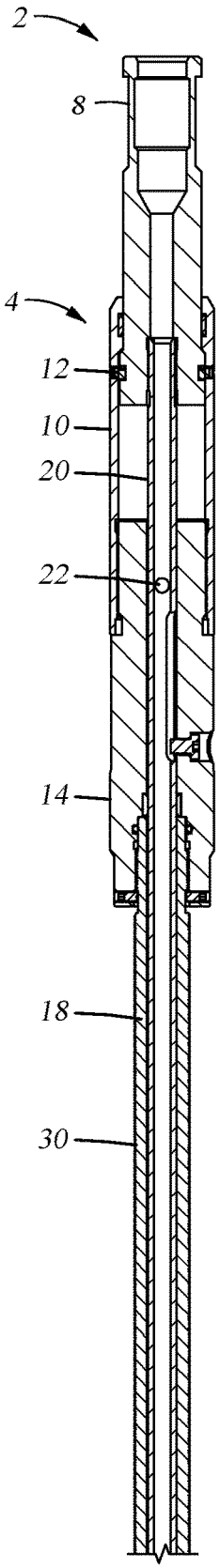
Fig. 9A3

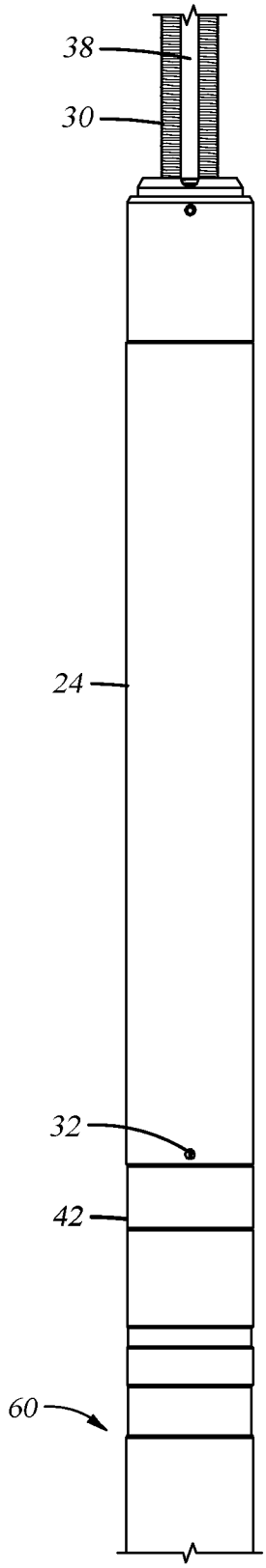
Fig. 9B1
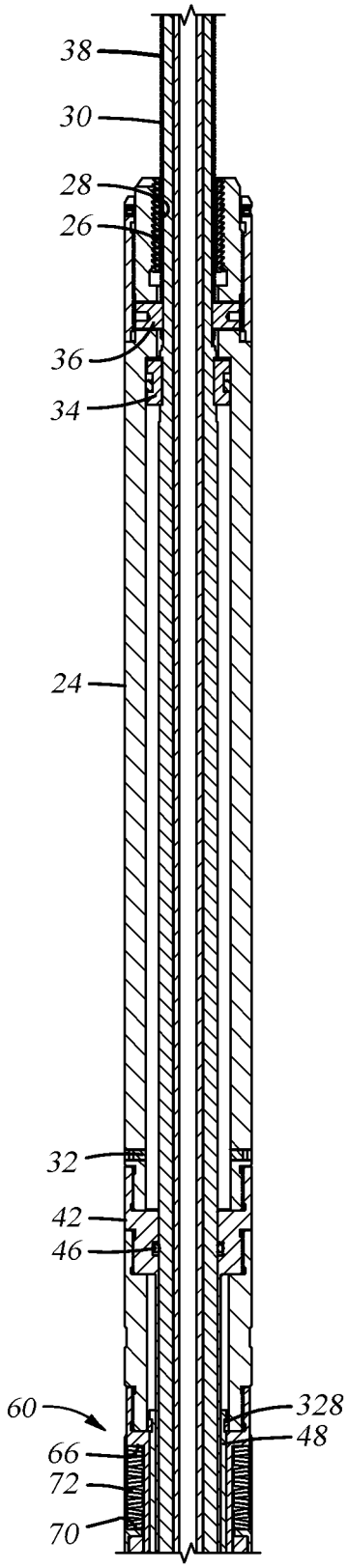
Fig. 9B2
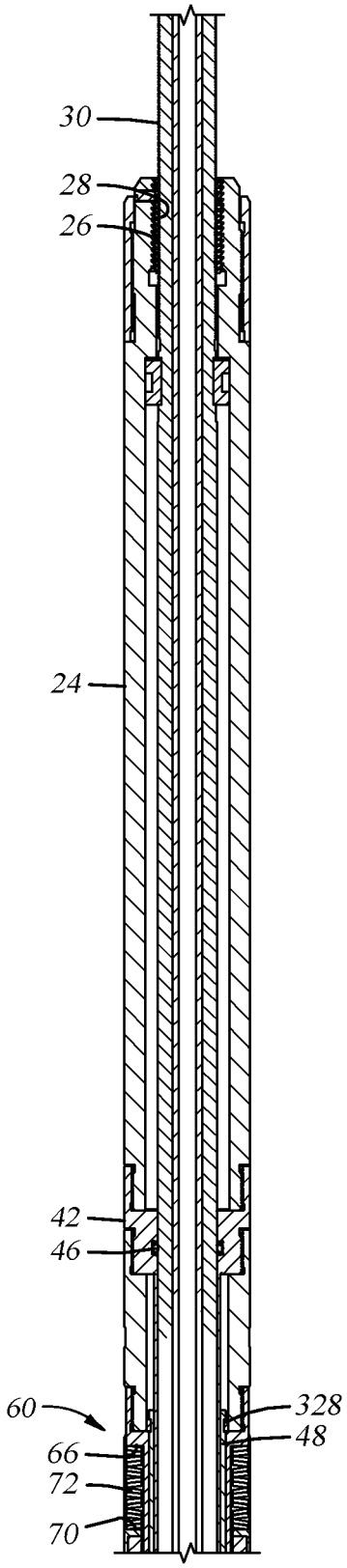
Fig. 9B3

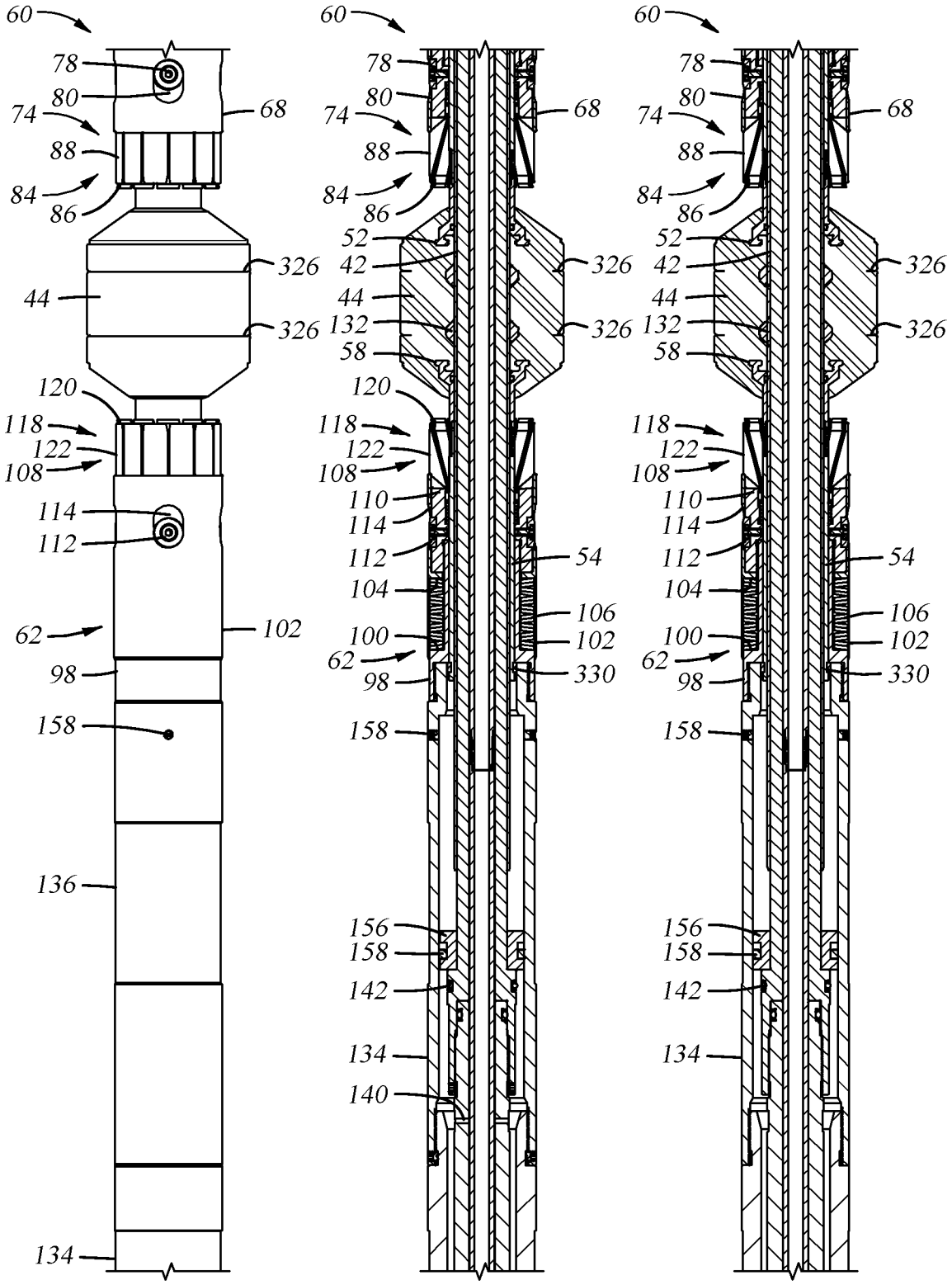
Fig. 9C1 Fig. 9C2 Fig. 9C3

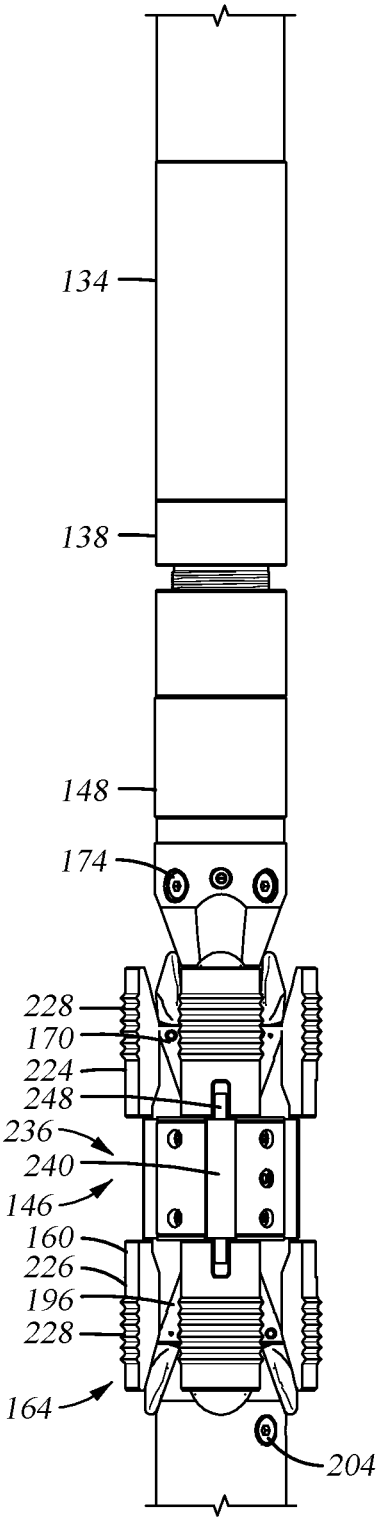
Fig. 9D1
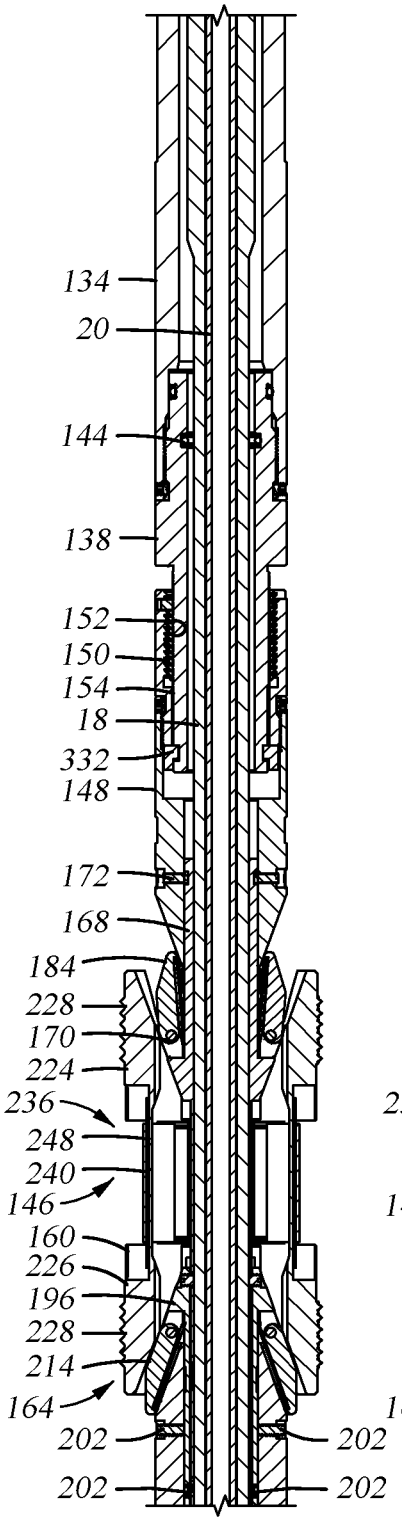
Fig. 9D2
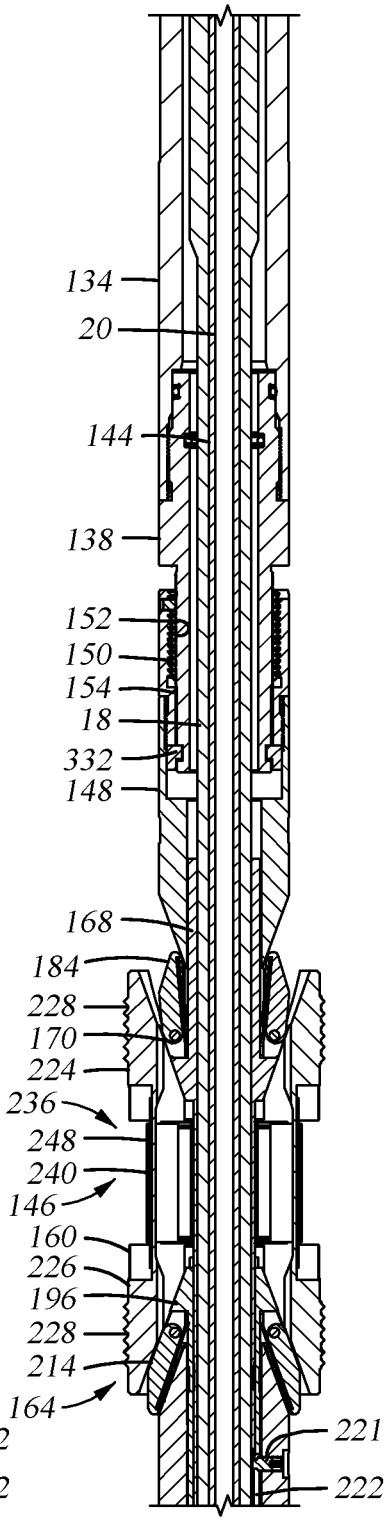
Fig. 9D3

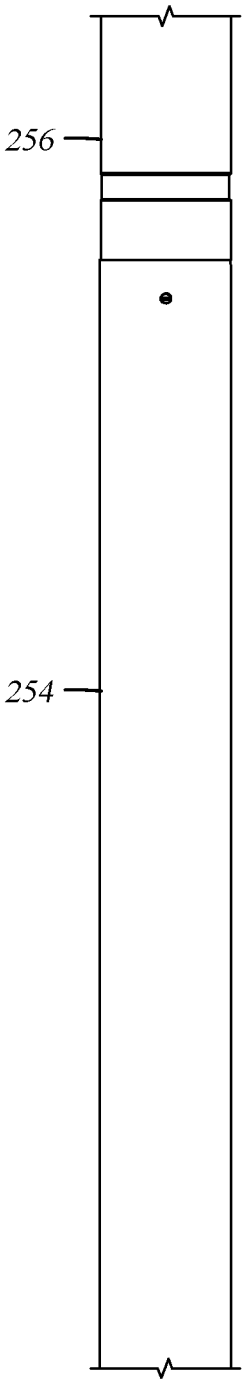
Fig. 9E1
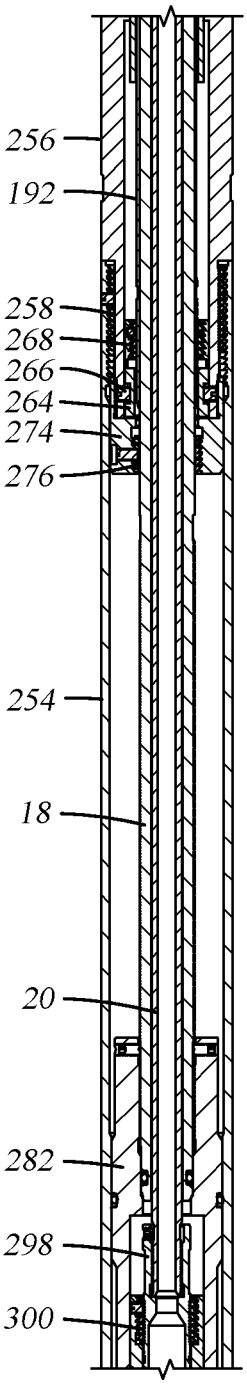
Fig. 9E2
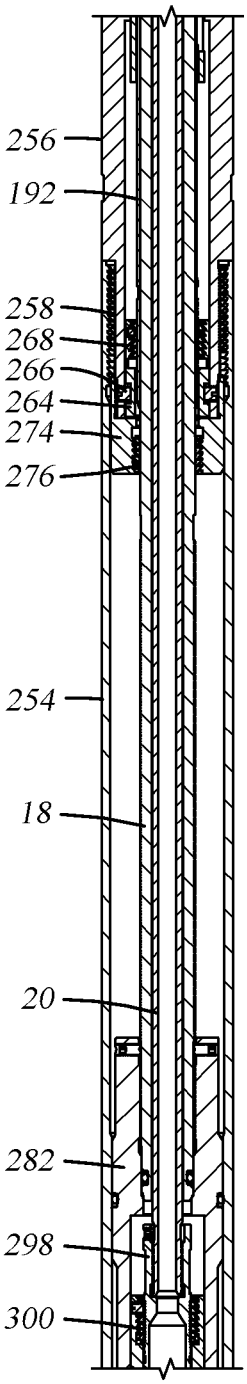
Fig. 9E3

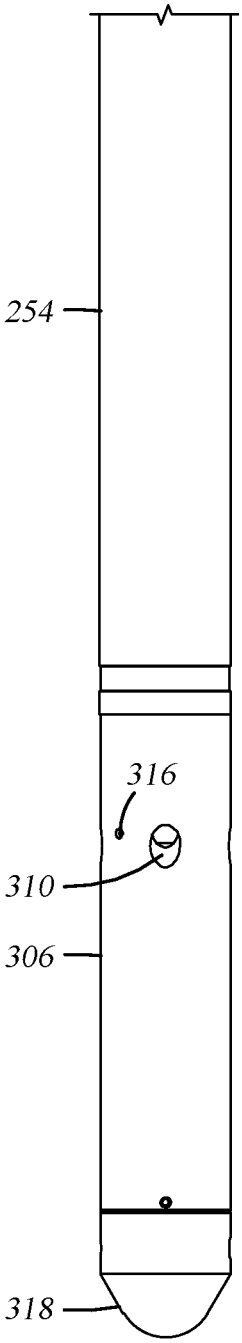
Fig. 9F1
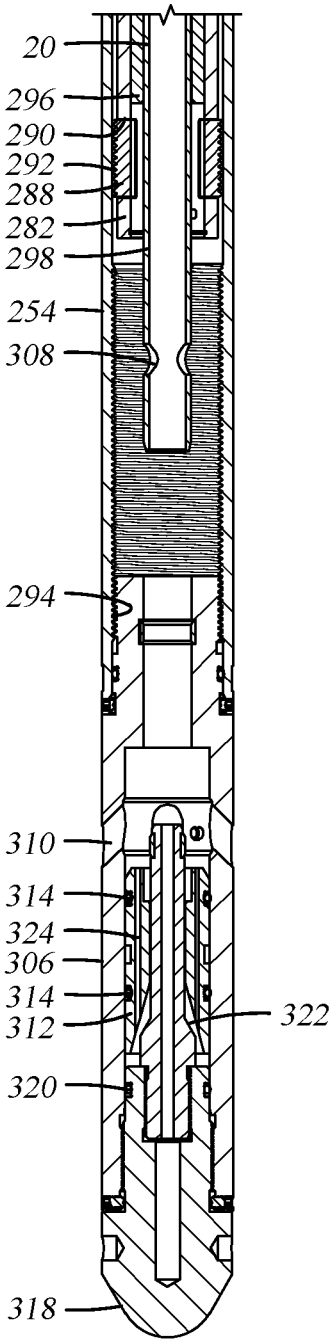
Fig. 9F2
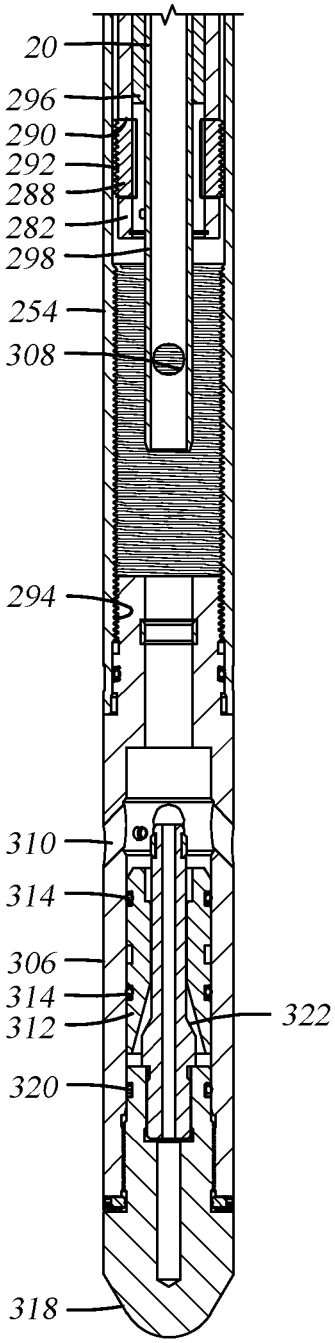
Fig. 9F3

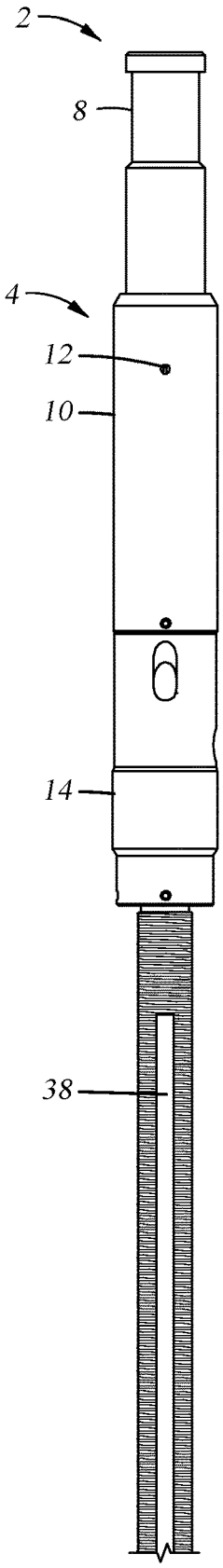
Fig. 10A1
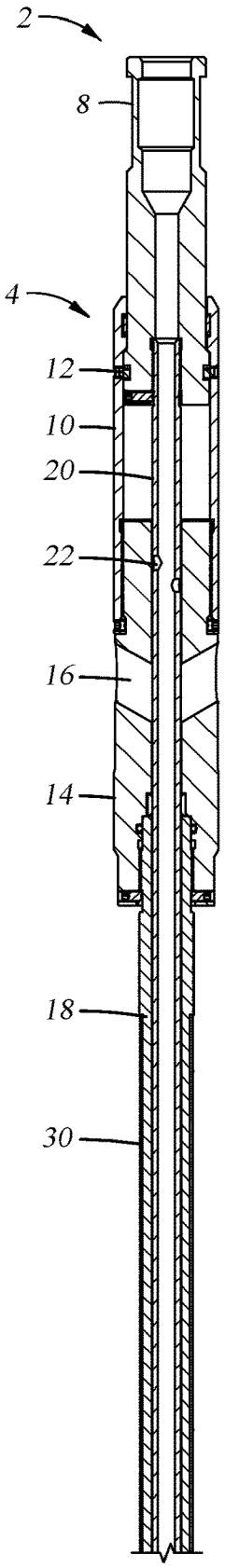
Fig. 10A2
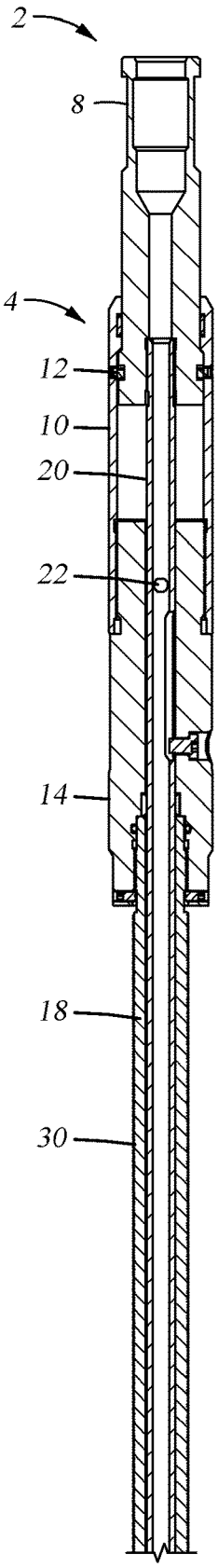
Fig. 10A3

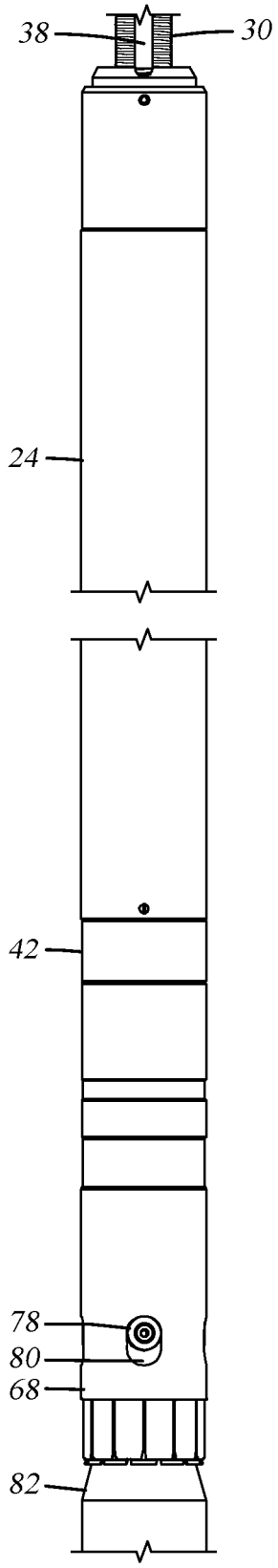
Fig. 10B1
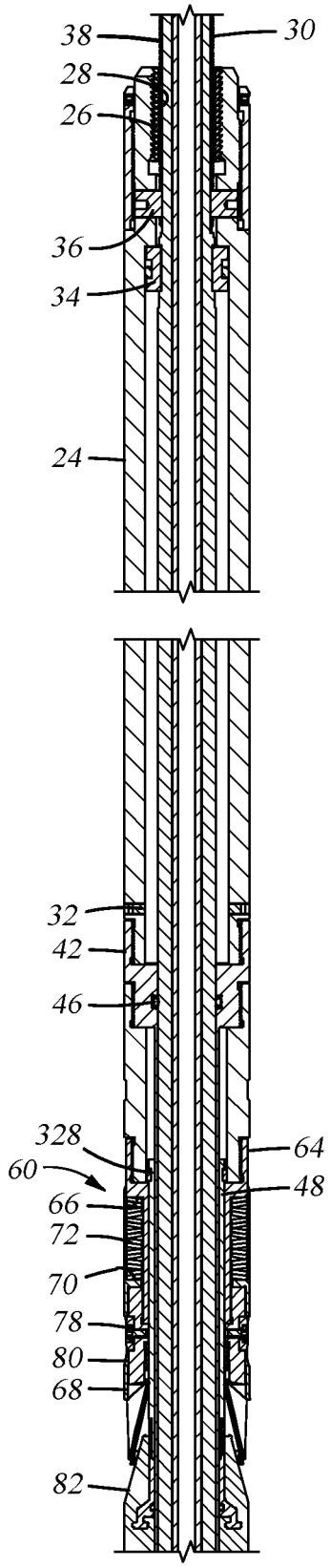
Fig. 10B2
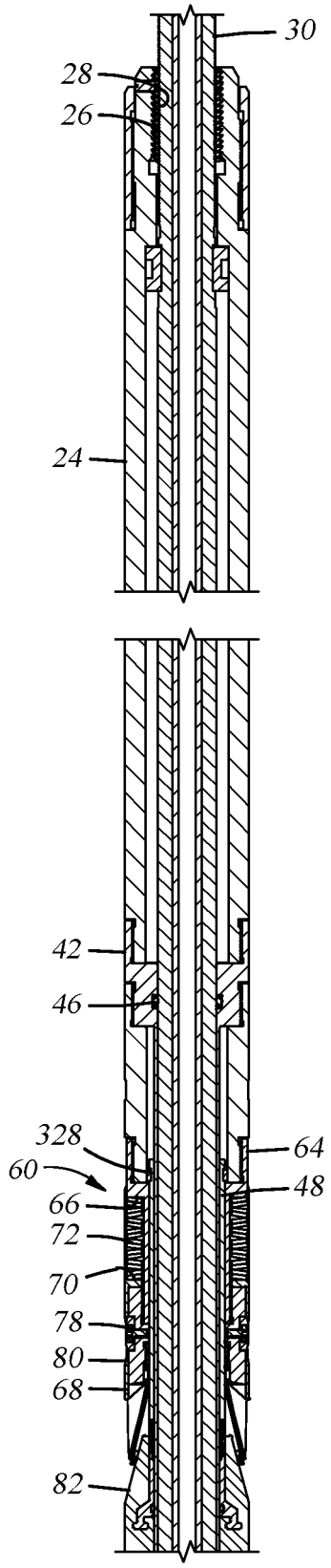
Fig. 10B3

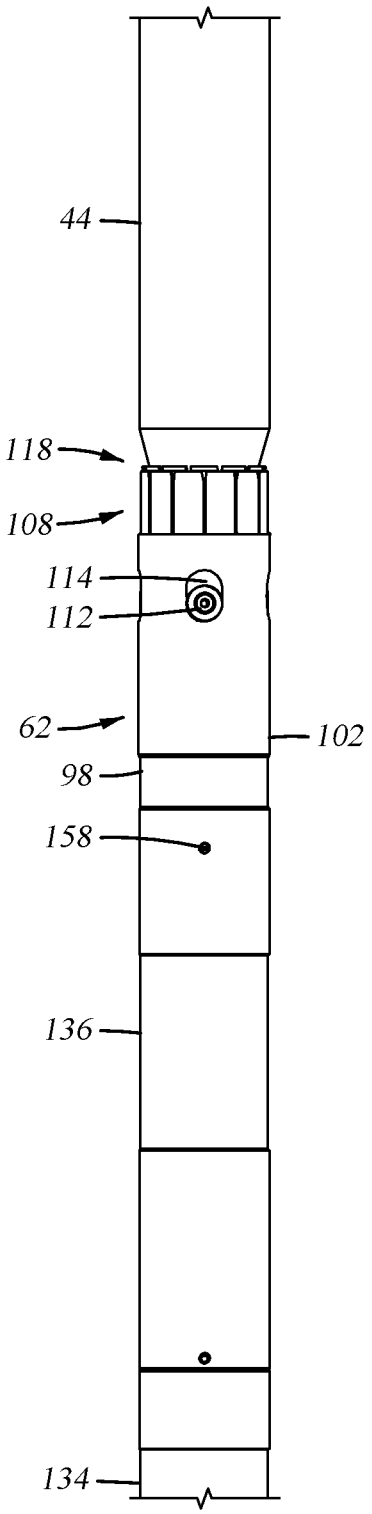
Fig. 10C1
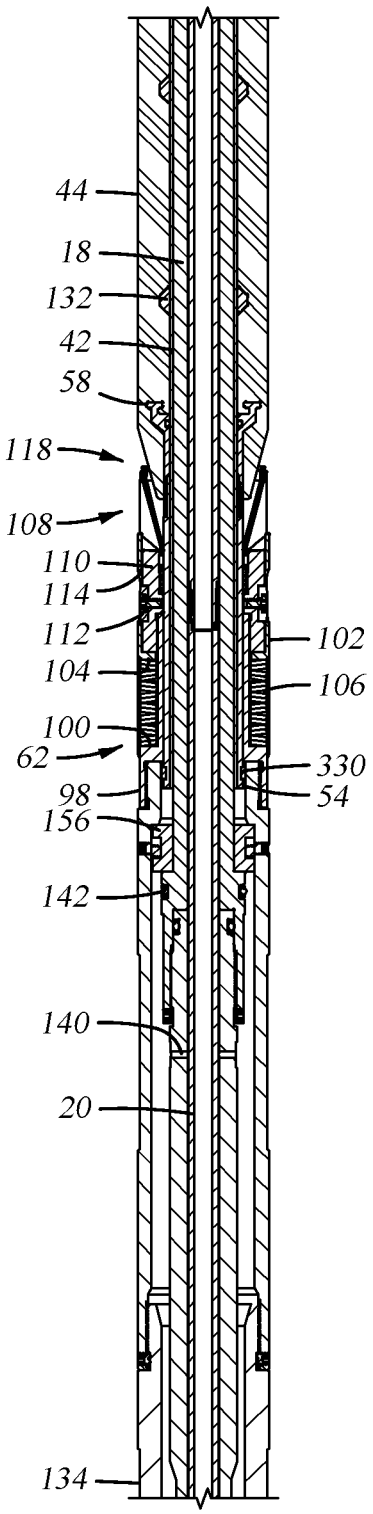
Fig. 10C2
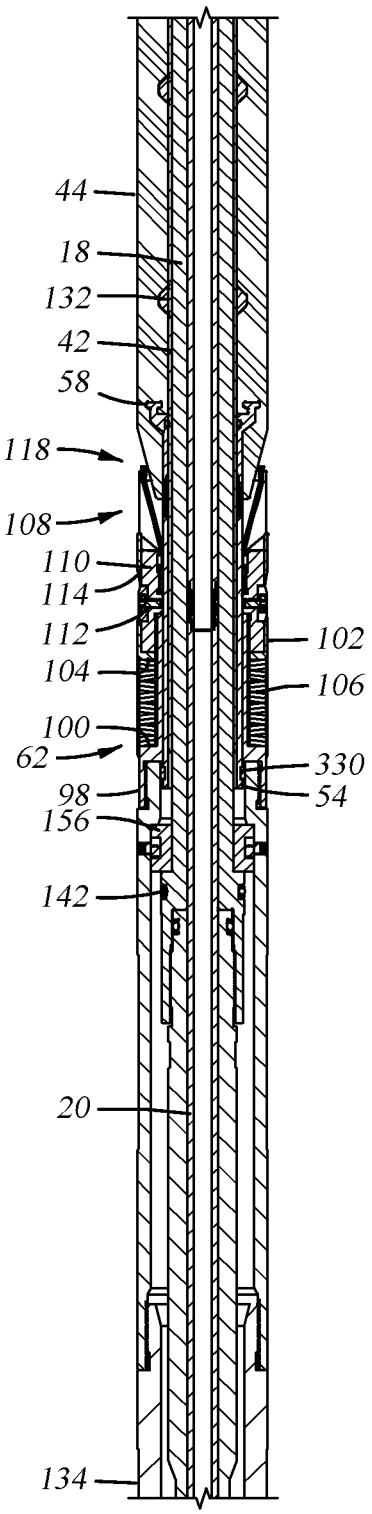
Fig. 10C3

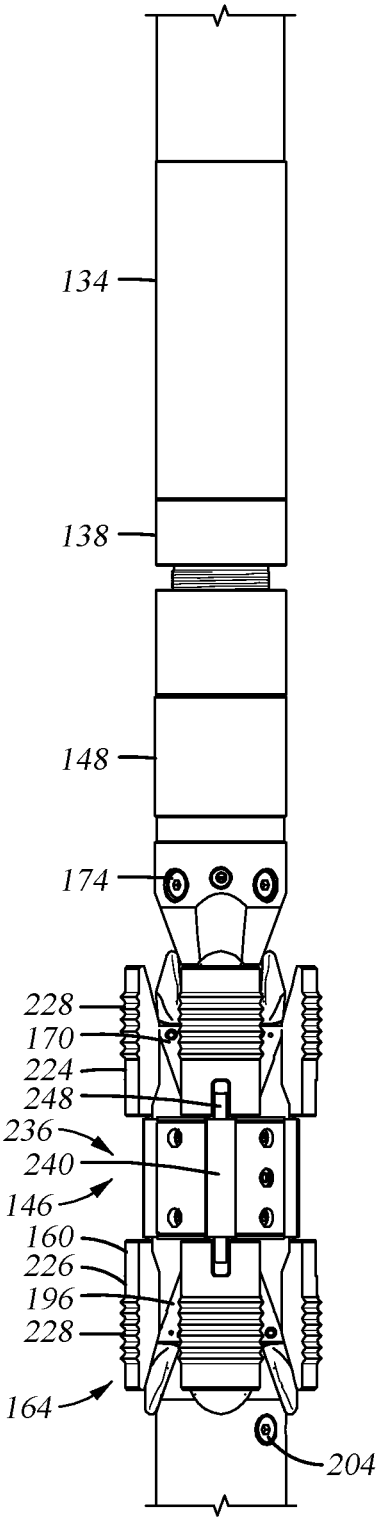
Fig. 10D1
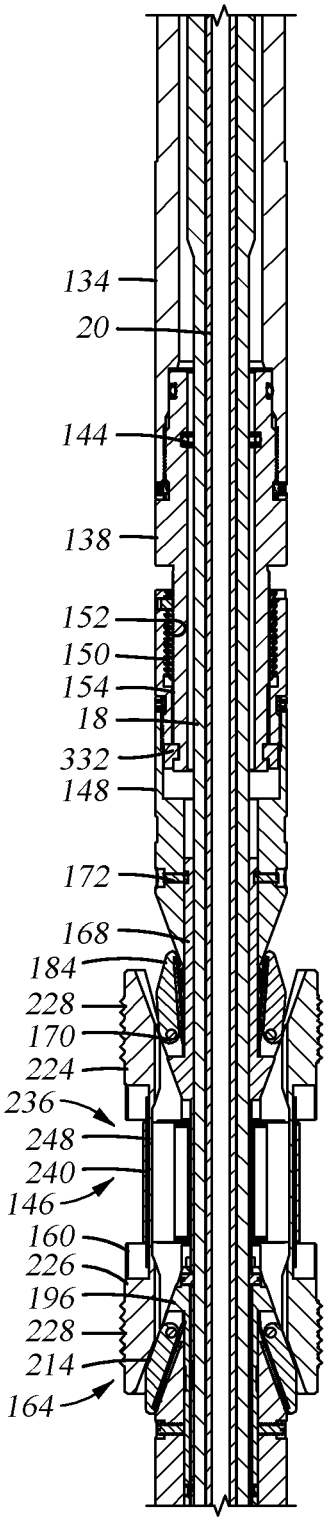
Fig. 10D2
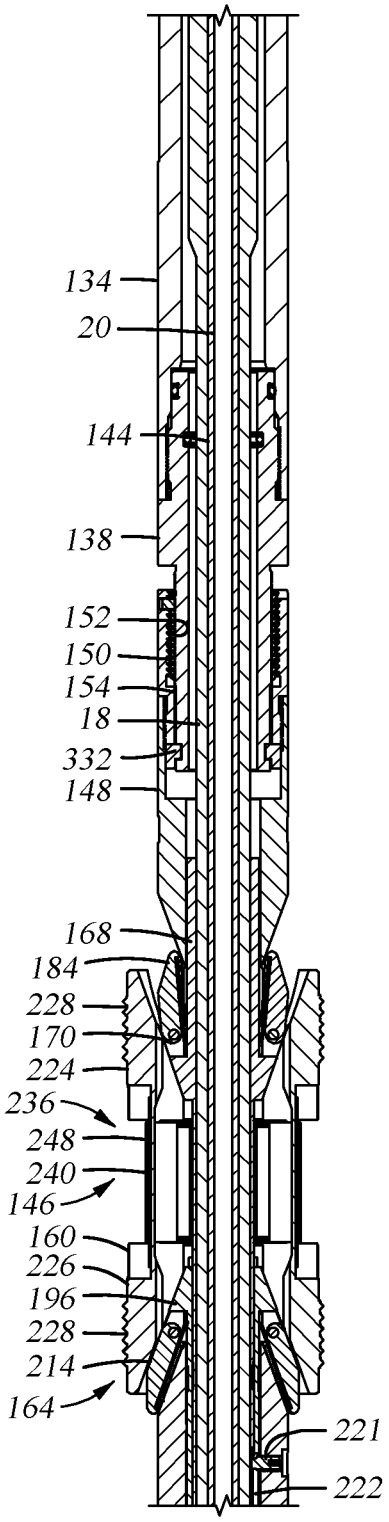
Fig. 10D3

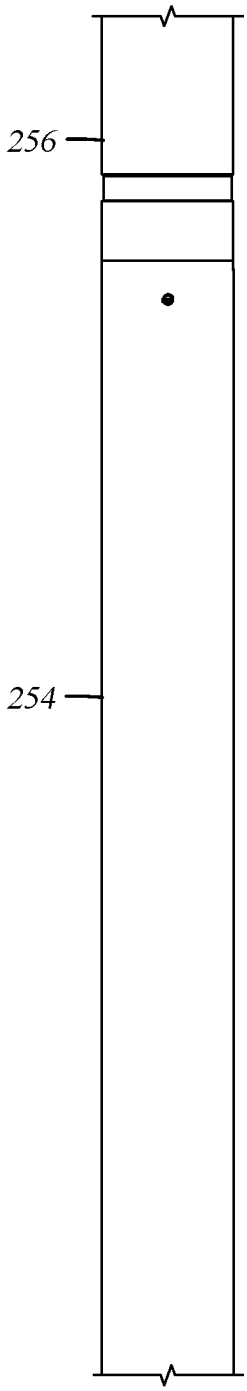
Fig. 10E1
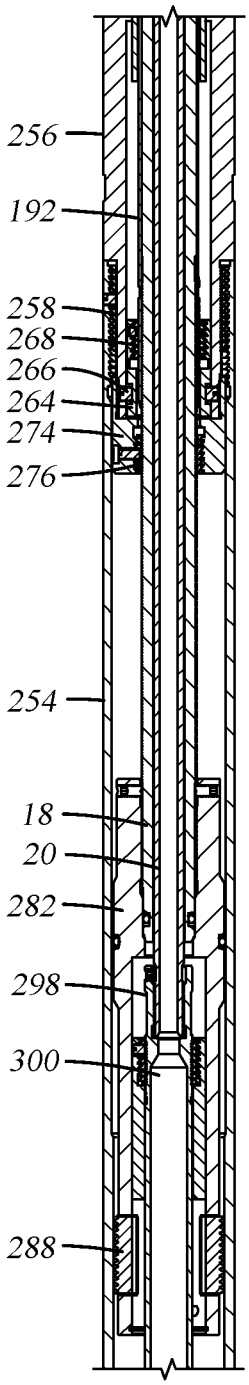
Fig. 10E2
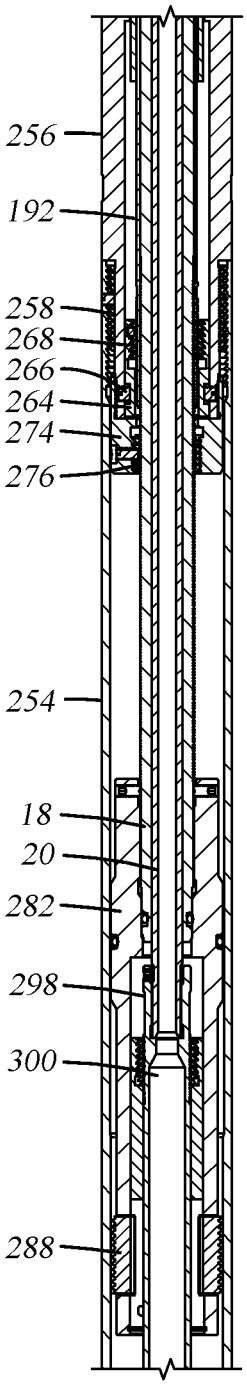
Fig. 10E3

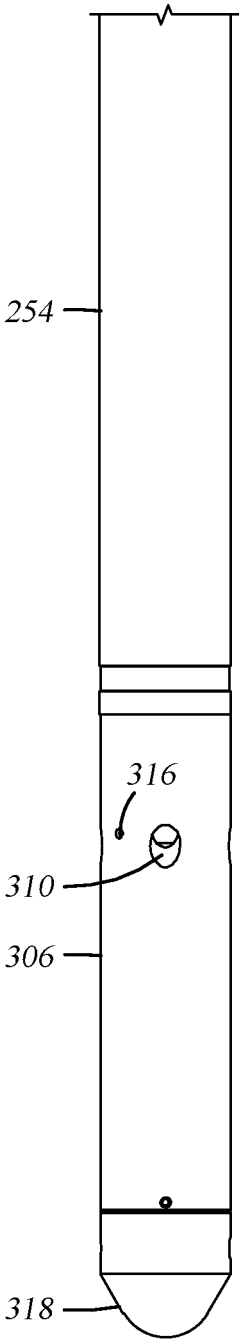
Fig. 10F1
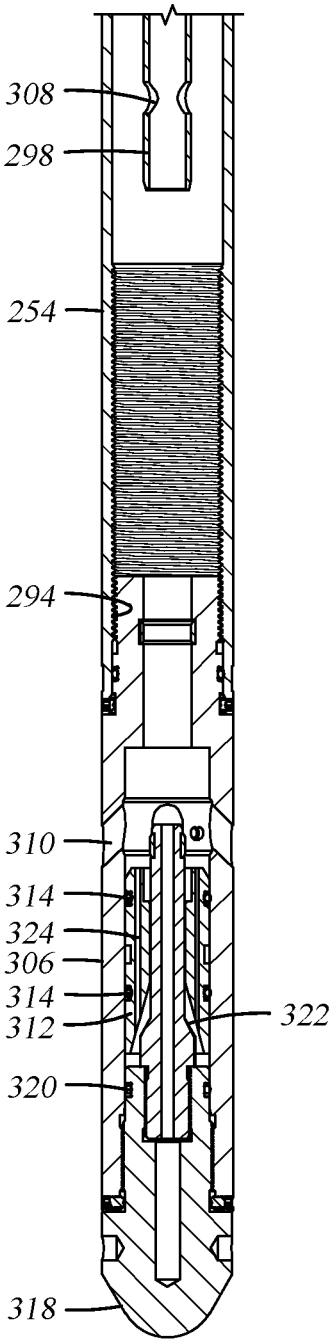
Fig. 10F2
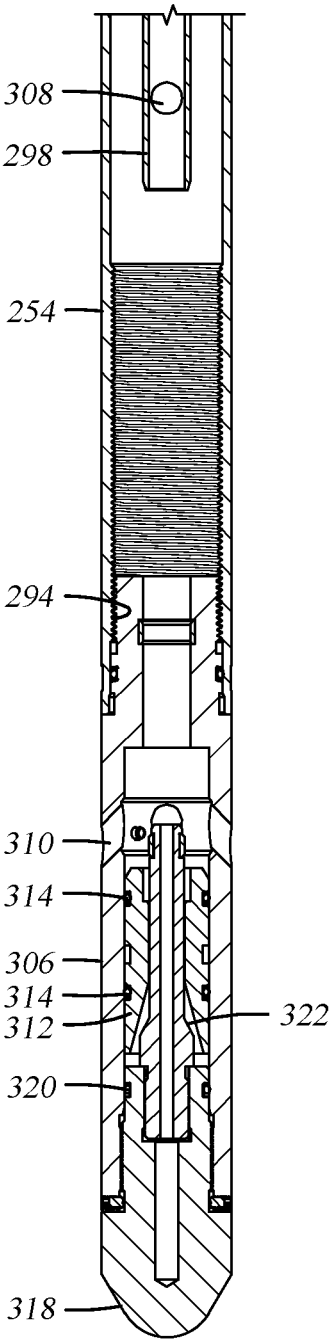
Fig. 10F3

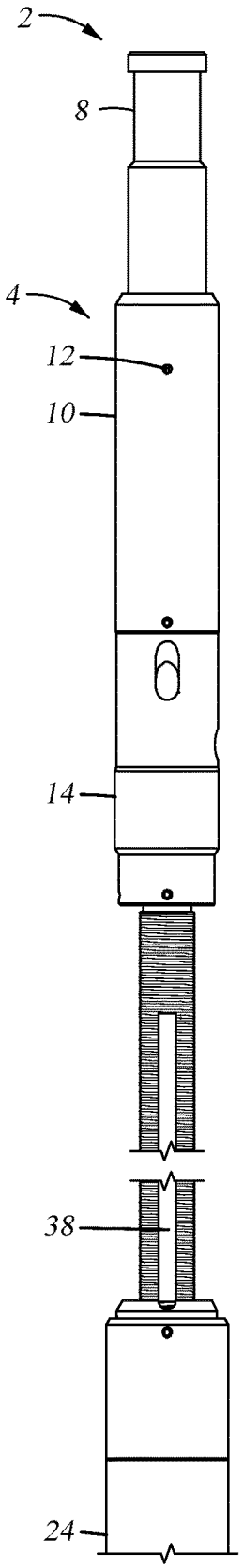
Fig. 11A1
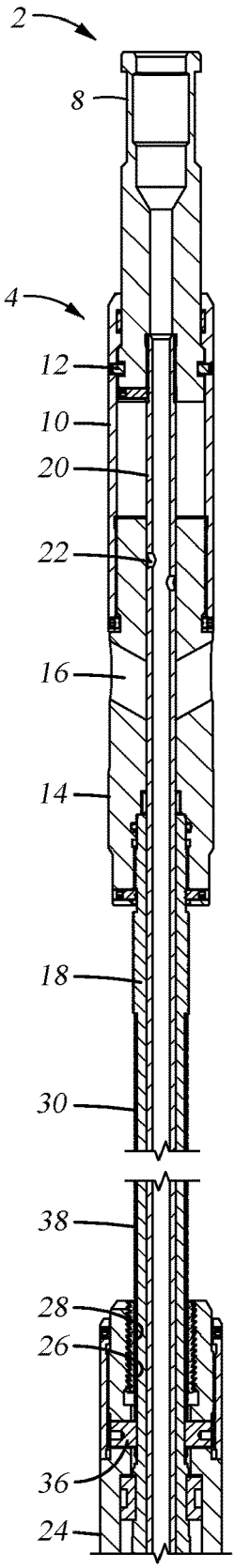
Fig. 11A2
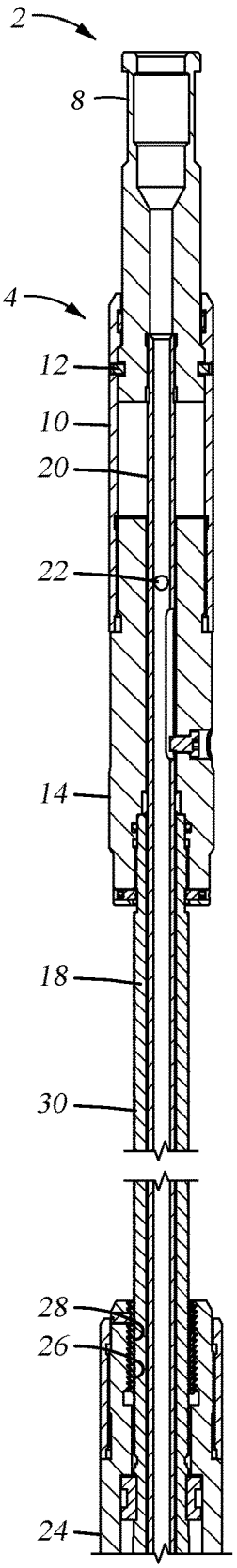
Fig. 11A3

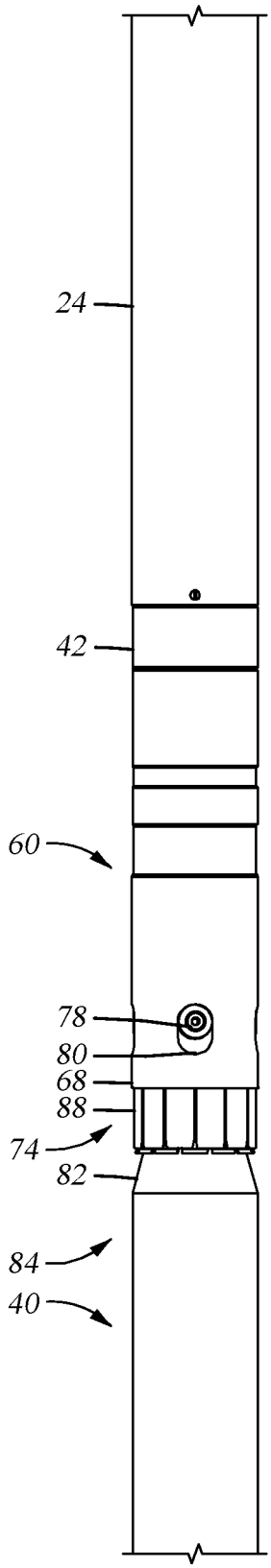
Fig. 11B1
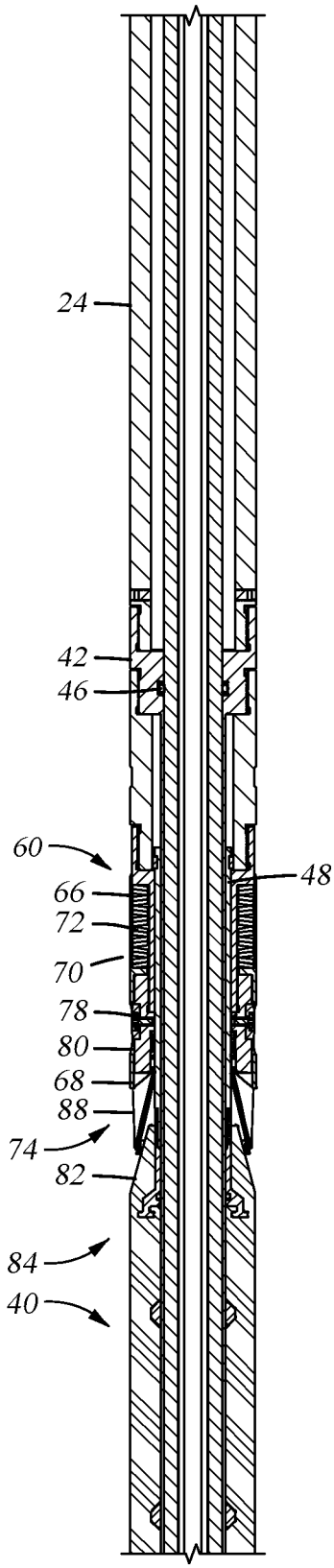
Fig. 11B2
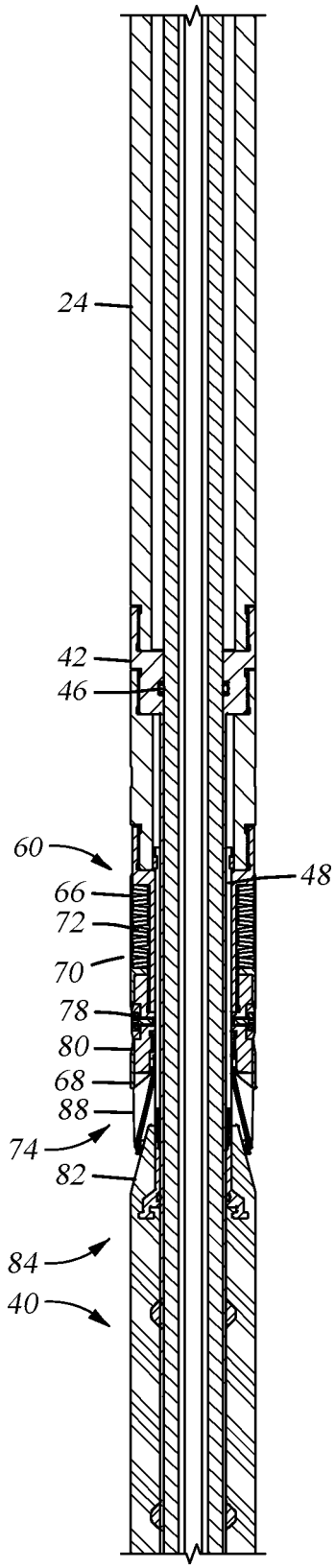
Fig. 11B3

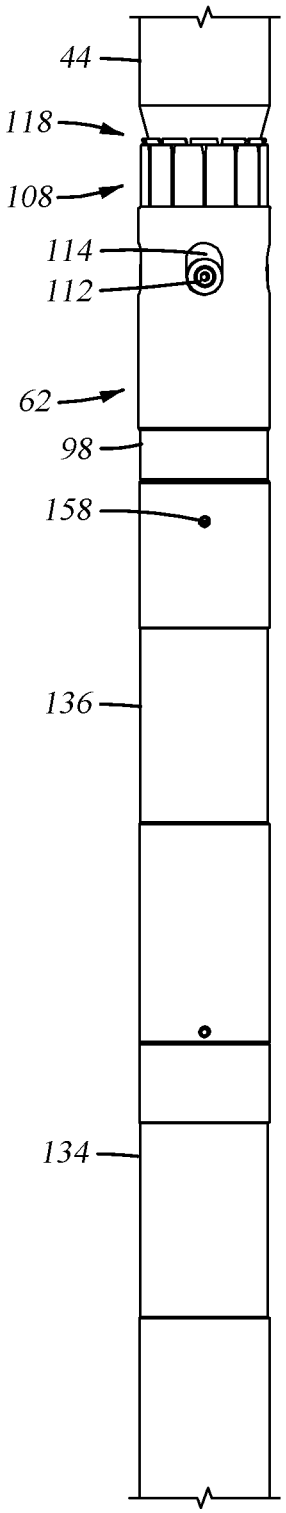
Fig. 11C1
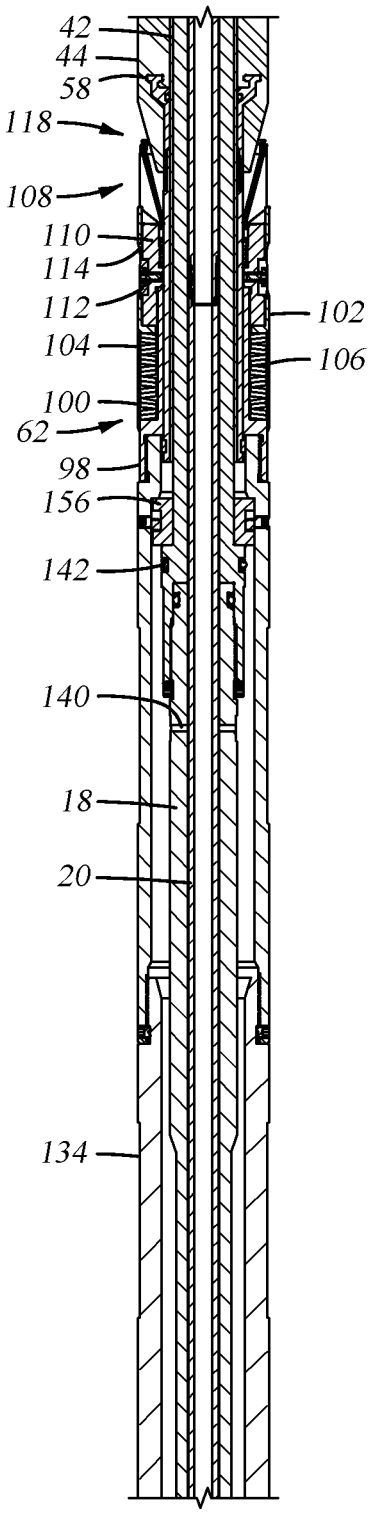
Fig. 11C2
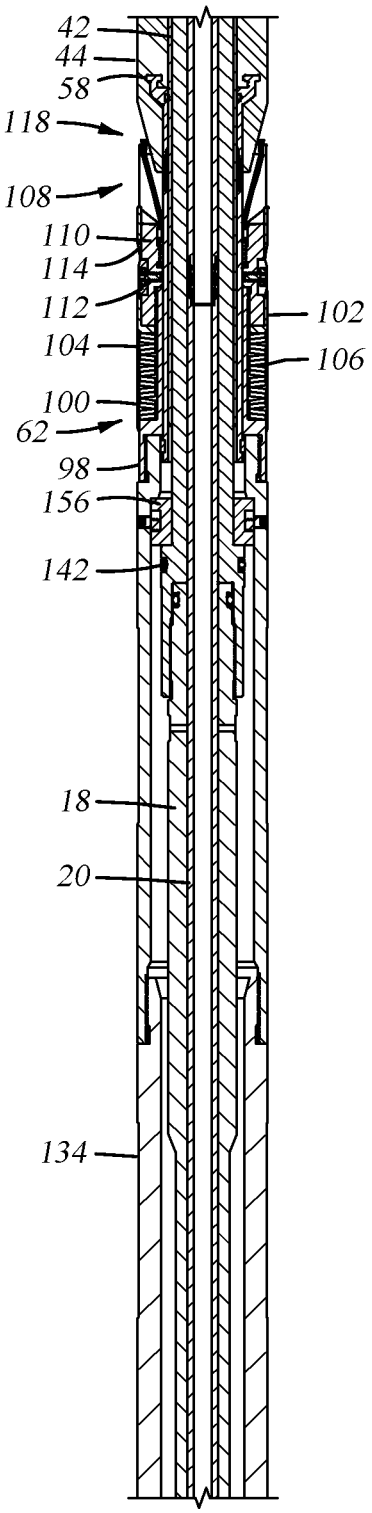
Fig. 11C3

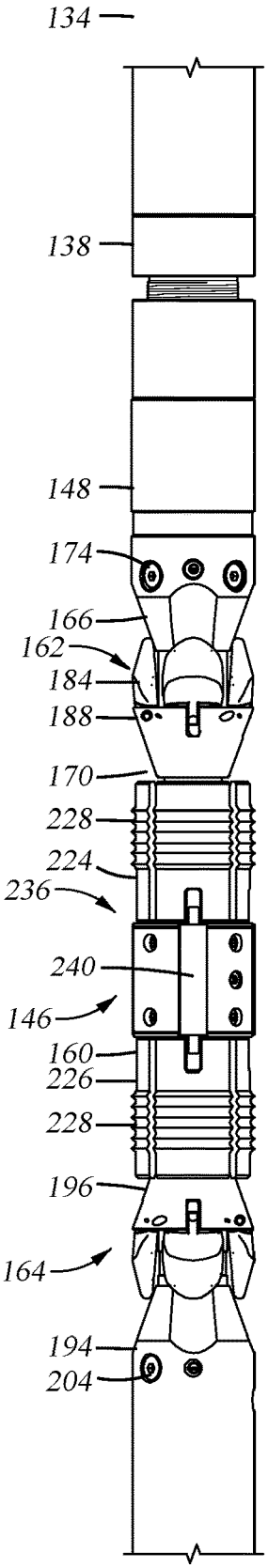
Fig. 11D1
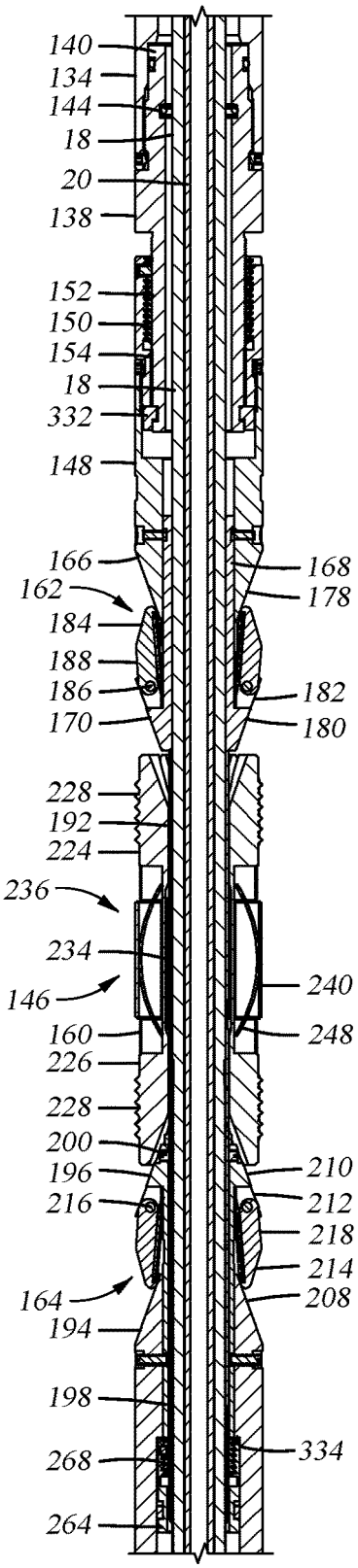
Fig. 11D2
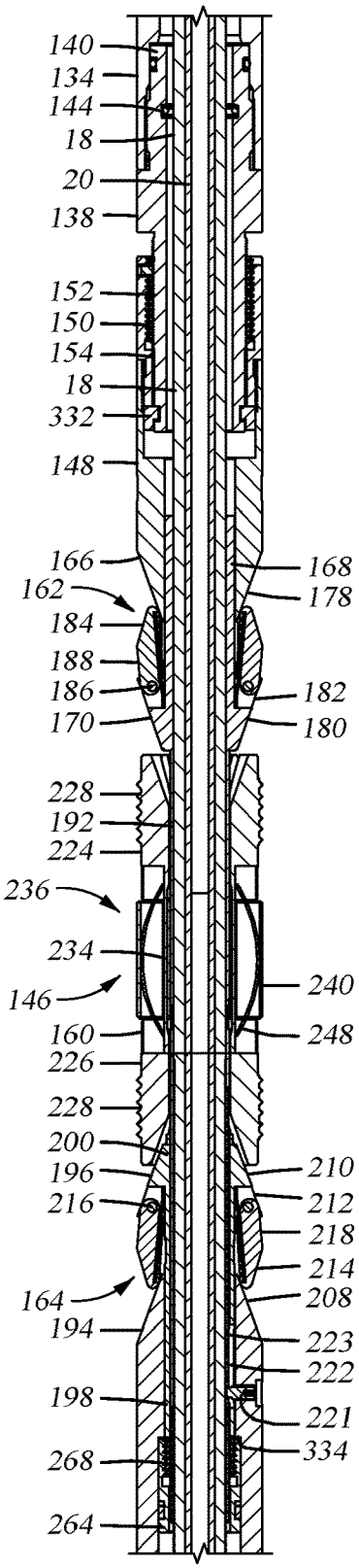
Fig. 11D3

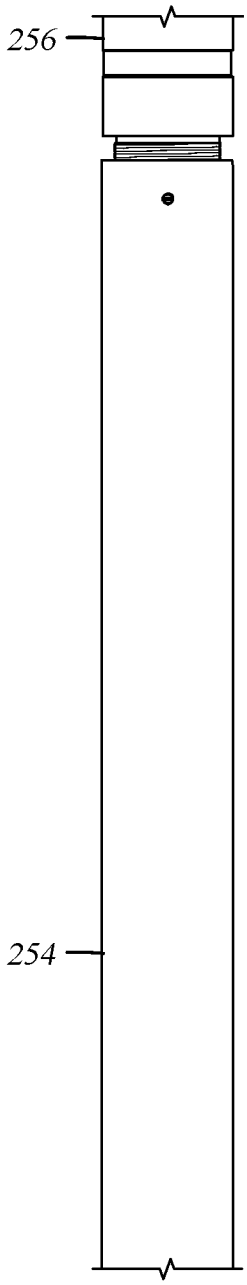
Fig. 11E1
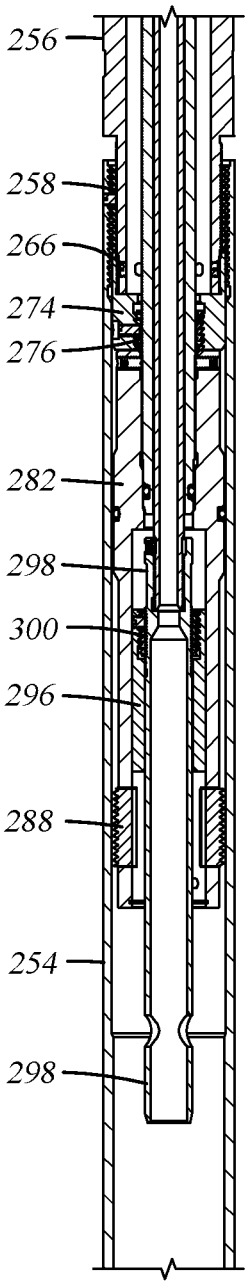
Fig. 11E2
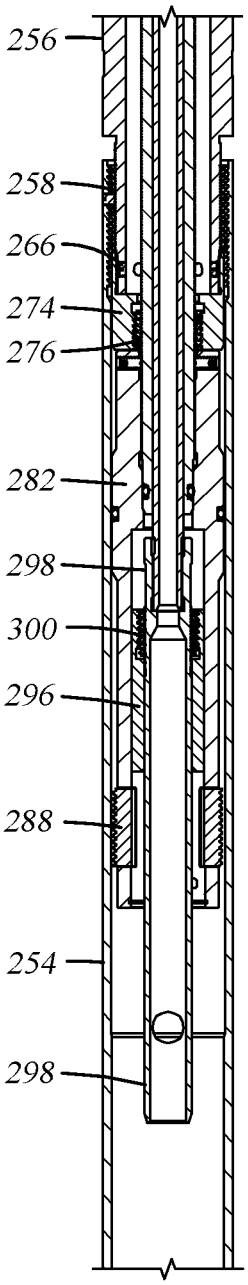
Fig. 11E3

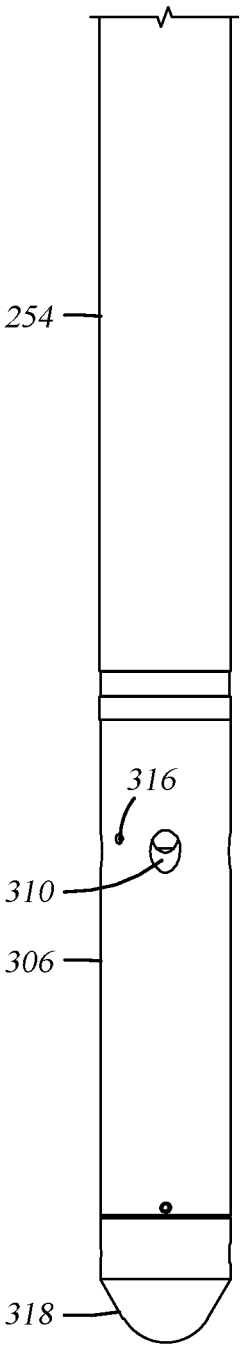
Fig. 11F1
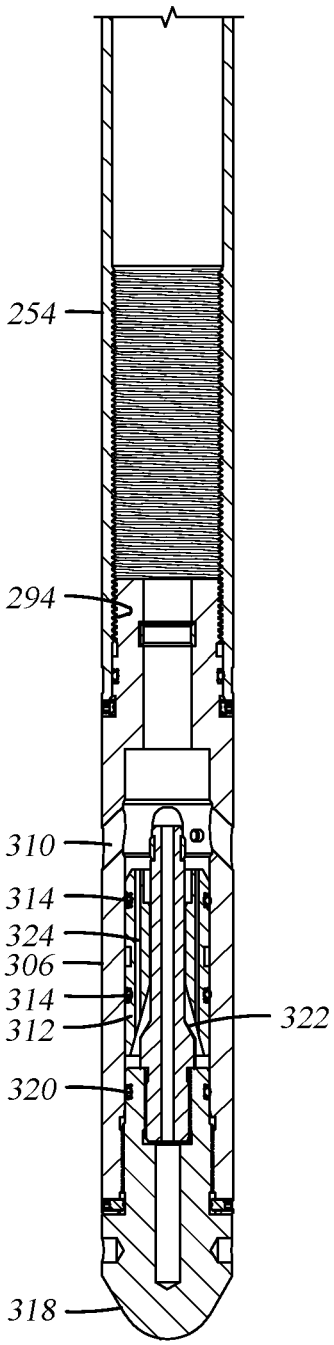
Fig. 11F2
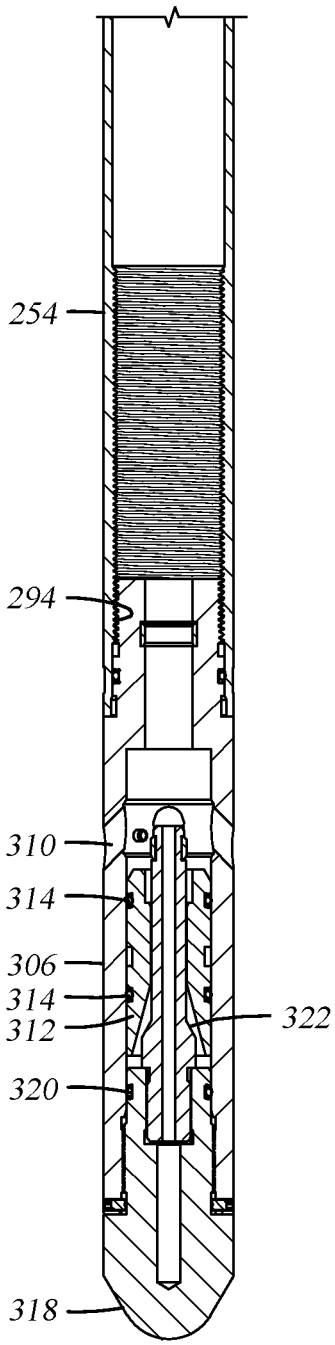
Fig. 11F3

CONTROLLED DEFORMATION AND SHAPE RECOVERY OF PACKING ELEMENTS

CROSS-REFERENCE TO RELATED APPLICATIONS

This application is related to U.S. patent application Ser. No. 17/085,859, filed Oct. 30, 2020, which is herein incorporated by reference in its entirety.

BACKGROUND

Field

Embodiments of the present disclosure generally relate to a packer assembly including a packing element. The packer apparatus may be used in bores, such as wellbores, pipelines, and the like.

Description of the Related Art

Packer assemblies are used in bores, such as wellbores or pipelines, to create temporary or permanent seals within the bores. A packer assembly may include one or more packing element. Typically, a packing element may be made out of a deformable material, such as an elastomer, to a prescribed initial length and initial outer diameter. The packing element may be set in a bore by the application of axial compression, thereby reducing the length of the packing element, and causing the packing element to deform radially outward into sealing contact with the surrounding bore.

For ease of installation in a bore, it may be desirable to run a packing element having an initial outer diameter significantly smaller than the inner diameter of the bore. In some instances, the packing element may have to fit through a restriction in the bore while being installed to the desired location in the bore. Such a situation may compromise the eventual utility of the packing element because generally, the greater the ratio of bore diameter to the initial outer diameter of the packing element, the lower the pressure sealing capability of the packing element when set in the bore. Hysteresis of deformable materials, such as elastomers, may adversely affect retrieval of a packing element from a bore, especially if retrieval involves passing the used packing element through a restriction.

Many operations conducted within a bore, such as a wellbore or a pipeline, require an anchor to be established within the bore, for example to secure tubing and equipment within a wellbore and to establish a force reaction point for other wellbore operations, such as setting packers, bridge plugs, anchoring other tools, and the like. Many anchors include slip systems that typically include a number of slip members having gripping teeth. Setting such an anchor involves moving the slip members radially outward into engagement with a bore wall. Cone based slip systems may include a cone that is moved axially relative to one or more slip members to radially move and support the slips in engagement with a bore wall. Conventional slip systems are limited in how far the slip members can move between the retracted and extended positions. Other slip systems have poor load ratings when the slip members are fully extended from a relatively small diameter to a relatively large diameter.

There is a need for some tools, such as packers and bridge plugs, to have packing elements and slip systems to be capable of undergoing transitions from a relatively small diameter to a relatively large diameter without compromising sealing or anchoring capabilities.

SUMMARY

In one embodiment, a packer assembly includes a packer mandrel and a packing element disposed about the packer mandrel. The packing element has a unitary structure of packing material. The packer assembly further includes an upper recovery sleeve disposed about the packer mandrel and extending between the packer mandrel and an upper end of the packing element. The upper recovery sleeve has an upper recovery profile embedded within the packing element. The packer assembly further includes an upper backup assembly movably disposed about the upper recovery sleeve and adjacent to the upper end of the packing element. The packer assembly further includes a lower recovery sleeve disposed about the packer mandrel and extending between the packer mandrel and a lower end of the packing element. The lower recovery sleeve has a lower recovery profile embedded within the packing element. The packer assembly further includes a lower backup assembly movably disposed about the lower recovery sleeve and adjacent to the lower end of the packing element.

In another embodiment, a downhole tool includes a central mandrel, a slip assembly disposed about the central mandrel, and a packer assembly disposed about the central mandrel. The packer assembly includes a packer mandrel and a packing element disposed about the packer mandrel. The packing element has a unitary structure of packing material. The packer assembly further includes an upper recovery sleeve disposed about the packer mandrel and extending between the packer mandrel and an upper end of the packing element. The upper recovery sleeve has an upper recovery profile embedded within the packing element. The packer assembly further includes an upper backup assembly movably disposed about the upper recovery sleeve and adjacent to the upper end of the packing element. The packer assembly further includes a lower recovery sleeve disposed about the packer mandrel and extending between the packer mandrel and a lower end of the packing element. The lower recovery sleeve has a lower recovery profile embedded within the packing element. The packer assembly further includes a lower backup assembly movably disposed about the lower recovery sleeve and adjacent to the lower end of the packing element.

In another embodiment, a method of manipulating a packing element in a bore includes providing an upper recovery sleeve having an upper recovery profile embedded within the packing element and providing a lower recovery sleeve having a lower recovery profile embedded within the packing element. The method further includes moving an upper inner backup sleeve with respect to the upper recovery sleeve toward an upper end of the packing element and moving a lower inner backup sleeve with respect to the lower recovery sleeve toward a lower end of the packing element. The method further includes reducing an axial distance between the upper recovery sleeve and the lower recovery sleeve, thereby axially compressing the packing element, and deforming the packing element into contact with a surrounding wall of the bore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIGS. 2A1, 2B1, 2C1, 2D1, 2E1, and 2F1 present external views of the bridge plug of FIG. 1 in a running configuration.

FIGS. 2A2, 2B2, 2C2, 2D2, 2E2, and 2F2 present longitudinal cross-sectional views taken in a plane through the center of the bridge plug of FIG. 1 in a running configuration.

FIGS. 2A3, 2B3, 2C3, 2D3, 2E3, and 2F3 present longitudinal cross-sectional views taken in a plane through the center of the bridge plug of FIG. 1 and perpendicular to that of FIGS. 2A2, 2B2, 2C2, 2D2, 2E2, and 2F2, respectively.

FIG. 3 is an exploded view of a packer assembly that is incorporated into the bridge plug of FIG. 1.

FIGS. 6A1 to 6F3 are views of the bridge plug of FIG. 1 corresponding to the views in FIGS. 2A1 to 2F3 for the stage of operation illustrated in FIG. 5B.

FIGS. 7A1 to 7F3 are views of the bridge plug of FIG. 1 corresponding to the views in FIGS. 2A1 to 2F3 for the stage of operation illustrated in FIG. 5C.

FIGS. 8A1 to 8F3 are views of the bridge plug of FIG. 1 corresponding to the views in FIGS. 2A1 to 2F3 for the stage of operation illustrated in FIG. 5D.

FIGS. 9A1 to 9F3 are views of the bridge plug of FIG. 1 corresponding to the views in FIGS. 2A1 to 2F3 for the stage of operation illustrated in FIG. 5E.

FIGS. 10A1 to 10F3 are views of the bridge plug of FIG. 1 corresponding to the views in FIGS. 2A1 to 2F3 for the stage of operation illustrated in FIG. 5F.

FIGS. 11A1 to 11F3 are views of the bridge plug of FIG. 1 corresponding to the views in FIGS. 2A1 to 2F3 for the stage of operation illustrated in FIG. 5G.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns packer assemblies and slip assemblies that may be incorporated into tools for use in a bore, such as a wellbore, a pipeline, and the like. Tools incorporating the packer and/or slip assemblies of the present disclosure may include wellbore packers, hangers, whipstock anchors, and the like. Another example tool is a bridge plug.

Figure 1:
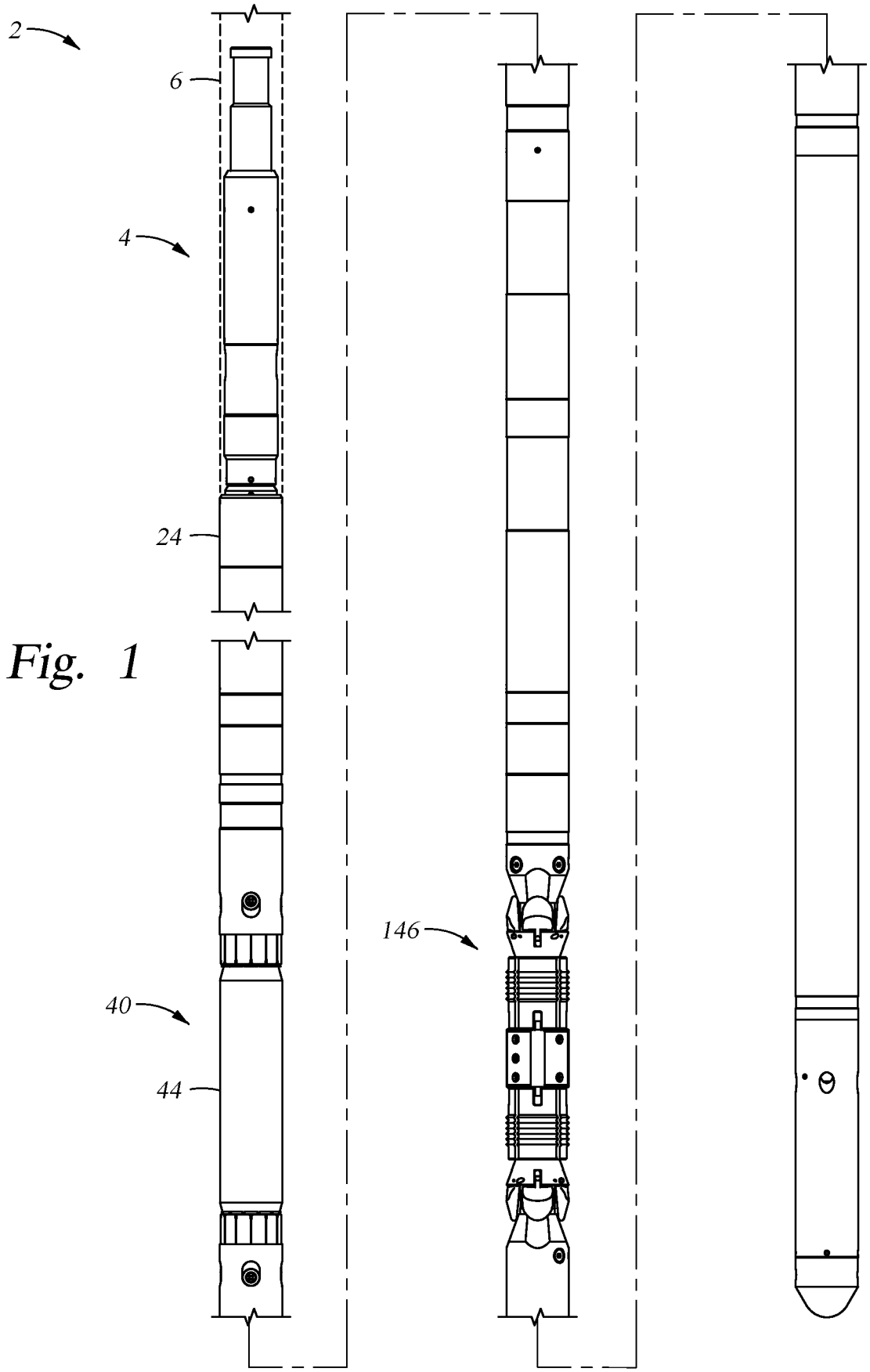
FIG. 1 is an external view of a bridge plug incorporating packer and slip assemblies of the present disclosure.

FIG. 1 is a general external view of a bridge plug incorporating a packer assembly and a slip assembly of the present disclosure. The bridge plug 2 may be configured to transition from a running configuration, in which the bridge plug 2 may be installed in a bore, to a set configuration, in which the bridge plug 2 may be fixed in place within the bore. In some embodiments, the bridge plug 2 may be configured to transition from the set configuration to a released configuration, in which the bridge plug 2 may be freed from the location in the bore in which the bridge plug 2 had been fixed. The bridge plug 2 may be in a configuration suitable for retrieval from the bore when in the running and in the released configurations.

The bridge plug 2 may have a setting tool adaptor 4. The setting tool adaptor 4 may be sized such that a sleeve 6 (shown as dashed lines) of a setting tool may fit around the setting tool adaptor 4 and may bear against an upper end of a setting sleeve 24.

The bridge plug 2 may have a packer assembly 40. The packer assembly 40 may have a packing element 44 that may create a seal in the bore. The packing element 44 may create the seal when the packer assembly 40 is transitioned from a running configuration, in which the packing element 44 is not in 360 degree circumferential contact with an inner wall of the bore, to a set configuration in which the packing element 44 is at least substantially in 360 degree circumferential contact with the inner wall of the bore. In some embodiments, the packer assembly 40 may be transitioned from the set configuration to a released configuration, in which the packing element 44 is not in 360 degree circumferential contact with the inner wall of the bore. In some embodiments, the packing element 44 may have a first maximum outer diameter when in the running configuration, a second larger maximum outer diameter when in the set configuration, and a third maximum outer diameter when in the released configuration. In some embodiments, the third maximum outer diameter is substantially the same as the first maximum outer diameter. The packer assembly 40 may be incorporated into a tool such as a wellbore packer or a bridge plug 2.

The bridge plug 2 may have a slip assembly 146. The slip assembly 146 may be configured to transition from a running configuration, in which the slip assembly 146 may be installed in the bore, to a set configuration, in which the slip assembly 146 may be fixed in place within the bore. The slip assembly 146 may be configured to transition from the set configuration to a released configuration, in which the slip assembly 146 may be freed from the location in the bore in which the slip assembly 146 had been fixed. The slip assembly 146 may be in a configuration suitable for retrieval from the bore when in the running and in the released configurations.

FIGS. 2A1-2I show the bridge plug 2 of FIG. 1 in further detail when the bridge plug 2 is in the running configuration. The bridge plug 2 is shown having a setting tool adaptor 4 that may be configured to couple to, and to be manipulated by, a setting tool. The setting tool adaptor 4 may have a fishing neck 8 that is sized and shaped to facilitate attachment of a fishing tool, retrieval tool, or the like. The fishing neck 8 may be coupled to a release sleeve 10 by one or more fastener 12, such as a latch, locking dog, collet, snap ring, shear ring, shear screw, shear pin, or the like. In some embodiments, the fastener 12 may temporarily inhibit relative axial movement between the fishing neck 8 and the release sleeve 10. The release sleeve 10 may be coupled to an adaptor body 14 that has one or more side port 16. The adaptor body 14 may be coupled to a central mandrel 18 that may extend through the bridge plug 2. The fishing neck 8 may be coupled to an equalization mandrel 20 that may extend through the central mandrel 18. The equalization mandrel 20 may have one or more side port 22.

Below the setting tool adaptor 4, the central mandrel 18 may extend through a setting sleeve 24, and be coupled to the setting sleeve 24 by a lock ring 26. The lock ring 26 may include ratchet teeth 28 that are configured to engage with corresponding ratchet teeth 30 on the central mandrel 18. The lock ring 26 may be configured to permit the setting sleeve 24 to move downwards with respect to the central mandrel 18, but prevent the setting sleeve 24 from moving upwards with respect to the central mandrel 18. Additionally, the central mandrel 18 may be coupled to the setting sleeve 24 by one or more fastener 32, such as a latch, locking dog, collet, snap ring, shear ring, shear screw, shear pin, or the like. In some embodiments, the fastener 32 may temporarily inhibit relative axial movement between the central mandrel 18 and the setting sleeve 24. In some embodiments, the fastener 32 may be engaged with a stop ring 34 on the central mandrel 18.

One or more key 36 may couple the setting sleeve 24 and the central mandrel 18. Each key 36 may protrude into a corresponding slot 38 on the central mandrel 18. The interaction between each key 36 and corresponding slot 38 may inhibit relative rotation between the setting sleeve 24 and the central mandrel 18. Thus, a remedial milling operation to disintegrate the lock ring 26 may be facilitated, if required, without incurring relative rotation between the setting sleeve 24 and the central mandrel 18.

Packer Assembly

Figure 2G:
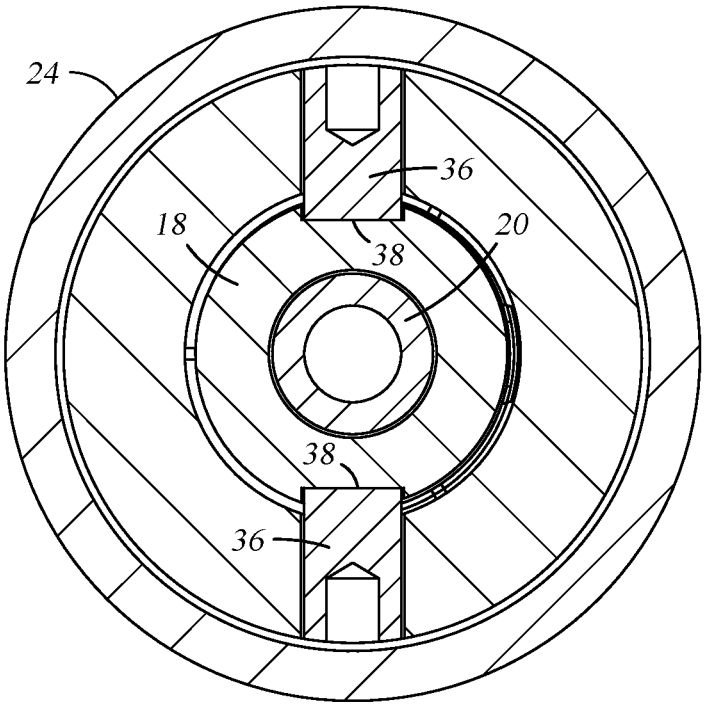
FIGS. 2G and 2H are lateral cross-sectional views of the bridge plug of FIG. 1 in the running configuration.
Figure 3:
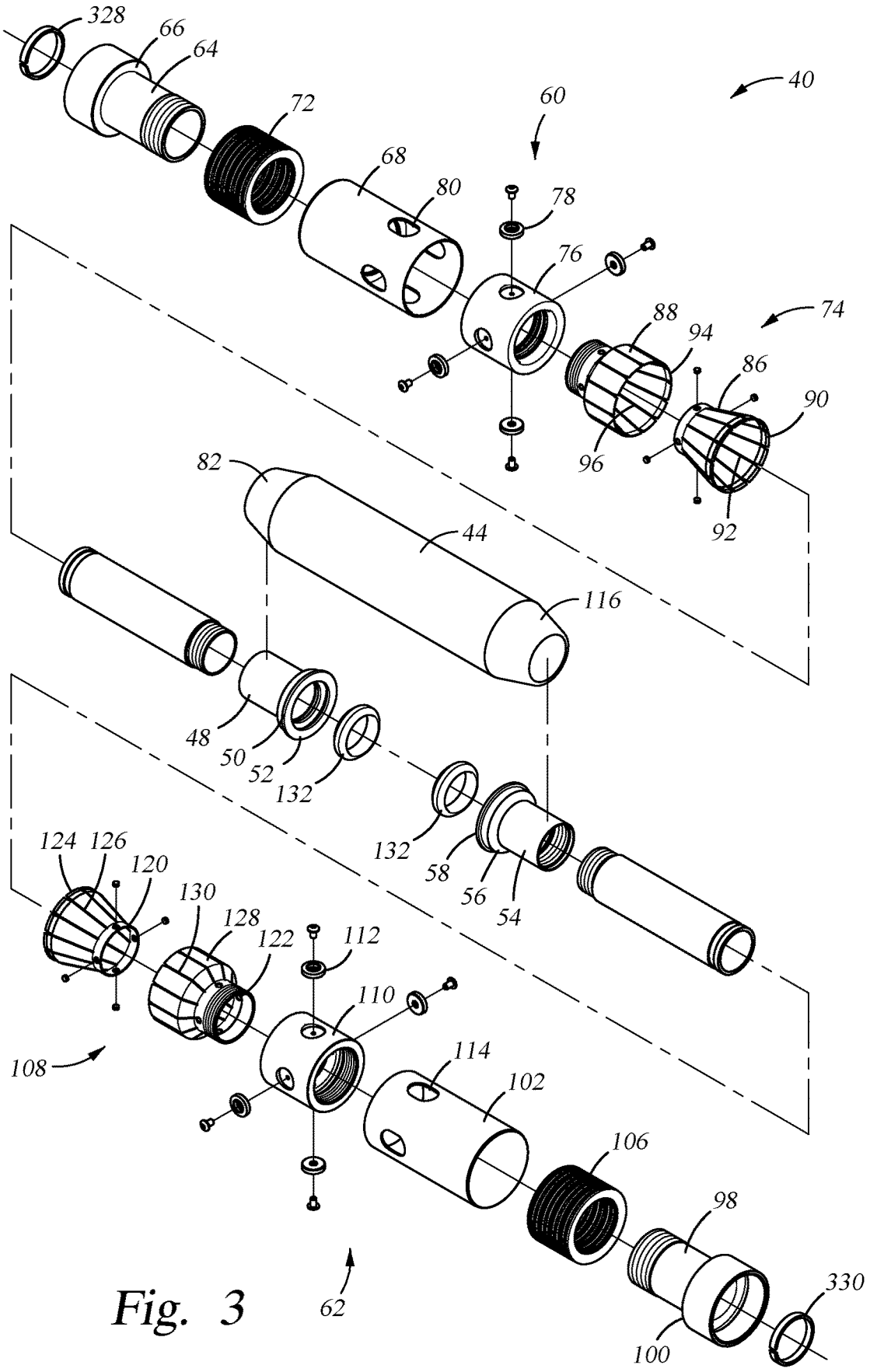

The bridge plug 2 may include a packer assembly 40, such as that shown in FIGS. 2B1-2D3 and in FIG. 3. The setting sleeve 24 may be coupled to the packer assembly 40. The packer assembly 40 may include a packer mandrel 42 and a packing element 44 disposed about the packer mandrel 42. The setting sleeve 24 may be coupled to the packer mandrel 42. The packer mandrel 42 may be disposed about the central mandrel 18. A seal member 46 may provide a seal between the central mandrel 18 and the packer mandrel 42. The packer assembly 40 may include an upper recovery sleeve 48 disposed about the packer mandrel 42 and extending between the packer mandrel 42 and an upper end 84 of the packing element 44. The upper recovery sleeve 48 may have an upper recovery profile 50 embedded within the packing element 44. The upper recovery profile 50 may include an annular projection 52 within the packing element 44. The annular projection 52 may be bonded to the packing element 44.

The packer assembly 40 may include a lower recovery sleeve 54 disposed about the packer mandrel 42 and extending between the packer mandrel 42 and a lower end 118 of the packing element 44. The lower recovery sleeve 54 may have a lower recovery profile 56 embedded within the packing element 44. The lower recovery profile 56 may include an annular projection 58 within the packing element 44. The annular projection 58 may be bonded to the packing element 44.

The packer assembly 40 may include an upper backup assembly 60 and a lower backup assembly 62. The upper backup assembly 60 may be disposed about the upper recovery sleeve 48. The upper backup assembly 60 may be configured to limit upward axial extension of the packing element 44. The lower backup assembly 62 may be disposed about the lower recovery sleeve 54. The lower backup assembly 62 may be configured to limit downward axial extension of the packing element 44.

The upper backup assembly 60 may include an upper inner backup sleeve 64. The upper inner backup sleeve 64 may have an annular shoulder 66, and may be movable with respect to the upper recovery sleeve 48. The upper backup assembly 60 may include an upper outer backup sleeve 68 disposed about the upper inner backup sleeve 64. The upper outer backup sleeve 68 may have an annular shoulder 70, and may be movable with respect to the upper inner backup sleeve 64. A biasing member 72, such as a spring or a mass of resilient deformable material, such as an elastomer, may be disposed between the annular shoulder 66 of the upper inner backup sleeve 64 and the annular shoulder 70 of the upper outer backup sleeve 68.

The upper backup assembly 60 may include an upper backup ring assembly 74. The upper backup ring assembly 74 may be coupled to an upper backup support 76. The upper backup support 76 may be coupled to the upper inner backup sleeve 64 and disposed at least partially inside the upper outer backup sleeve 68. The upper backup support 76 and the upper backup ring assembly 74 may move with the upper inner backup sleeve 64 relative to the upper outer backup sleeve 68. A key 78 may be coupled to the upper backup support 76, and may protrude into a keyway 80 of the upper outer backup sleeve 68. Relative movement between the upper backup support 76 and the upper outer backup sleeve 68 may be constrained by the interaction between the key 78 and the keyway 80.

The upper backup ring assembly 74 may be configured to enclose an outer surface 82 of the upper end 84 of the packing element 44. The upper backup ring assembly 74 may include an inner backup ring 86 and an outer backup ring 88 adjacent the inner backup ring 86. The inner backup ring 86 may have fingers 90 separated by slots 92, and the fingers 90 may be disposed adjacent the outer surface 82 of the upper end 84 of the packing element 44. The outer backup ring 88 may have fingers 94 separated by slots 96, and the fingers 94 may be disposed such that each finger 94 of the outer backup ring overlaps with a corresponding slot 92 of the inner backup ring 86.

The lower backup assembly 62 may include a lower inner backup sleeve 98. The lower inner backup sleeve 98 may have an annular shoulder 100, and may be movable with respect to the lower recovery sleeve 54. The lower backup assembly 62 may include a lower outer backup sleeve 102 disposed about the lower inner backup sleeve 98. The lower outer backup sleeve 102 may have an annular shoulder 104, and may be movable with respect to the lower inner backup sleeve 98. A biasing member 106, such as a spring or a mass of resilient deformable material, such as an elastomer, may be disposed between the annular shoulder 100 of the lower inner backup sleeve 98 and the annular shoulder 104 of the lower outer backup sleeve 102.

The lower backup assembly 62 may include a lower backup ring assembly 108. The lower backup ring assembly 108 may be coupled to a lower backup support 110. The lower backup support 110 may be coupled to the lower inner backup sleeve 98 and disposed at least partially inside the lower outer backup sleeve 102. The lower backup support 110 and the lower backup ring assembly 108 may move with the lower inner backup sleeve 98 relative to the lower outer backup sleeve 102. A key 112 may be coupled to the lower backup support 110, and may protrude into a keyway 114 of the lower outer backup sleeve 102. Relative movement between the lower backup support 110 and the lower outer backup sleeve 102 may be constrained by the interaction between the key 112 and the keyway 114.

The lower backup ring assembly 108 may be configured to enclose an outer surface 116 of the lower end 118 of the packing element 44. The lower backup ring assembly 108 may include an inner backup ring 120 and an outer backup ring 122 adjacent the inner backup ring 120. The inner backup ring 120 may have fingers 124 separated by slots 126, and the fingers 124 may be disposed adjacent the outer surface 116 of the lower end 118 of the packing element 44. The outer backup ring 122 may have fingers 128 separated by slots 130, and the fingers 128 may be disposed such that each finger 128 of the outer backup ring 122 overlaps with a corresponding slot 126 of the inner backup ring 120.

As shown in FIGS. 2B1-2C3 and 3, the packing element 44 may be manufactured as a single piece of packing material, such as an elastomer. The single piece may be referred to as a unitary structure. During manufacture, the elastomer may be built up in layers, such as by wrapping one or more sheet around a form, and then cured to form the unitary structure. In some embodiments, the packing element 44 may incorporate more than one grade of elastomeric material in the unitary structure. For example, the packing element may include elastomeric material of 70 durometer and elastomeric material of 90 durometer. In some embodiments, the packing element 44 may incorporate non-elastomeric materials in the unitary structure. For example, the unitary structure of the packing element 44 may include resilient fibers, such as aramid fibers. In some embodiments, the packing element 44 may include one or more garter spring embedded in the unitary structure. Thus, in embodiments in which the packing element 44 is a unitary structure, the unitary structure need not be homogenous. Furthermore, the unitary structure may include different types of materials, as described above.

In some embodiments, one or more filler ring 132 may be disposed around the packer mandrel 42, between the packer mandrel 42 and the packing element 44. The one or more filler ring 132 may be bonded to the packing element 44. The one or more filler ring 132 may be movable on the packer mandrel 42. In some embodiments, the one or more filler ring 132 may be made out of a rigid material, such as steel.

Lower Boost Mechanism

The packer assembly 40 may have a lower boost mechanism. The lower boost mechanism may be configured to act on the lower backup assembly 62 after the packing element 44 has been set in a bore. The lower boost mechanism may apply an upwardly-directed force on the lower backup assembly 62 when a pressure in the bore below the packing element 44 exceeds a pressure in the bore above the packing element 44.

The lower boost mechanism may include a boost housing 134 coupled to a boost housing extension 136. One end of the boost housing extension 136 may be coupled to the lower inner backup sleeve 98. The other end of the boost housing 134 may be coupled to a boost mandrel 138, which may also be coupled to another component of the bridge plug 2, such as a slip assembly 146. As illustrated in FIGS. 2D1-2D3, and for the benefit of further description, in some embodiments, the boost mandrel 138 may be coupled to a slip assembly skirt 148. The coupling between the boost mandrel 138 and the slip assembly skirt 148 may include a lock ring 150. The lock ring 150 may include ratchet teeth 152 that are configured to engage with corresponding ratchet teeth 154 on the boost mandrel 138. The lock ring 150 may be configured to permit the boost mandrel 138 to move upwards with respect to the slip assembly skirt 148, but prevent the boost mandrel 138 from moving downwards with respect to the slip assembly skirt 148.

The central mandrel 18 may extend through the lower boost mechanism, and may have one or more side port 140 that fluidically couples an interior of the central mandrel 18 with an exterior of the central mandrel 18. Seal members 142, 144 either side of the port may provide a seal between the central mandrel 18 and the boost housing 134 and the boost mandrel 138, respectively. Pressure in the bore above the packing element 44 when the packing element 44 is set in the bore may be communicated through the one or more side port 16 in the adaptor body 14, between the equalization mandrel 20 and the central mandrel 18, and through the one or more side port 140 of the central mandrel 18 into the interior of the boost housing 134. Pressure in the bore below the packing element 44 may be communicated around the lock ring 150 between the boost mandrel 138 and the slip assembly skirt 148 and into the interior of the boost mandrel 138.

Thus, a pressure differential may exist across the seal member 144 between the central mandrel 18 and the boost mandrel 138. If the pressure in the bore below the packing element 44 is greater than the pressure in the bore above the packing element 44, the pressure differential across the seal member 144 will result in a net upward force on the boost mandrel 138. The net upward force may be transmitted through the boost housing 134 and boost housing extension 136 to the lower backup assembly 62, and may result in the lower backup assembly 62 applying an upward boost force on the packing element 44 that is additional to the force applied during an initial setting of the packing element 44. A corresponding upward movement of the lower backup assembly 62, boost housing extension 136, boost housing 134, and boost mandrel 138 may be accommodated by the ratchet teeth 152 of the lock ring 150 and the ratchet teeth 154 of the boost mandrel 138, and hence the boost mandrel 138 may move upward with respect to the slip assembly 146. Since the ratchet teeth 152 of the lock ring 150 and the ratchet teeth 154 of the boost mandrel 138 inhibit the boost mandrel 138 from moving downwards with respect to the slip assembly 146, the boost force applied to the packing element 44 may be sustained even if the pressure differential that caused the exertion of the boost force is subsequently reduced, or eliminated, or reversed.

Upper Boost Mechanism

The packer assembly 40 may have an upper boost mechanism. The upper boost mechanism may be configured to act on the upper backup assembly 60 after the packing element 44 has been set in a bore. The upper boost mechanism may apply a downwardly-directed force on the upper backup assembly 60 when a pressure in the bore above the packing element 44 exceeds a pressure in the bore below the packing element 44.

The upper boost mechanism may include the packer mandrel 42, setting sleeve 24, and the lock ring 26 coupling the setting sleeve 24 to the central mandrel 18. Pressure in the bore above the packing element 44 when the packing element 44 is set in the bore may be communicated around the lock ring 26 coupling the setting sleeve 24 to the central mandrel 18, and into the interior of the setting sleeve 24 and against the seal member 46 that provides a seal between the packer mandrel 42 and the central mandrel 18. Pressure in the bore below the packing element 44 may be communicated around the lower backup assembly 62, into the interior of the boost housing extension 136, and between the central mandrel 18 and the packer mandrel 42 up to the seal member 46 that provides a seal between the packer mandrel 42 and the central mandrel 18.

Thus, a pressure differential may exist across the seal member 46 between the central mandrel 18 and the packer mandrel 42. If the pressure in the bore above the packing element 44 is greater than the pressure in the bore below the packing element 44, the pressure differential across the seal member 46 will result in a net downward force on the packer mandrel 42. The net downward force may be transmitted through the upper backup assembly 60, and may result in the upper backup assembly 60 applying a downward boost force on the packing element 44 that is additional to the force applied during an initial setting of the packing element 44. A corresponding downward movement of the upper backup assembly 60, packer mandrel 42, and setting sleeve 24 may be accommodated by the ratchet teeth 28 of the lock ring 26 and the ratchet teeth 30 of the central mandrel 18, and hence the setting sleeve 24 may move downward with respect to the central mandrel 18. Since the ratchet teeth 28 of the lock ring 26 and the ratchet teeth 30 of the central mandrel 18 inhibit the setting sleeve 24 from moving upwards with respect to the central mandrel 18, the boost force applied to the packing element 44 may be sustained even if the pressure differential that caused the exertion of the boost force is subsequently reduced, or eliminated, or reversed.

Slip Assembly

The bridge plug 2 may include a slip assembly 146, such as that shown in FIGS. 2C1-2E3 and in FIGS. 4A-4H. A slip setting ring 156 may be disposed around the central mandrel 18 within the boost housing extension 136. The slip setting ring 156 may be movable on the central mandrel 18, but temporarily coupled to the boost housing extension 136 by one or more fastener 158, such as a latch, locking dog, collet, snap ring, shear ring, shear screw, shear pin, or the like. As described below, the slip setting ring 156 and the one or more fastener 158 may enable an axial force from the packer mandrel 42 to be transmitted through the boost housing extension 136 and boost mandrel 138 in order to set slip member(s) 160 of the slip assembly 146. The slip member(s) 160 may be actuated into contact with a surrounding bore by interaction with an upper cone assembly 162 and a lower cone assembly 164.

As described above, FIGS. 2D1-2D3 show the boost mandrel 138 coupled to a slip assembly skirt 148 of the upper cone assembly 162. The slip assembly skirt 148 may be coupled to an upper support cone 166. In some embodiments, the slip assembly skirt 148 may be formed as part of the upper support cone 166. The upper support cone 166 may be disposed around an upper cone sleeve 168. The upper cone sleeve 168 may be coupled to an upper base cone 170. In some embodiments, the upper cone sleeve 168 may be formed as part of the upper base cone 170. The upper support cone 166 may be coupled to the upper cone sleeve 168 by a fastener 172, such as a latch, locking dog, collet, snap ring, shear ring, shear screw, shear pin, or the like. One or more key 174 may couple the upper support cone 166 with the upper cone sleeve 168. Each key 174 may protrude into a corresponding slot 176 in the upper cone sleeve 168.

Figure 4A:
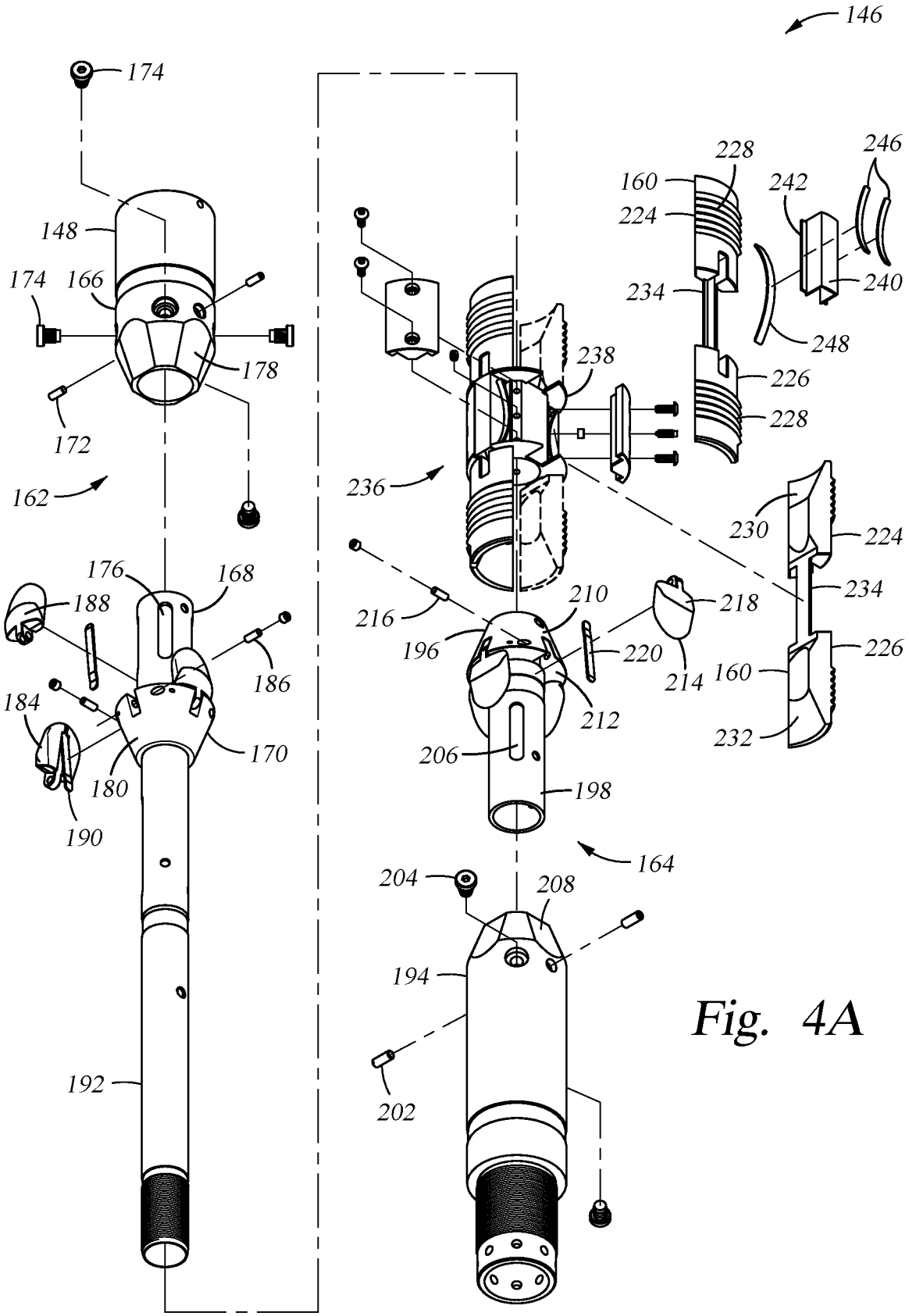
FIG. 4A is an exploded view of a slip assembly that is incorporated into the bridge plug of FIG. 1.

The upper support cone 166 may have a cone face 178. The upper base cone 170 may have a cone face 180 and a cone rear 182. One or more upper extension ramp 184 may be disposed between the cone face 178 of the upper support cone 166 and cone rear 182 of the upper base cone 170. As shown in FIG. 4A, the sloped outer surface of the cone face 178 of the upper support cone 166 may include a concave portion at an interface with each extension ramp 184. The upper extension ramp 184 may be pivotably coupled to the upper base cone 170 by a pin or hinge 186, and movable between a retracted position (as shown in FIGS. 2D1-2D3) and an extended position (as shown and described hereinafter). When in the extended position, the upper extension ramp 184 may have a ramp surface 188 substantially aligned with the cone face 180 of the upper base cone 170. The upper extension ramp 184 may be biased toward the retracted position by a biasing member 190, such as a spring or a mass of resilient deformable material, such as an elastomer. The biasing member 190 may be disposed in a slot in an underside of the upper extension ramp 184.

In some embodiments, a maximum outer diameter of the upper support cone 166 and a maximum outer diameter of the upper base cone 170 do not change when the slip assembly 146 transitions between the running, set, and released configurations.

The upper base cone 170 may be coupled to a slip mandrel 192. In some embodiments, the slip mandrel 192 and upper base cone 170 may be formed as a single piece. The slip mandrel 192 may extend through the slip assembly 146. The central mandrel 18 may extend through the slip mandrel 192 and through the slip assembly 146.

A lower cone assembly 164 may be disposed on the slip mandrel 192. The lower cone assembly 164 may include a lower support cone 194 and a lower base cone 196. A lower cone sleeve 198 may be coupled to the lower base cone 196. In some embodiments, the lower cone sleeve 198 may be formed as part of the lower base cone 196. The lower base cone 196 may be coupled to the slip mandrel 192 by a fastener 200, such as a latch, locking dog, collet, snap ring, shear ring, shear screw, shear pin, or the like. The lower support cone 194 may be disposed around the lower cone sleeve 198. The lower support cone 194 may be coupled to the lower cone sleeve 198 by a fastener 202, such as a latch, locking dog, collet, snap ring, shear ring, shear screw, shear pin, or the like. One or more key 204 may couple the lower support cone 194 with the lower cone sleeve 198. Each key 204 may protrude into a corresponding slot 206 in the lower cone sleeve 198.

The lower support cone 194 may have a cone face 208. The lower base cone 196 may have a cone face 210 and a cone rear 212. One or more lower extension ramp 214 may be disposed between the cone face 208 of the lower support cone 194 and cone rear 212 of the lower base cone 196. As shown in FIG. 4A, the sloped outer surface of the cone face 208 of the lower support cone 194 may include a concave portion at an interface with each extension ramp 214. The lower extension ramp 214 may be pivotably coupled to the lower base cone 196 by a pin or hinge 216, and movable between a retracted position (as shown in FIGS. 2D1-2D3) and an extended position (as shown and described hereinafter). When in the extended position, the lower extension ramp 214 may have a ramp surface 218 substantially aligned with the cone face 210 of the lower base cone 196. The lower extension ramp 214 may be biased toward the retracted position by a biasing member 220, such as a spring or a mass of resilient deformable material, such as an elastomer. The biasing member 220 may be disposed in a slot in an underside of the lower extension ramp 214.

In some embodiments, a maximum outer diameter of the lower support cone 194 and a maximum outer diameter of the lower base cone 196 do not change when the slip assembly 146 transitions between the running, set, and released configurations.

The slip assembly 146 may also include one or more slip member 160 disposed between the upper cone assembly 162 and the lower cone assembly 164. Each slip member 160 may be movable between retracted and extended positions. Each slip member 160 may have an upper gripper 224 and a lower gripper 226. The upper and lower grippers 224, 226 may have outwardly projecting teeth 228. The teeth 228 may be configured to penetrate an inner surface of a bore, such as an inner surface of a tubular. Each upper and lower gripper 224, 226 may have a sloped inner surface 230, 232. The sloped inner surface 230 of the upper gripper 224 may be configured to engage and slide against the cone face 180 of the upper base cone 170. The sloped inner surface 230 of the upper gripper 224 may be configured to engage and slide against the ramp surface 188 of the upper extension ramp 184 when the upper extension ramp 184 is in the extended position. The sloped inner surface 232 of the lower gripper 226 may be configured to engage and slide against the cone face 210 of the lower base cone 196. The sloped inner surface 232 of the lower gripper 226 may be configured to engage and slide against the ramp surface 218 of the lower extension ramp 214 when the lower extension ramp 214 is in the extended position.

As shown in FIGS. 2D3, 4B, 4D, and 4H, rotational alignment between the upper cone assembly 162 and the lower cone assembly 164 may be maintained by a key 221 in the lower support cone 194 that rides within a keyway 222 in the lower cone sleeve 198 and a keyway 223 in the slip mandrel 192.

Each slip member 160 may have a shank 234 between the upper gripper 224 and the lower gripper 226. The shank 234 may be at least partially contained within a slip cage 236. The slip cage 236 may include a slip cage body 238. One or more retainer 240 may be disposed in a radial opening in the slip cage body 238. Each retainer 240 may be movable with respect to the slip cage body 238 between retracted and extended positions. As best seen in FIGS. 4A and 4G, each retainer 240 may have a generally "U" shaped profile with one or more flange 242 at the ends of the "U" profile. Each retainer 240 may have a flange 242 at each end of the "U" profile. Each flange 242 may be disposed within the slip cage body 238, and may be configured to interact with a corresponding shoulder 244 in the slip cage body 238. A biasing member 246, such as a spring or a mass of resilient deformable material, such as an elastomer, may be disposed between each flange 242 and each corresponding shoulder 244. Each retainer 240 may be biased towards the retracted position by the biasing member(s) 246. The shank 234 of each slip member 160 may be disposed between the slip cage body 238 and a corresponding retainer 240. For example, the shank 234 of each slip member 160 may be disposed within the "U" profile of a corresponding retainer 240. A biasing member 248, such as a spring or a mass of resilient deformable material, such as an elastomer, may be disposed between each shank 234 and the base of each "U" profile of a corresponding retainer 240. Each shank 234, and therefore each slip member 160, may be biased towards the retracted position by each biasing member 248.

When the bridge plug 2 transitions from the running configuration to the set configuration, each slip member 160 may move from the retracted position to the extended position and each retainer 240 may move from the retracted position to the extended position. When the bridge plug 2 transitions from the set configuration to the released configuration, each slip member 160 may move from the extended position to the retracted position and each retainer 240 may move from the extended position to the retracted position.

Figure 4B:
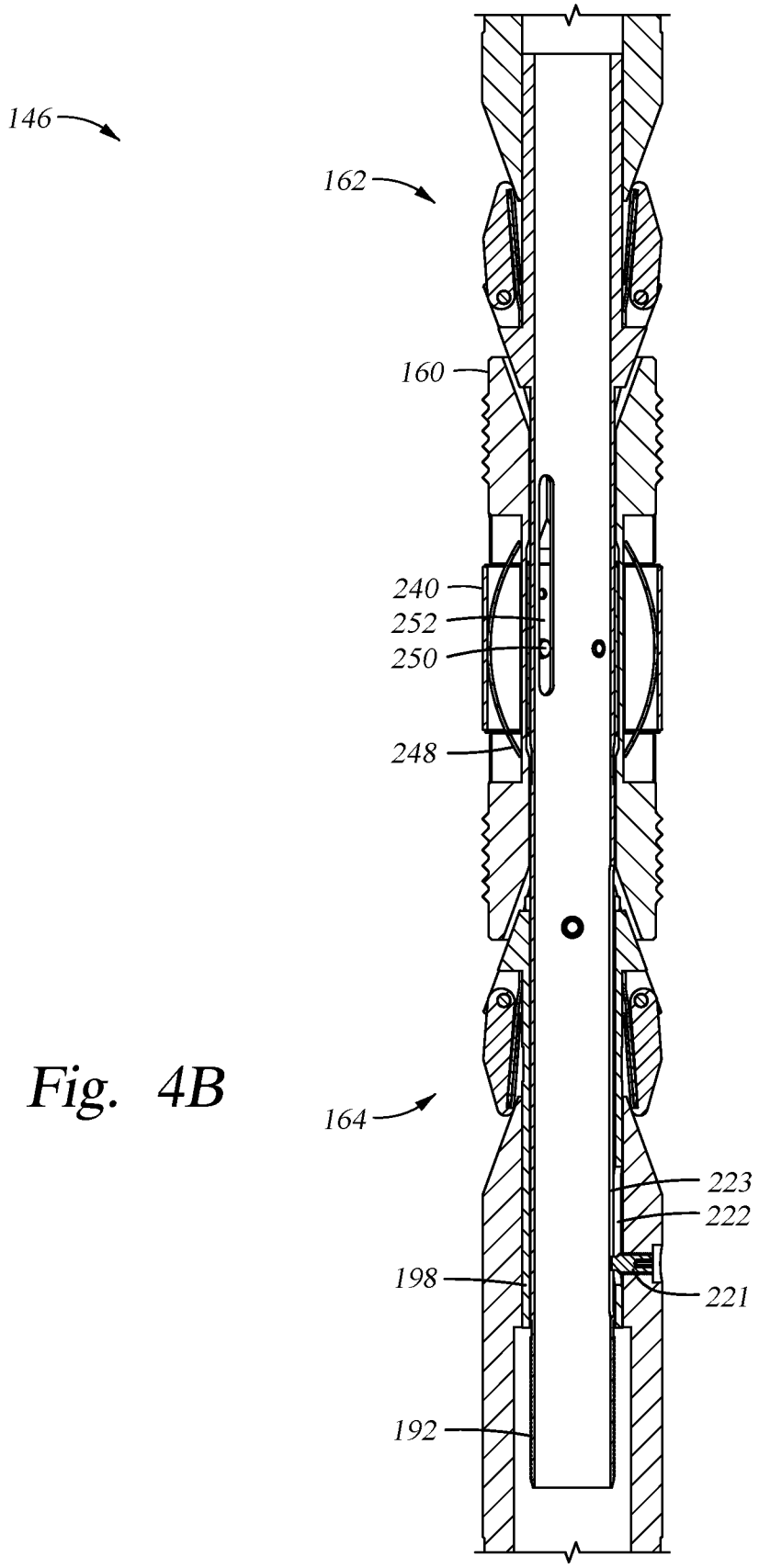
FIG. 4B is a longitudinal cross-sectional view taken through the center of the slip assembly of FIG. 4A showing the slip assembly in a running configuration.
Figure 4C:
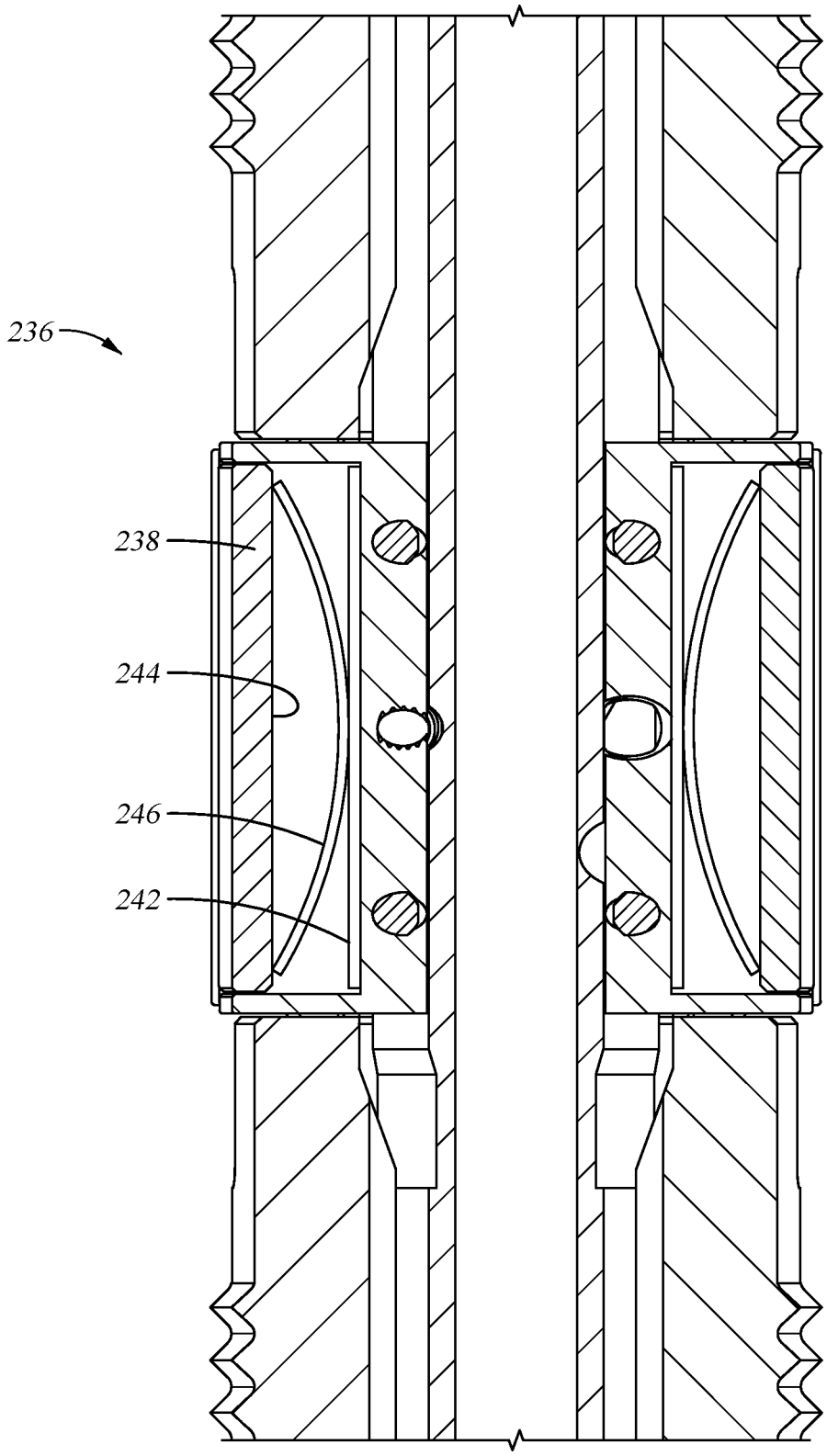
FIG. 4C is a longitudinal cross-sectional view of the slip cage of the slip assembly of FIG. 4A, that is offset from the center of the slip assembly.
Figure 4D:
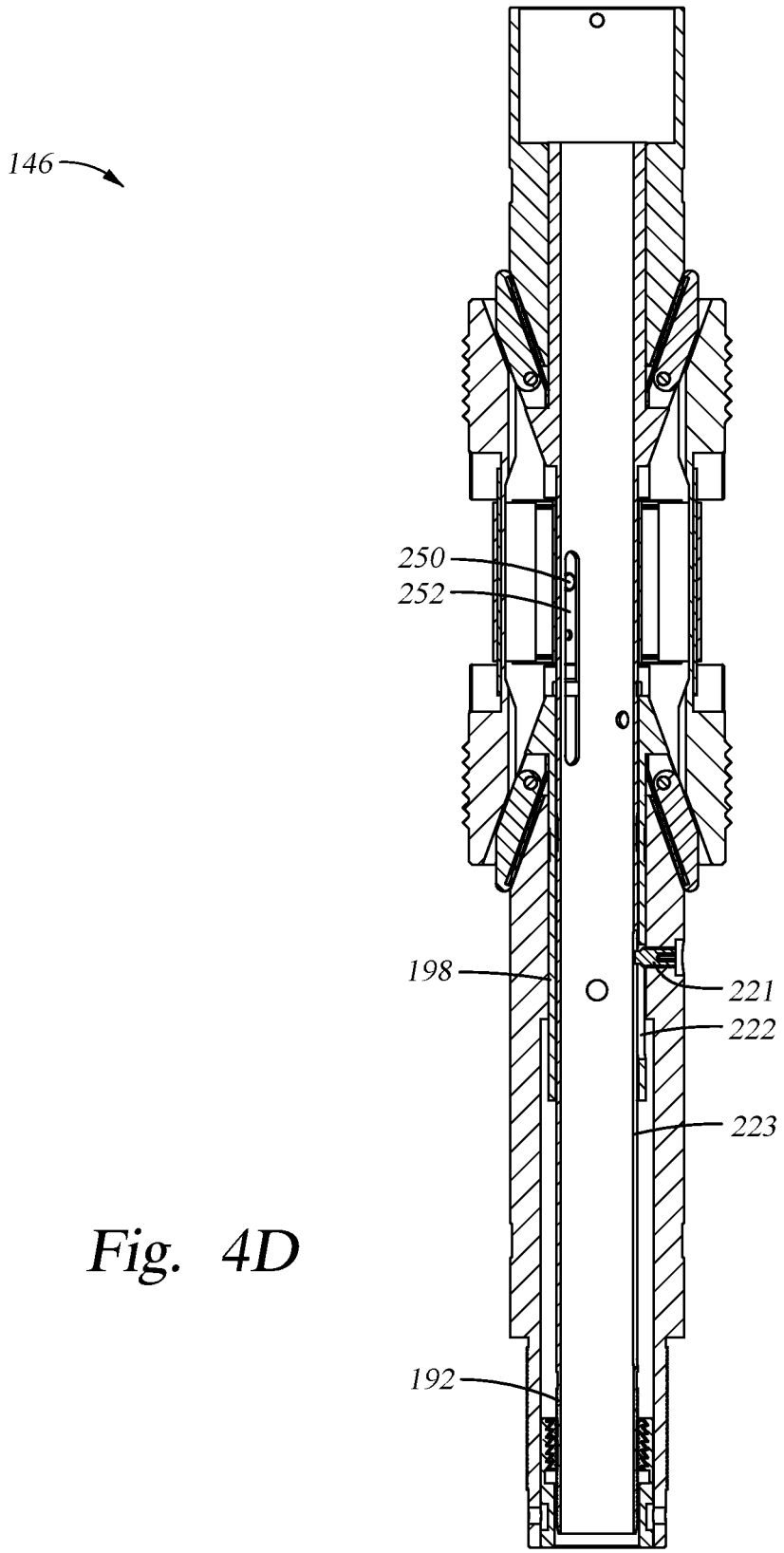
FIG. 4D is a longitudinal cross-sectional view taken through the center of the slip assembly of FIG. 4A showing the slip assembly in a set configuration.
Figure 4E:
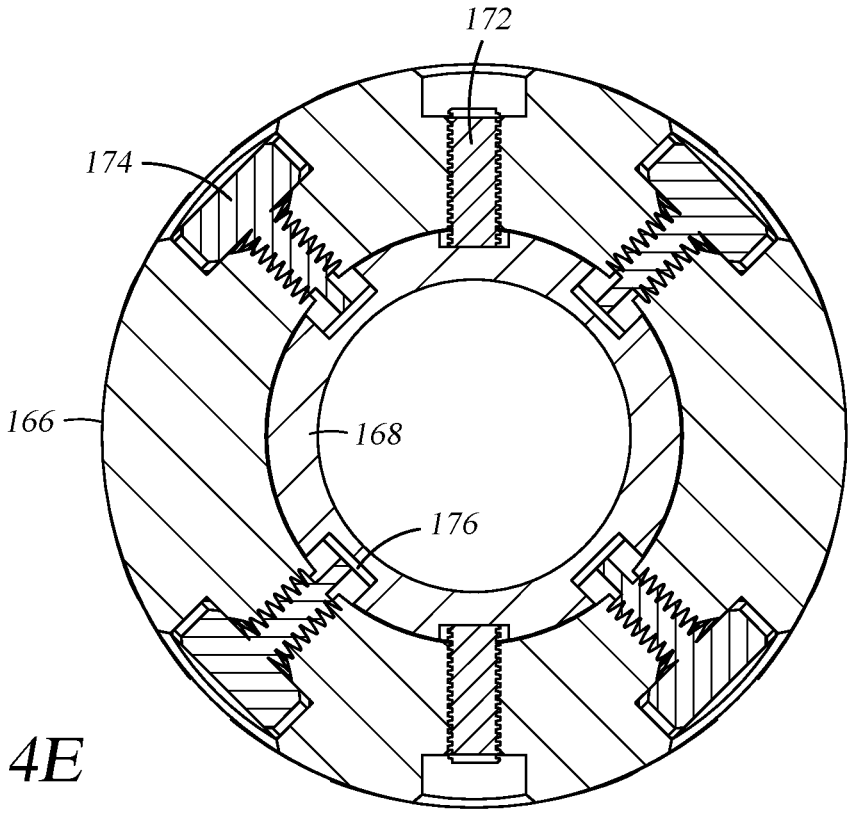
FIGS. 4E to 4H are lateral cross-sectional views of the slip assembly of FIG. 4A.
Figure 4F:
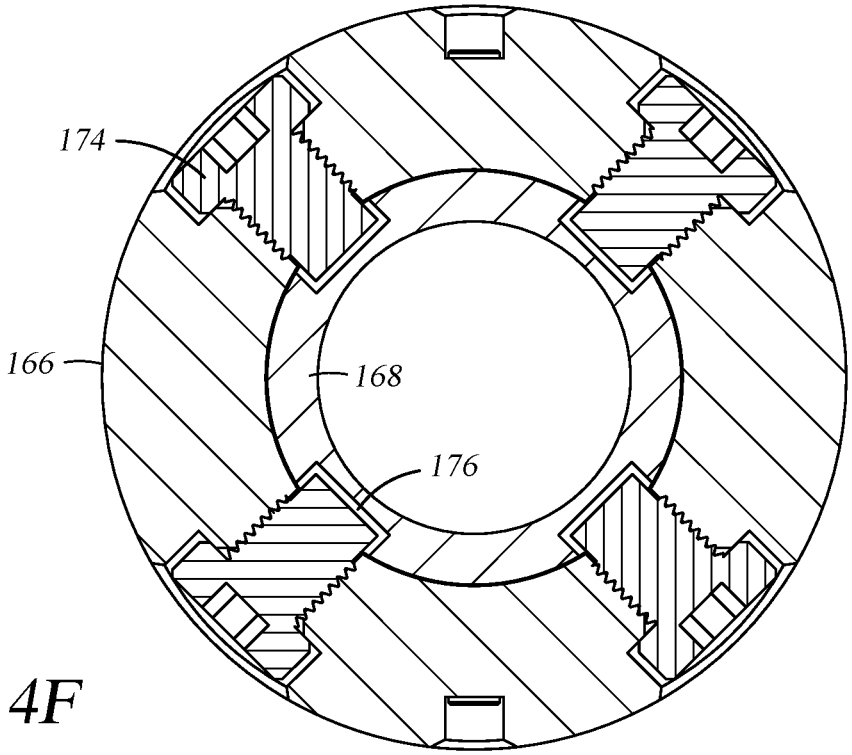
Figure 4G:
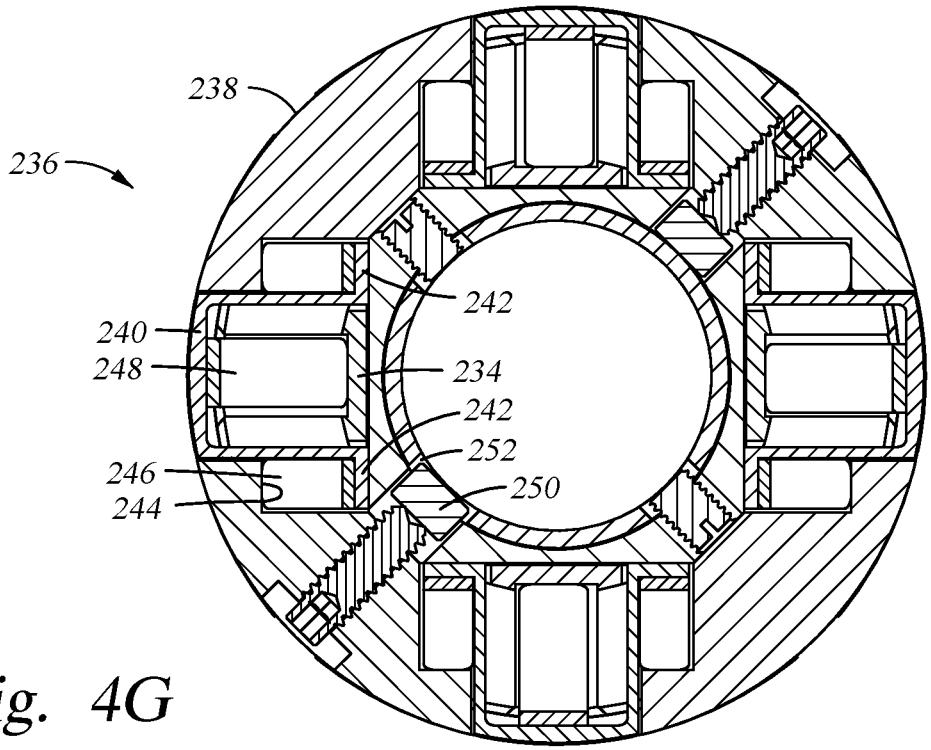
Figure 4H:
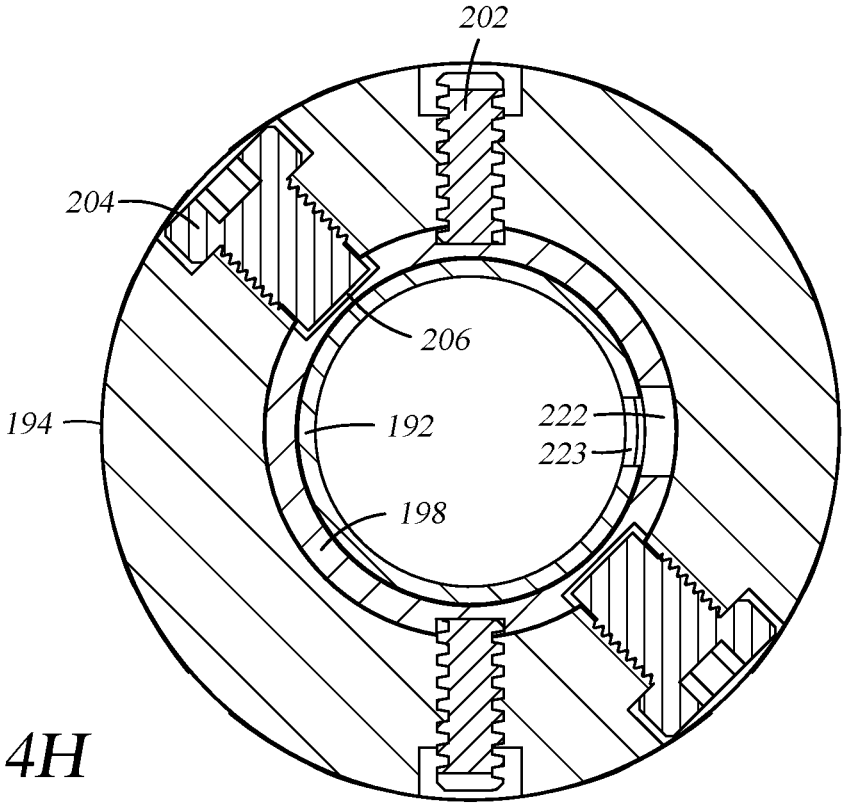

As shown in FIGS. 4B, 4D, and 4G, one or more key 250 may couple the slip cage 236 with the slip mandrel 192. Each key 250 may protrude into a corresponding slot 252 in the slip mandrel 192. The interaction between each key 250 and corresponding slot 252 may inhibit relative rotation between the slip cage 236 and the slip mandrel 192. Thus, rotational alignment between each slip member 160 and each of the upper and lower base cone faces 180, 210 plus the upper and lower extension ramps 184, 214 may be maintained.

Setting/Release Mechanisms

The slip assembly 146 may be coupled to one or more mechanism, such as a setting mechanism and/or a release mechanism. The one or more mechanism may be actuated during transition of the bridge plug 2 from the running configuration to the set configuration. The one or more mechanism may be actuated during the transition of the bridge plug 2 from the set configuration to the released configuration.

Figure 2H:
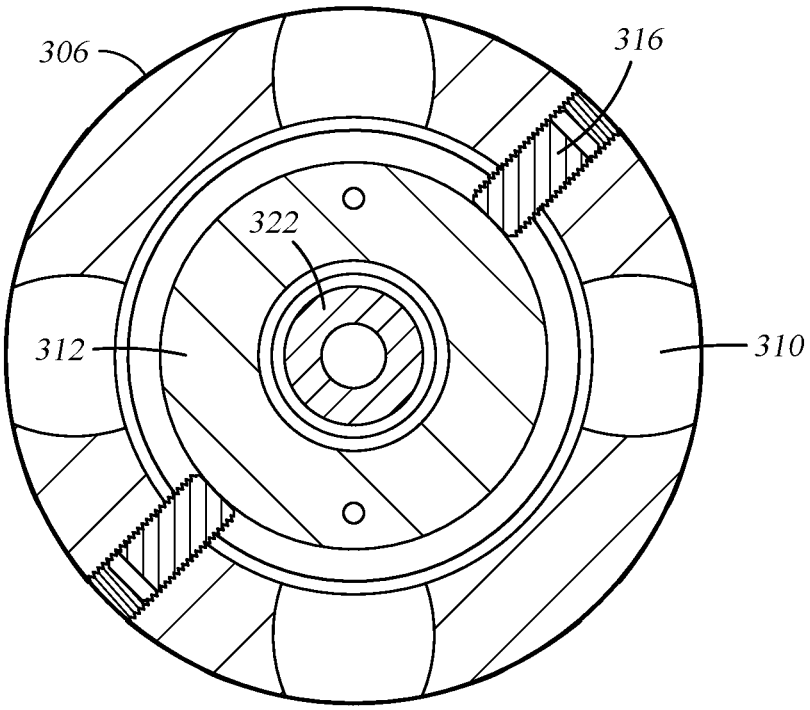
Figure 2I:
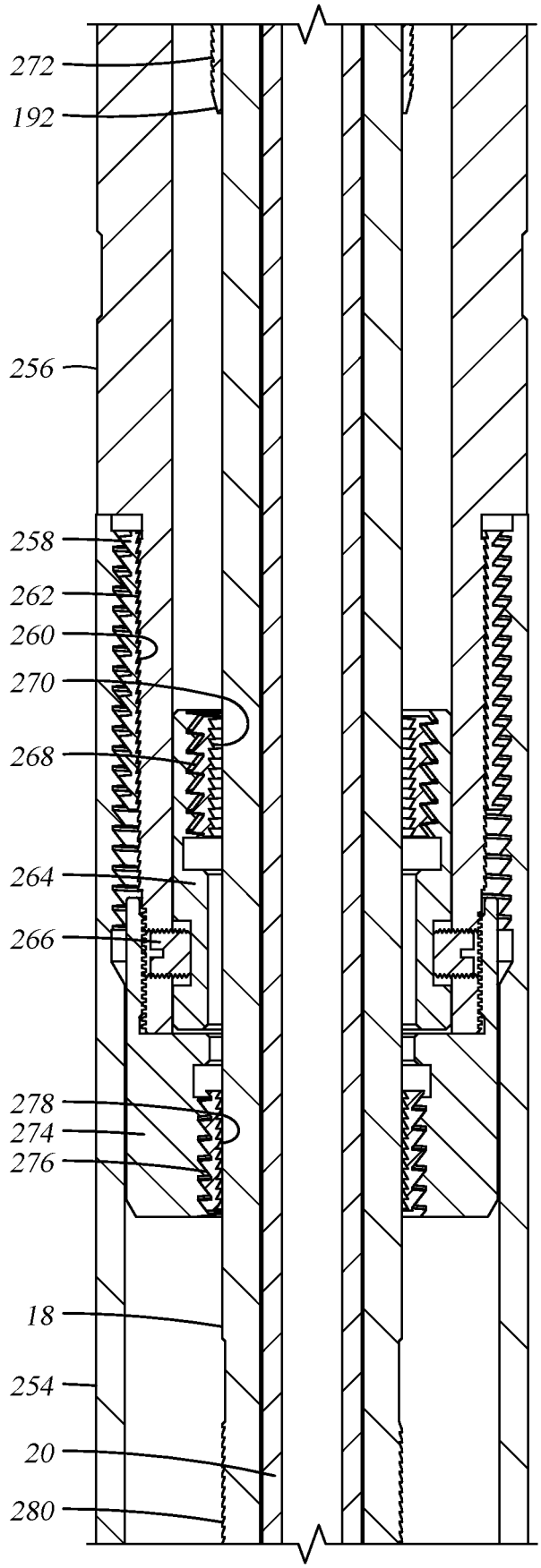
FIG. 2I focuses on a portion of the bridge plug of FIG. 1 as depicted in FIG. 2E3.

The slip assembly 146 may be coupled to a release housing 254. The coupling may be between a slip assembly connector 256 and the release housing 254. In some embodiments, the slip assembly connector 256 may be part of the lower support cone 194. In some embodiments, the slip assembly connector 256 may be coupled to the lower support cone 194. With reference to FIG. 2I, the coupling between the release housing 254 and the slip assembly connector 256 may include a lock ring 258. The lock ring 258 may include ratchet teeth 260 that are configured to engage with corresponding ratchet teeth 262 on the slip assembly connector 256. The lock ring 258 may be configured to permit the slip assembly connector 256 to move upwards with respect to the release housing 254, but prevent the slip assembly connector 256 from moving downwards with respect to the release housing 254.

Still referring to FIG. 2I, the slip assembly connector 256 may be disposed about a shear sub 264. The shear sub 264 may be configured to be a secondary release mechanism that maintains the slip assembly 146 in the set configuration until the packer assembly 40 has transitioned to the released configuration. The shear sub 264 may be coupled to the slip assembly connector 256 by a fastener 266, such as a latch, locking dog, collet, snap ring, shear ring, shear screw, shear pin, or the like. The shear sub 264 may be disposed about the central mandrel 18 such that sufficient space exists for an end of the slip mandrel 192 to move into a position between the shear sub 264 and the central mandrel 18. The shear sub 264 may be configured to couple to the slip mandrel 192 during operation of the bridge plug 2. The coupling between the shear sub 264 and the slip mandrel 192 may include a lock ring 268. The lock ring 268 may include ratchet teeth 270 that are configured to engage with corresponding ratchet teeth 272 on the slip mandrel 192. The lock ring 268 may be configured to permit the slip mandrel 192 to move downwards with respect to the shear sub 264, but prevent the slip mandrel 192 from moving upwards with respect to the shear sub 264.

Continuing with FIG. 2I, the slip assembly connector 256 may be coupled to a lower cone retainer 274. The lower cone retainer 274 may be disposed within the release housing 254 and about the central mandrel 18. The lower cone retainer 274 may be configured to couple to the central mandrel 18 during operation of the bridge plug 2. The coupling between the lower cone retainer 274 and the central mandrel 18 may include a lock ring 276. The lock ring 276 may include ratchet teeth 278 that are configured to engage with corresponding ratchet teeth 280 on the central mandrel 18. The lock ring 276 may be configured to permit the central mandrel 18 to move upwards with respect to the lower cone retainer 274, but prevent the central mandrel 18 from moving downwards with respect to the lower cone retainer 274.

Now referring to FIGS. 2F1-2F3, the central mandrel 18 may extend into the release housing 254 and be coupled to a release sub 282. The release sub 282 may be contained within the release housing 254. One or more seal member 284 may provide a seal between the central mandrel 18 and the release sub 282. One or more seal member 286 may provide a seal between the release sub 282 and the release housing 254. One or more release lug 288 may be disposed within one or more corresponding slot 290 in the release sub 282. Each release lug 288 may have an external profile 292 that is configured to engage a corresponding internal profile 294 of the release housing 254. The engagement between each release lug 288 and the release housing 254 may inhibit axial movement of the release sub 282 with respect to the release housing 254. The one or more release lug 288 may be maintained in engagement with the release housing 254 by a support ring 296 disposed within the release sub 282. The one or more release lug 288 and the support ring 296 may be configured as a primary release mechanism that maintains the packer assembly 40 in the set configuration until after pressure equalization across the packing element 44 has been facilitated.

The equalization mandrel 20 may extend through the central mandrel 18 into the release sub 282, and may be coupled to a release mandrel 298. The release mandrel 298 may extend through the support ring 296. The support ring 296 may be configured to couple to the release mandrel 298 during operation of the bridge plug 2. The coupling between the support ring 296 and the release mandrel 298 may include a lock ring 300. The lock ring 300 may include ratchet teeth 302 that are configured to engage with corresponding ratchet teeth 304 on the release mandrel 298. The lock ring 300 may be configured to permit the release mandrel 298 to move downwards with respect to the support ring 296, but prevent the release mandrel 298 from moving upwards with respect to the support ring 296.

The lower end of the release housing 254 may be coupled to a ported sub 306. The release mandrel 298 may extend into the ported sub 306, and may have one or more side port 308 at a lower end. The ported sub 306 may have one or more side port 310. As shown in FIGS. 2F2-2F3, when the bridge plug 2 is in the running configuration, the one or more side port 310 of the ported sub 306 may be obscured by an equalizing sleeve 312. One or more seal member 314 may inhibit fluidic communication through the one or more side port 310 of the ported sub 306 when the equalizing sleeve 312 is in the position as shown in FIGS. 2F2-2F3. As shown in FIG. 2H, the equalizing sleeve 312 may be temporarily held in the position shown in FIGS. 2F2-2F3 by a fastener 316, such as a latch, locking dog, collet, snap ring, shear ring, shear screw, shear pin, or the like.

The ported sub 306 may be coupled to a bull nose 318. The bull nose 318 may be without any fluid communication ports. One or more seal member 320 may inhibit fluidic communication between the ported sub 306 and the bull nose 318. In some embodiments, instead of a bull nose 318, the ported sub 306 may be coupled to an alternative item of equipment, such as a tubular, a gauge carrier, a logging tool, a perforating gun, etc. As shown in FIGS. 2F2-2F3, the bull nose 318 may be coupled to a debris mandrel 322 within the ported sub 306. The debris mandrel 322 may extend from the bull nose 318 and into the equalizing sleeve 312. To facilitate axial movement of the equalizing sleeve 312 so as to uncover the one or more side port 310 of the ported sub 306, the equalizing sleeve 312 may have one or more relief bore 324. The relief bore 324 may prevent the occurrence of a pressure lock as the equalizing sleeve 312 moves axially over the debris mandrel 322 toward the bull nose 318.

Bridge Plug Operation

Figure 5A:
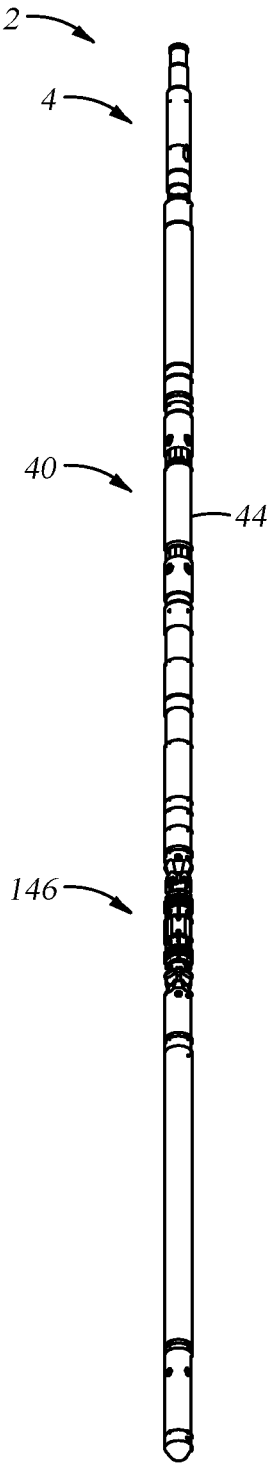
FIGS. 5A to 5G are external views of the bridge plug of FIG. 1 in various stages of transition from the running configuration to a set configuration, and further to a released configuration.
Figure 5B:
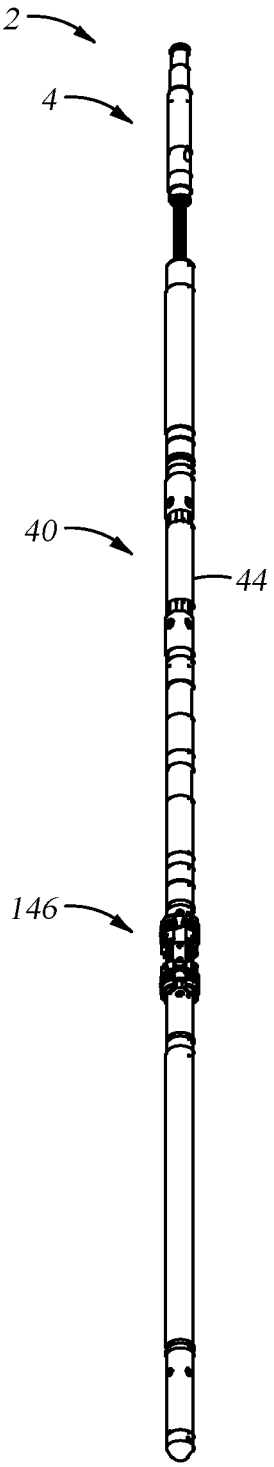
Figure 5C:
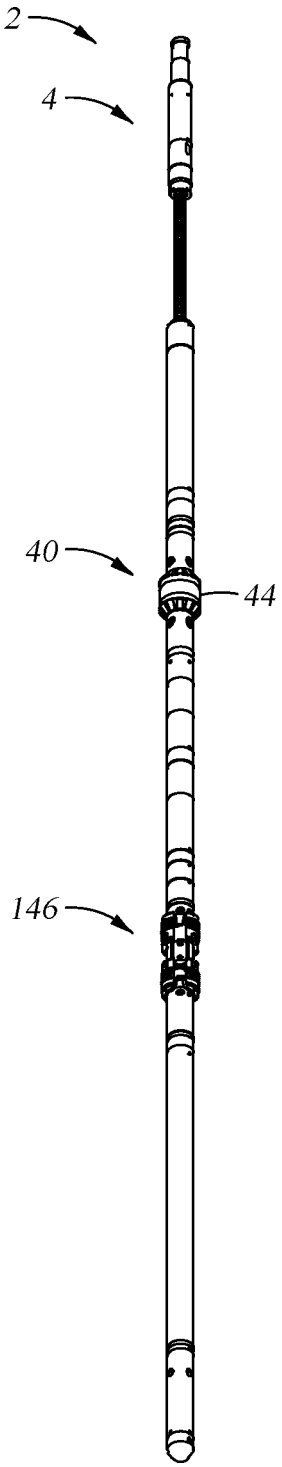
Figure 5D:
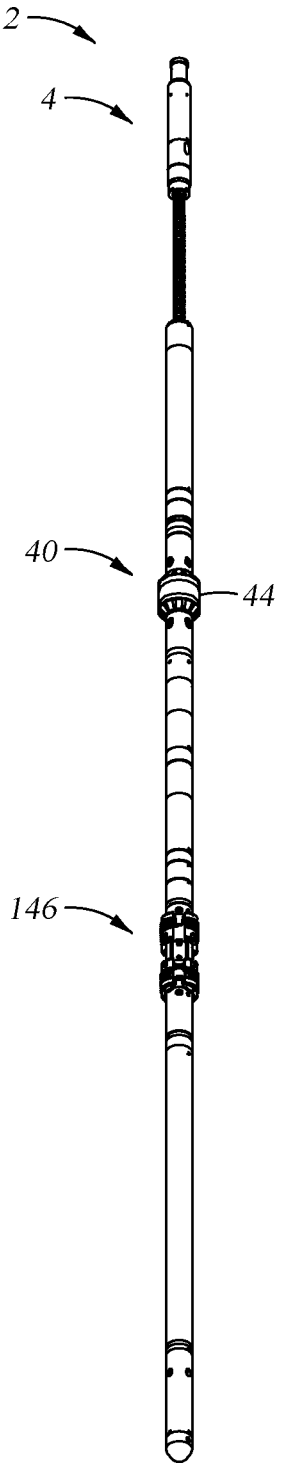
Figure 5E:
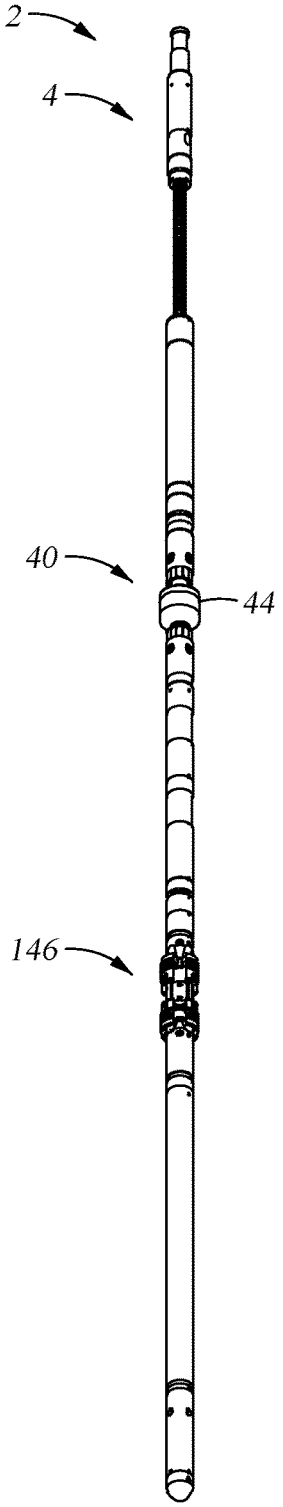
Figure 5F:
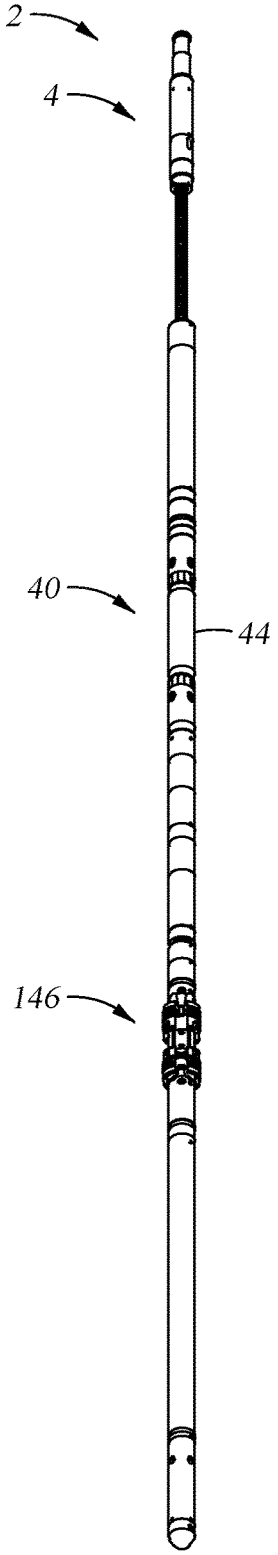
Figure 5G:
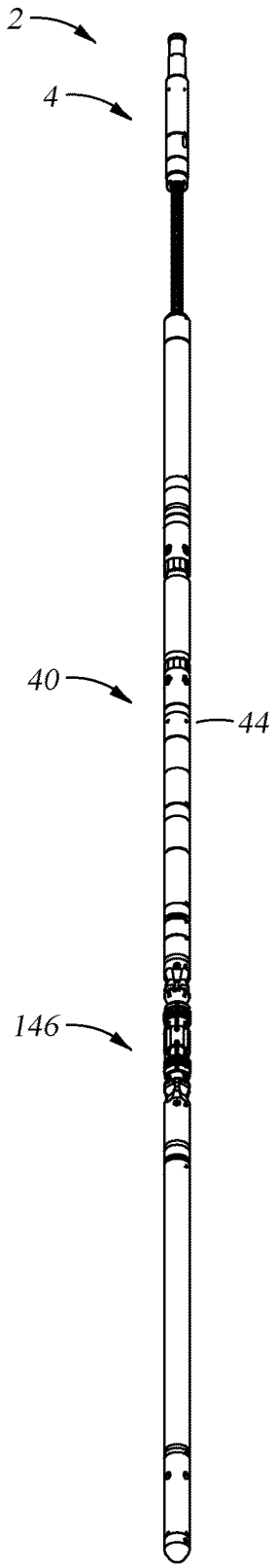

FIGS. 5A-5G show the bridge plug 2 in different stages of operation. FIG. 5A shows the bridge plug 2 in a running configuration. FIG. 5B shows the bridge plug 2 during transition to a set configuration in which the slip assembly 146 has been set but the packer assembly 40 is yet to be set. FIG. 5C shows the bridge plug 2 in the set configuration in which both the slip assembly 146 and the packer assembly 40 have been set. FIG. 5D shows the bridge plug 2 while still in the set configuration, but actuated to equalize pressure across the packing element 44 of the packer assembly 40. FIG. 5E shows the bridge plug 2 during releasing of the packing element 44. FIG. 5F shows the bridge plug 2 having released the packing element 44 and commencing release of the slip assembly 146. FIG. 5G shows the bridge plug 2 after having released the slip assembly 146 and fully transitioned to a released configuration.

In the following descriptions, any recital of item A moving towards item B is to be interpreted to encompass item A moving towards item B that is itself moving in the same direction as item A, item A moving towards a stationary item B, item B moving towards item A that is itself moving in the same direction as item B, item B moving towards a stationary item A, and both items A and B moving towards each other. Similarly, any recital of item A moving away from item B is to be interpreted to encompass item A moving away from item B that is itself moving in the same direction as item A, item A moving away from a stationary item B, item B moving away from item A that is itself moving in the same direction as item B, item B moving away from a stationary item A, and both items A and B moving away from each other.

Details of the bridge plug 2 in the running configuration are shown in FIGS. 2A1-2I, and are described above. In an exemplary method, a setting tool (not shown) having a setting tool sleeve 6 (FIG. 1) may be coupled to the bridge plug 2. The bridge plug 2 may be inserted into a bore, such as a wellbore 336 (see FIGS. 6D1 and 7C2), a pipeline, or the like. Activation of the setting tool may involve applying a tensile axial force (that may be considered as a pull force) to the fishing neck 8 while applying a compressive axial force (that may be considered as a push force) to the setting sleeve 24. Activation of the setting tool may result in the bridge plug 2 transitioning from the configuration as shown in FIG. 5A to that shown in FIG. 5B. Activation of the setting tool may result also in the bridge plug 2 transitioning from the configuration as shown in FIG. 5B to that shown in FIG. 5C.

Slip Assembly Setting

Details of the bridge plug 2 corresponding to the status shown in FIG. 5B are shown in FIGS. 6A1-6F3. The following description highlights at least some of the changes to occur in transitioning from the configuration shown in FIGS. 2A1-2F3. As illustrated, the setting sleeve 24 has moved axially away from the setting tool adaptor 4. Each key 36 has slid within a corresponding slot 38, and the ratchet teeth 28 of the lock ring 26 have moved along, and remain engaged with, the ratchet teeth 30 on the central mandrel 18. The one or more fastener 32 coupling the central mandrel 18 to the setting sleeve 24 has been defeated, such as by shearing.

Axial movement of the setting sleeve 24 has resulted in axial movement of the packer mandrel 42. The lower end of the packer mandrel 42 has engaged the slip setting ring 156. Because the one or more fastener 158 coupling the slip setting ring 156 to the boost housing extension 136 has not been defeated, axial force exerted by the packer mandrel 42 on the slip setting ring 156 has been transferred to the boost housing extension 136 and to the boost housing 134.

The axial force on the boost housing 134 has caused the slip assembly 146 to transition into the set configuration. The one or more fastener 172 coupling the upper support cone 166 to the upper cone sleeve 168 has been defeated, such as by shearing, and the upper support cone 166 has moved towards the upper base cone 170. Each upper extension ramp 184 has ridden along the cone face 178 of the upper support cone 166 from a retracted position to an extended position; each upper extension ramp 184 having pivoted about a respective pin or hinge 186. The one or more fastener 202 coupling the lower support cone 194 to the lower cone sleeve 198 has been defeated, such as by shearing, and the lower support cone 194 has moved towards the lower base cone 196. Each lower extension ramp 214 has ridden along the cone face 208 of the lower support cone 194 from a retracted position to an extended position; each lower extension ramp 214 having pivoted about a respective pin or hinge 216.

Additionally, the one or more fastener 200 coupling the lower base cone 196 to the slip mandrel 192 has been defeated, such as by shearing, and the upper cone assembly 162 has moved towards the lower cone assembly 164. The sloped inner surface 230 of the upper gripper 224 of each slip member 160 has ridden along the cone face 180 of the upper base cone 170 and along a respective upper extension ramp 184. The sloped inner surface 232 of the lower gripper 226 of each slip member 160 has ridden along the cone face 210 of the lower base cone 196 and along a respective lower extension ramp 214. Hence, each slip member 160 has moved radially outwards and into a set position. As illustrated, each retainer 240 has also moved radially outwards to an extended position as a result of each slip member 160 moving radially outwards. Thus, in embodiments in which the bridge plug 2 had been installed in a bore (such as a wellbore or pipeline), the slip assembly 146 is now in a set configuration in the bore, and may provide an anchor against further axial movement of the bridge plug 2.

Because the upper cone assembly 162 has moved towards the lower cone assembly 164, the lower end of the slip mandrel 192 is now engaged with the lock ring 268 of the shear sub 264. The relative movement between the upper cone assembly 162 and the lower cone assembly 164 has been achieved because of the opposing axial tensile and compressive forces applied by the setting tool. The axial tensile force applied to the central mandrel 18 has transferred through the release sub 282, the one or more release lug 288, the release housing 254, the slip assembly connector 256, and to the lower support cone 194. The axial compressive force applied to the setting sleeve 24 has transferred through the packer mandrel 42, the boost housing extension 136, the boost housing 134, and to the upper support cone 166.

Packer Assembly Setting

Details of the bridge plug 2 corresponding to the status shown in FIG. 5C are shown in FIGS. 7A1-7F3. The following description highlights at least some of the changes to occur in transitioning from the configuration shown in FIGS. 6A1-6F3. As illustrated, the setting sleeve 24 has moved further axially away from the setting tool adaptor 4. Each key 36 has slid within a corresponding slot 38, and the ratchet teeth 28 of the lock ring 26 have moved along, and remain engaged with, the ratchet teeth 30 on the central mandrel 18.

The lower end of the packer mandrel 42 that had engaged the slip setting ring 156 applied an axial force in one direction, whereas the boost housing extension 136 and boost housing 134 were unable to move in the direction of the axial force because the slip assembly 146 had been set, thereby providing an anchor resisting movement. Thus, the boost housing extension 136 resisted the force applied by the packer mandrel 42 through the slip setting ring 156, resulting in the one or more fastener 158 coupling the slip setting ring 156 to the boost housing extension 136 being defeated, such as by shearing. Hence, the upper backup assembly 60 has moved towards the lower backup assembly 62, resulting in the packing element 44 becoming axially compressed.

As shown in FIGS. 7C1-C3, axial compression of the packing element 44 has caused the packing element 44 to extend radially outwardly. This has caused the inner and outer backup rings 86, 88 of the upper backup assembly 60 and the inner and outer backup rings 120, 122 of the lower backup assembly 62 to splay outwards. The upper backup support 76 may bear against the outer backup ring 88. The lower backup support 110 may bear against the outer backup ring 122. In some embodiments, particularly those in which the one or more filler ring 132 is bonded to the packing element 44, the packing element 44 may develop one or more external fold 326, as illustrated. In embodiments in which the bridge plug 2 had been installed in a bore (such as a wellbore or pipeline), the packer assembly 40 is now in a set configuration in the bore, and may provide a seal against an internal wall of the bore.

Equalization

Details of the bridge plug 2 corresponding to the status shown in FIG. 5D are shown in FIGS. 8A1-8F3. The following description highlights at least some of the changes to occur in transitioning from the configuration shown in FIGS. 7A1-7F3. In order to actuate the pressure equalization feature of the bridge plug 2, the fishing neck 8 of the setting tool adaptor 4 may be engaged by a suitable tool (not shown), such as a setting tool or a retrieval tool. The tool that engages the fishing neck 8 may apply an axial compressive force on the fishing neck 8. The axial compressive force may be sufficient to defeat, such as by shearing, the one or more fastener 12 coupling the fishing neck 8 to the release sleeve 10. As illustrated, the fishing neck 8 has moved down towards the adaptor body 14, which has caused the equalization mandrel 20 to move downwards with respect to the packer assembly 40 and the slip assembly 146.

As illustrated, downward movement of the equalization mandrel 20 has caused downward movement of the release mandrel 298 with respect to the support ring 296. Ratchet teeth 304 on the release mandrel 298 have become engaged with corresponding ratchet teeth 302 of the lock ring 300 in the support ring 296. Additionally, downward axial force applied through the release mandrel 298 has caused the fastener 316 coupling the equalizing sleeve 312 to the ported sub 306 to be defeated, such as by shearing. Subsequent downward movement of the equalization mandrel 20 has caused downward movement of the equalizing sleeve 312 with respect to the ported sub 306, thereby opening fluid communication through the one or more side port 310.

Thus, fluid in the bore below the packing element 44 may communicate with fluid in the bore above the packing element 44 via the one or more side port 310 in the ported sub 306, the one or more side port 308 in the release mandrel 298, the release mandrel 298, the equalization mandrel 20, the one or more side port 22 in the equalization mandrel 20, and the one or more side port 16 in the adaptor body 14. Hence, pressures in the bore above and below the packing element 44 may become substantially equalized.

Initiating Release of the Bridge Plug

Details of the bridge plug 2 corresponding to the status shown in FIG. 5E are shown in FIGS. 9A1-9F3. The following description highlights at least some of the changes to occur in transitioning from the configuration shown in FIGS. 8A1-8F3. In order to commence release of the bridge plug 2, a suitable tool (not shown), such as a setting tool or a retrieval tool, may apply an axial tensile force on the fishing neck 8 of the setting tool adaptor 4. As illustrated, the fishing neck 8 has moved upwards away from the adaptor body 14, which has caused the equalization mandrel 20 to move upwards with respect to the packer assembly 40 and the slip assembly 146. A further axial tensile force exerted on the fishing neck 8 has transferred through the release sleeve 10 and the adaptor body 14 to the central mandrel 18.

As illustrated, the central mandrel 18 has moved upwards with respect to the setting sleeve 24. The stop ring 34 on the central mandrel 18 has engaged an inner shoulder 333 of the setting sleeve 24, and further upward movement of the central mandrel 18 has caused the setting sleeve 24 to move upwards. Upward movement of the setting sleeve 24 has caused upward movement of the upper inner backup sleeve 64, and that has caused the upper backup assembly 60 to become disengaged from the packing element 44. As illustrated, the inner and outer backup rings 86, 88 of the upper backup assembly 60 may retract at least partially from their splayed outward position.

Upward movement of the upper inner backup sleeve 64 also has caused upward movement of the upper recovery sleeve 48 via engagement with a stop ring 328 on the upper recovery sleeve 48. As illustrated, interaction between the upper recovery profile 50 of the upper recovery sleeve 48 and the packing element 44 may cause the packing element 44 to begin to elongate axially and shrink radially. Additionally, or alternatively, interaction between the upper recovery profile 50 of the upper recovery sleeve 48 and the packing element 44 may cause the packing element 44 to begin to move axially upward and away from the lower backup assembly 62. FIGS. 9C1-9C3 show the packing element 44 to have elongated axially, shrank radially, and moved axially upward, resulting in the inner and outer backup rings 120, 122 of the lower backup assembly 62 retracting at least partially from their splayed outward positions.

Upward movement of the packing element 44 may also cause upward movement of the lower recovery sleeve 54 due to interaction between the lower recovery profile 56 of the lower recovery sleeve 54 and the packing element 44. As illustrated, a stop ring 330 on the lower recovery sleeve 54 may transfer an upward force, and upward movement, to the lower inner backup sleeve 98. Upward movement of the lower inner backup sleeve 98 may be transferred through the boost housing extension 136, the boost housing 134, and the boost mandrel 138 to the slip assembly skirt 148 via a stop ring 332 on the boost mandrel 138.

Upward movement of the slip assembly skirt 148 may cause upward movement of the upper support cone 166 away from the upper base cone 170. Hence, the upper support cone 166 may move away from each upper extension ramp 184. As illustrated, each upper extension ramp 184 may pivot from the extended position towards the retracted position under the influence of each corresponding biasing member 190.

Additionally, as illustrated, upward movement of the equalization mandrel 20 has caused upward movement of the release mandrel 298, and upward movement of the support ring 296 because of the engagement between the ratchet teeth 304 on the release mandrel 298 with the ratchet teeth 302 of the lock ring 300 in the support ring 296. Consequently, the radial support for the one or more release lug 288 to be in engagement with the release housing 254 had been removed, and thus upward movement of the central mandrel 18 may cause, as illustrated, upward movement of the release sub 282 such that each release lug 288 becomes disengaged from the release housing 254.

Completing Release of the Packing Element

Details of the bridge plug 2 corresponding to the status shown in FIG. 5F are shown in FIGS. 10A1-10F3. The following description highlights at least some of the changes to occur in transitioning from the configuration shown in FIGS. 9A1-9F3. A further axial tensile force applied to the fishing neck 8 of the setting tool adaptor 4 is transferred, as described above, via the central mandrel 18 to the upper recovery sleeve 48, thereby causing the packing element 44 to elongate axially and shrink radially. The central mandrel 18 and the release sub 282 have moved further upwards with respect to the slip assembly 146.

Completing Release of the Bridge Plug by Releasing the Slip Assembly

Details of the bridge plug 2 corresponding to the status shown in FIG. 5G are shown in FIGS. 11A1-11F3. The following description highlights at least some of the changes to occur in transitioning from the configuration shown in FIGS. 10A1-10F3. A further axial tensile force applied to the fishing neck 8 of the setting tool adaptor 4 is transferred via the central mandrel 18 and the stop ring 332 on the boost mandrel 138 to the slip assembly skirt 148 and the upper support cone 166. Upward movement of the upper support cone 166 with respect to the upper cone sleeve 168 ceased when at least one key 174 in the upper support cone 166 reached the end of the corresponding slot 176 in the upper cone sleeve 168. Thereafter, further axial tensile force has in turn been transferred to the slip mandrel 192.

Because the slip mandrel 192 is coupled to the shear sub 264 via the lock ring 268, the shear sub 264 has experienced an upward force which, upon reaching a threshold value, has defeated (such as by shearing) the one or more fastener 266 coupling the shear sub 264 to the slip assembly connector 256, thereby releasing the shear sub 264 and permitting the slip mandrel 192 and shear sub 264 to move upwards with respect to the lower cone assembly 164 and to the slip member(s) 160. Further upward movement of the central mandrel 18 has resulted in the upper cone sleeve 168, upper base cone 170, and the slip mandrel 192 moving upwards with respect to the slip member(s) 160. Hence, the upper base cone 170 has moved away from the upper gripper 224 of each slip member 160, and the biasing members 246, 248 were able to commence retracting the slip member(s) 160.

During the transition between FIGS. 10A1-10F3 and FIGS. 11A1-11F3, a lower end of the slot 252 in the slip mandrel 192 encountered the key 250 of the slip cage 236, and further upward movement of the slip mandrel 192 caused the slip cage 236 to move upwards with respect to the lower cone assembly 164. Thus, the lower gripper 226 of each slip member 160 became axially separated from the lower cone assembly 164, and the biasing members 246, 248 caused the slip member(s) 160 to retract. Additional upward movement of the slip mandrel 192 with respect to the lower cone assembly 164 caused the shear sub 264 to contact and raise the lower cone sleeve 198 with respect to the lower support cone 194, thereby axially separating the lower base cone 196 from the lower support cone 194. As illustrated, each lower extension ramp 214 has pivoted towards the retracted position under the influence of each corresponding biasing member 220.

In some embodiments, the magnitude of axial separation between the lower base cone 196 and the lower support cone 194 may be governed by the interaction between the one or more key 204 that couples the lower support cone 194 with the lower cone sleeve 198 and the corresponding slot 206 in the lower cone sleeve 198. When the end of the corresponding slot 206 in the lower cone sleeve 198 reaches the one or more key 204 in the lower support cone 194, the lower support cone 194, the release housing 254, and the ported sub 306 may be carried by the one or more key 204 in the lower support cone 194.

In some embodiments, the magnitude of axial separation between the lower base cone 196 and the lower support cone 194 may be governed by the shear sub 264 encountering an internal shoulder 334 of the lower support cone 194. The lower support cone 194, the release housing 254, and the ported sub 306 may be carried by the shear sub 264.

Upon the retraction of the slip member(s) 160, the bridge plug 2 is no longer anchored to the bore in which the bridge plug 2 had been installed, and therefore the bridge plug 2 may be retrieved.

In summary, a bridge plug of the present disclosure incorporating a packer assembly of the present disclosure and a slip assembly of the present disclosure may be run into a bore, including being run through a restriction in the bore. The bridge plug may be actuated to a set configuration in which the slip assembly is anchored to a wall of the bore within a portion of the bore that is greater than the size of the restriction and a packing element of the packer assembly seals against the wall of the bore. The bridge plug may be further actuated to disengage from the wall of the portion of the bore, and to transition to a size that may fit through the restriction to enable retrieval from the bore. The bridge plug may be retrieved from the bore, including being retrieved through the restriction in the bore.

Packer Assembly Additional Embodiments

In some embodiments of the packer assembly 40, the packing element 44 may include multiple pieces of packing material, such that the packing element 44 is not considered as a unitary structure. For example, the packing element 44 may include a plurality of individual sections of deformable material, such as individual elastomeric sections. The plurality of individual sections may be positioned adjacent to one another on the packer mandrel 42. In some embodiments, the plurality of individual deformable sections may be separated by annular rings.

Figure 12A:
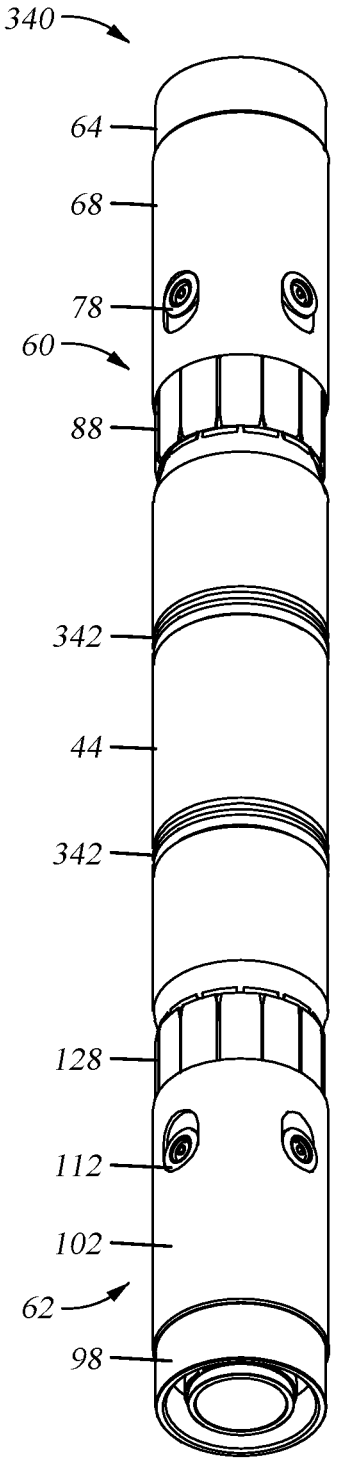
FIG. 12A is an external view of a packer assembly according to another embodiment, shown in a running configuration.
Figure 12B:
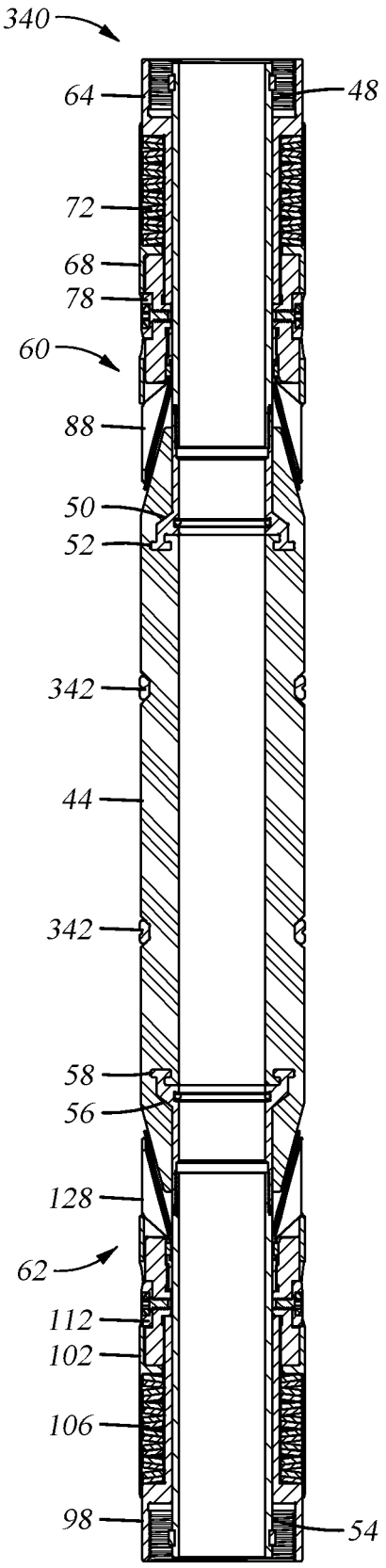
FIG. 12B is a longitudinal cross-sectional view taken through the center of the packer assembly of FIG. 12A.
Figure 12C:
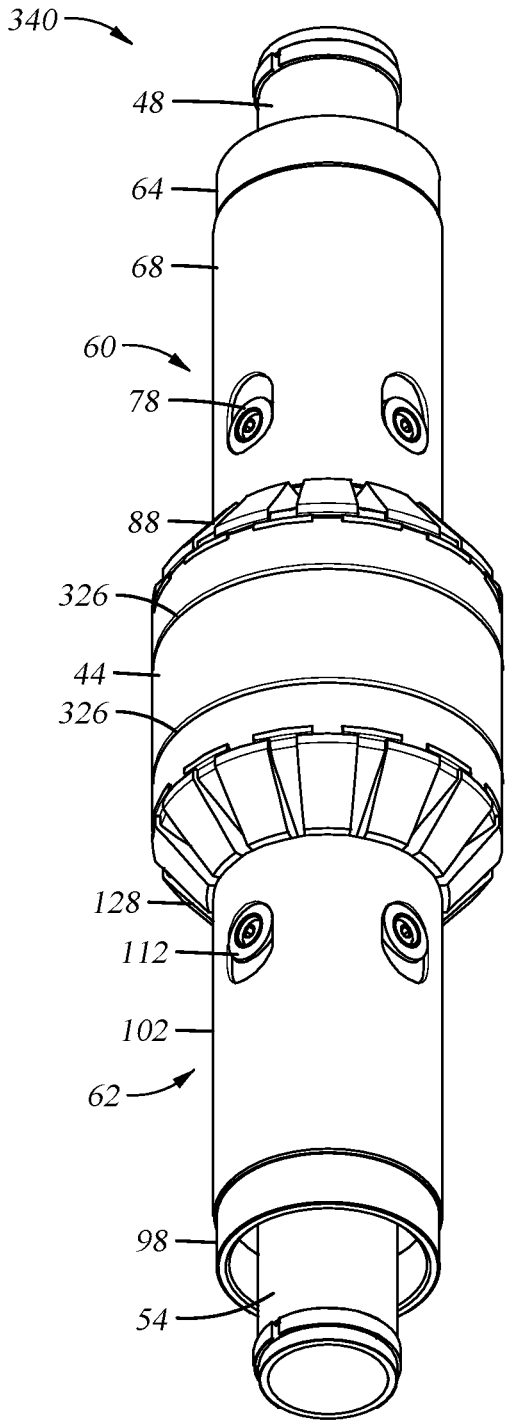
FIG. 12C is an external view of the packer assembly of FIG. 12A shown in a set configuration.
Figure 12D:
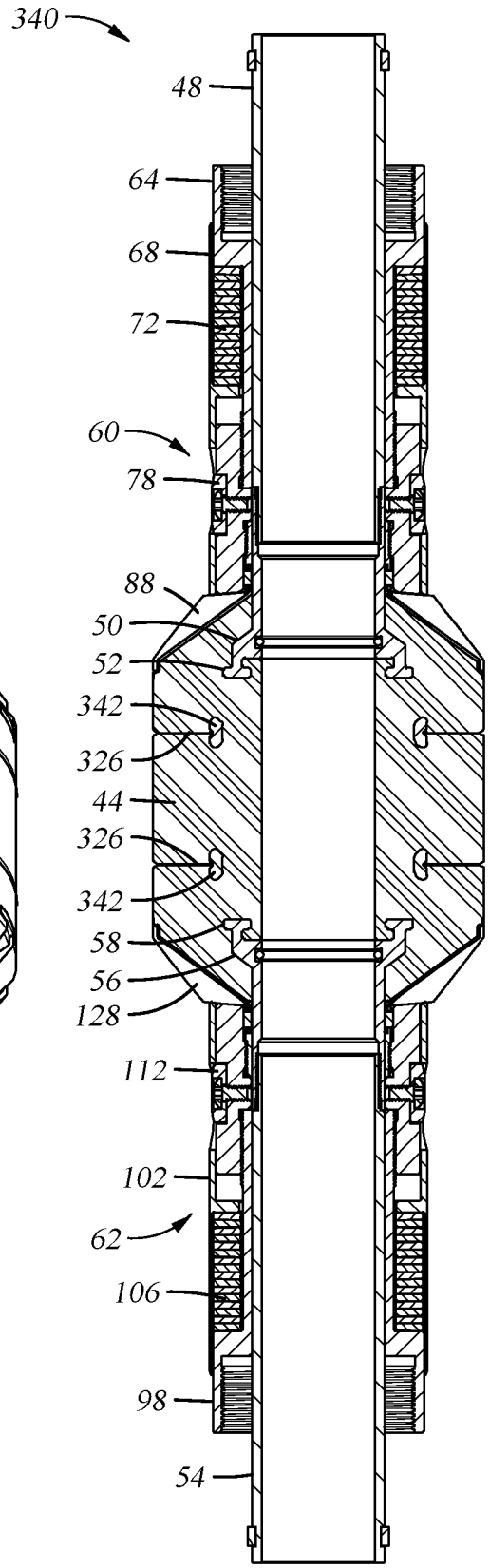
FIG. 12D is a longitudinal cross-sectional view taken through the center of the packer assembly of FIG. 12C.

In some embodiments, one or more spacer ring may be disposed within and/or about the packing element 44. FIGS. 12A to 12D show an example packer assembly 340 in which the filler rings 132 have been replaced by spacer rings 342 disposed about packing element 44. FIGS. 12A and 12B show the packer assembly in an unset configuration, such as a deployment configuration. FIGS. 12C and 12D show the packer assembly 340 of FIGS. 12A and 12B, respectively, in a set configuration in which the packing element 44 has undergone axial compression resulting in a corresponding radial enlargement. In FIGS. 12C and 12D the packing element 44 has deformed around the spacer rings 342, thereby forming folds 326.

In embodiments in which the packing element 44 is not considered as a unitary structure, the one or more spacer ring 342 may be disposed about one, some, or all of the plurality of sections of the packing element 44. In some embodiments, a spacer ring 342 may be bonded to the packing element 44. In some embodiments, a spacer ring 342 may not be bonded to the packing element 44. A spacer ring 342 may be made out of a rigid material, such as steel.

In some embodiments, a spacer ring 342 may not undergo a substantial change in shape or size when the packer assembly 40 is transitioned from the running configuration to the set configuration. In some embodiments, a spacer ring 342 may not undergo a substantial change in shape or size when the packer assembly 40 is transitioned from the set configuration to a released configuration. In some embodiments, a spacer ring 342 may have a first maximum outer diameter before the packer assembly 40 is transitioned from a running configuration to the set configuration, a second maximum outer diameter after the packer assembly 40 is transitioned from the running configuration to the set configuration, and the second maximum outer diameter may be substantially the same as the first maximum outer diameter. In some embodiments, a spacer ring 342 may have a third maximum outer diameter after the packer assembly 40 is transitioned from the set configuration to the released configuration, and the third maximum outer diameter may be substantially the same as the first maximum outer diameter.

Slip Assembly Additional Embodiments

Figure 13A:
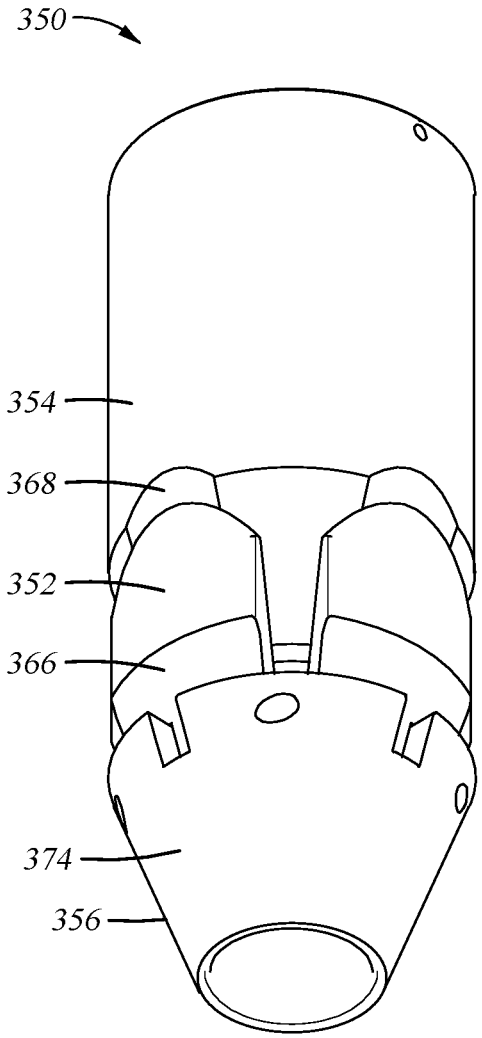
FIG. 13A is an external view of a slip cone assembly according to another embodiment, shown in a running configuration.
Figure 13B:
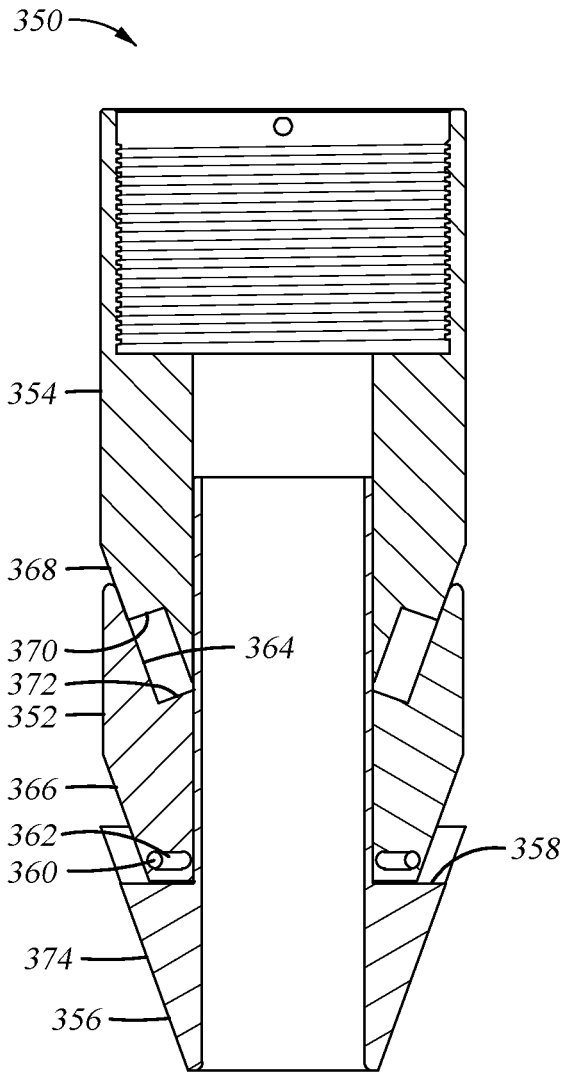
FIG. 13B is a longitudinal cross-sectional view taken through the center of the slip cone assembly of FIG. 13A.
Figure 13C:
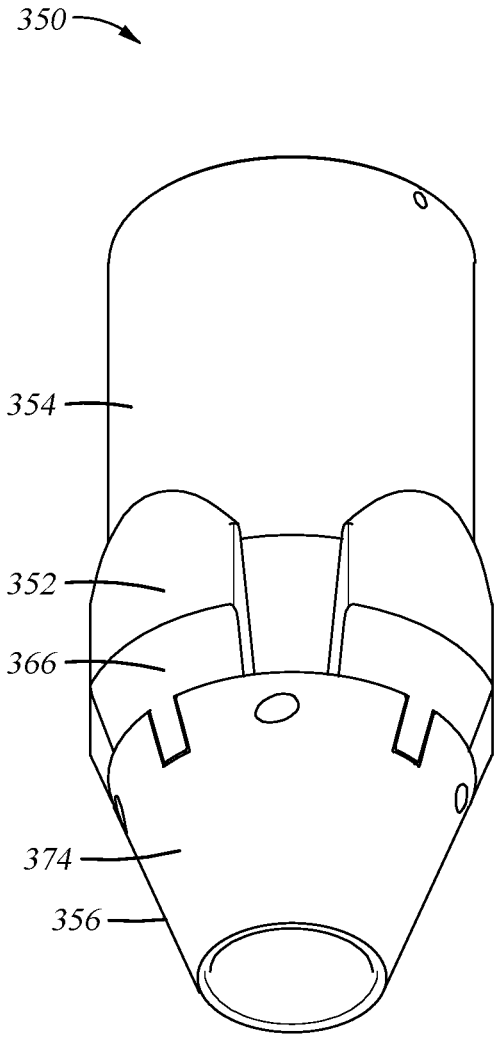
FIG. 13C is an external view of the slip cone assembly of FIG. 13A shown in a set configuration.
Figure 13D:
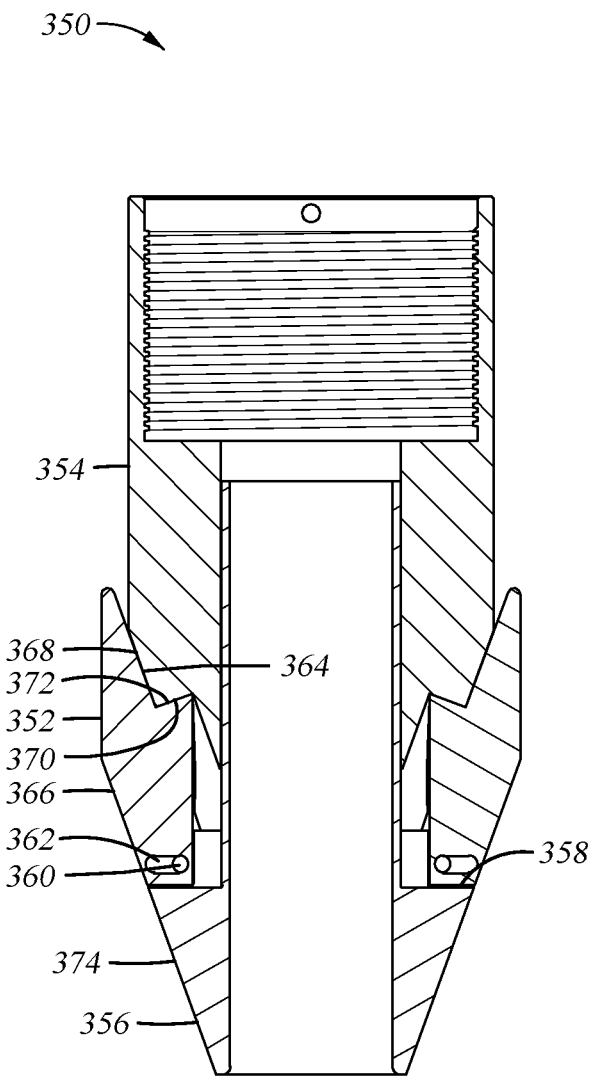
FIG. 13D is a longitudinal cross-sectional view taken through the center of the slip cone assembly of FIG. 13C.

In some embodiments of the slip assembly 146, the extension ramps 184, 214 may transition between retracted and extended configurations by sliding laterally with respect to the corresponding base cone 170, 196. FIGS. 13A-13D show an embodiment of a slip cone assembly 350 that may be used in place of upper cone assembly 162 and/or lower cone assembly 164 in slip assembly 146. FIGS. 13A and 13B show the slip cone assembly 350 in an unset configuration; FIGS. 13C and 13D show the slip cone assembly 350 in a set configuration. One or more extension ramp 352 may be disposed between a support cone 354 and a rear face 358 of a base cone 356, and may be coupled to the base cone 356 using a key 360. Each extension ramp 352 may have a sloped outer surface 366 and a sloped inner surface 364. The sloped inner surface 364 may be configured to interact with a sloped outer surface 368 of the support cone 354. As shown in FIG. 13A, the sloped outer surface 368 of each support cone 354 may include a concave portion at an interface with the sloped inner surface 364 of each extension ramp 352.

When transitioning from the running configuration to the set configuration, at least one of the support cone 354 and the base cone 356 may be moved toward the other of the base cone 356 and the support cone 354. The sloped outer surface 368 of the support cone 354 interacts with the sloped inner surface 364 of each extension ramp 352, thereby causing each extension ramp 352 to move from a retracted position to an extended position. For each extension ramp 352, the key 360 may travel within a keyway 362, and the interaction between the key 360 and the keyway 362 may limit the maximum extent of travel of the extension ramp 352. Additionally, or alternatively, the maximum extent of travel of each extension ramp 352 may be limited by an interaction between a shoulder 370 on the support cone 354 and a corresponding shoulder 372 on each extension ramp 352. When an extension ramp 352 is in the extended position, the sloped outer surface 366 may be substantially aligned with a sloped outer surface 374 of the base cone 356. A sloped inner surface 230, 232 of a gripper 224, 226 of a slip member 160 may slide along the sloped outer surface 374 of the base cone 356 and the sloped outer surface 366 of the extension ramp 352.

Figure 14A:
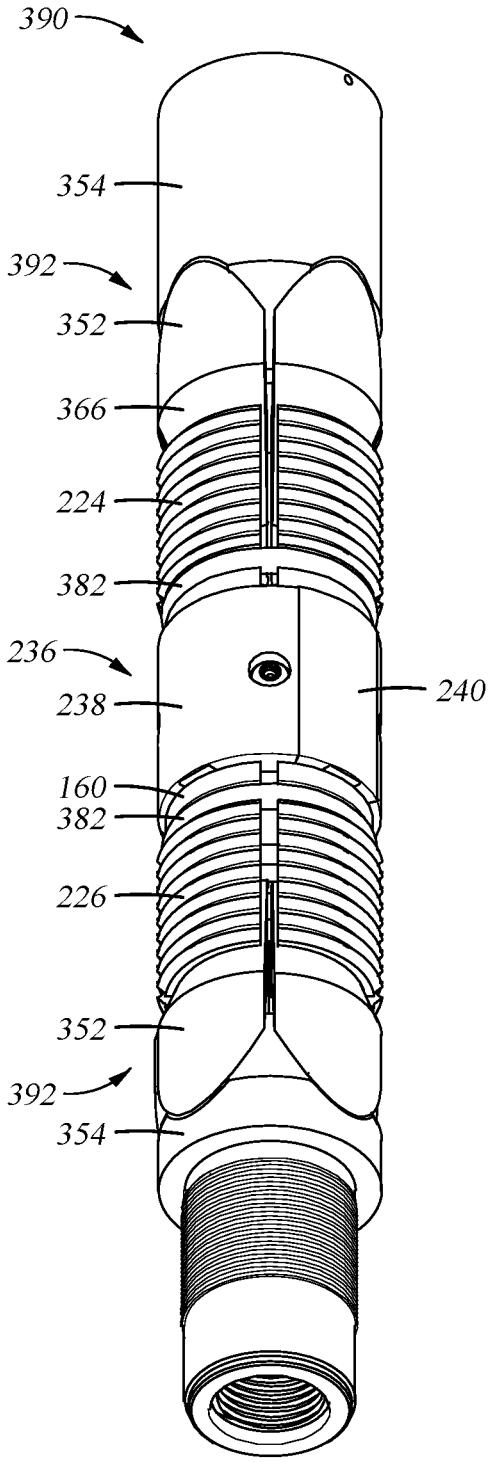
FIG. 14A is an external view of a slip cone assembly according to another embodiment, shown in a running configuration.
Figure 14B:
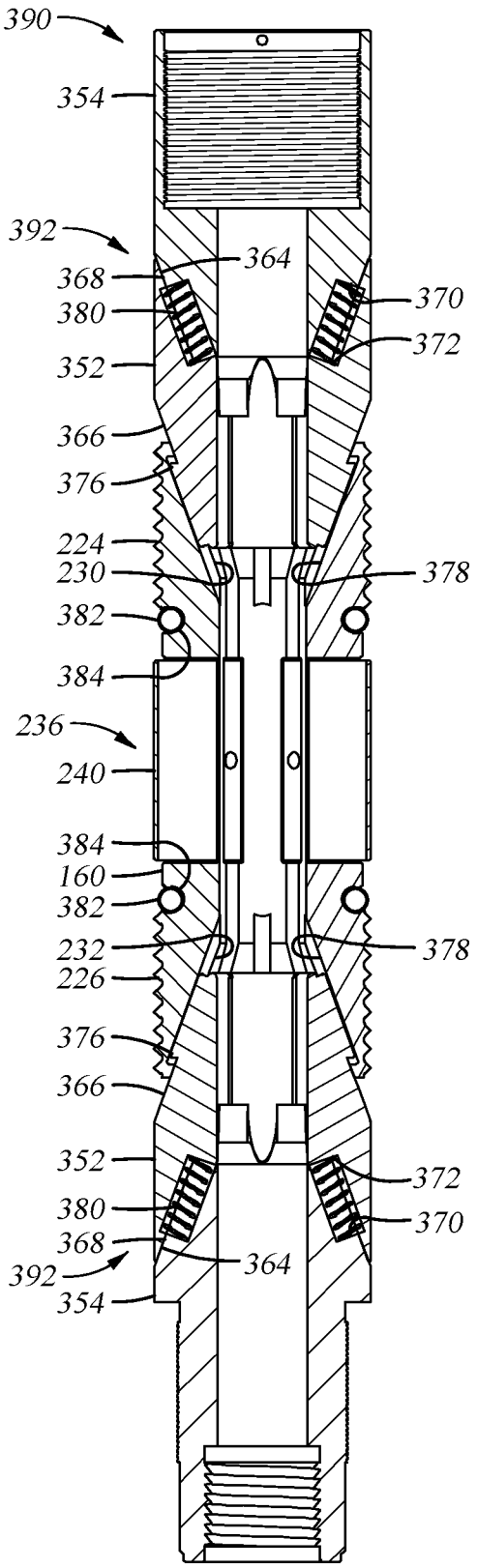
FIG. 14B is a longitudinal cross-sectional view taken through the center of the slip cone assembly of FIG. 14A.
Figure 14C:
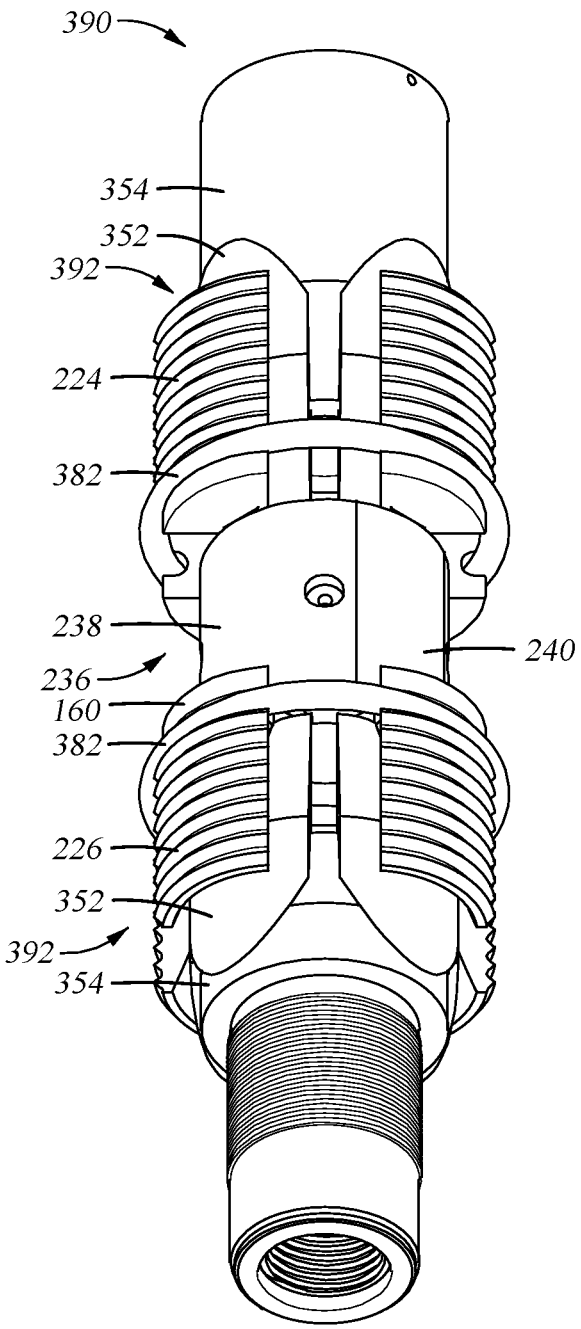
FIG. 14C is an external view of the slip cone assembly of FIG. 14A shown in a set configuration.
Figure 14D:
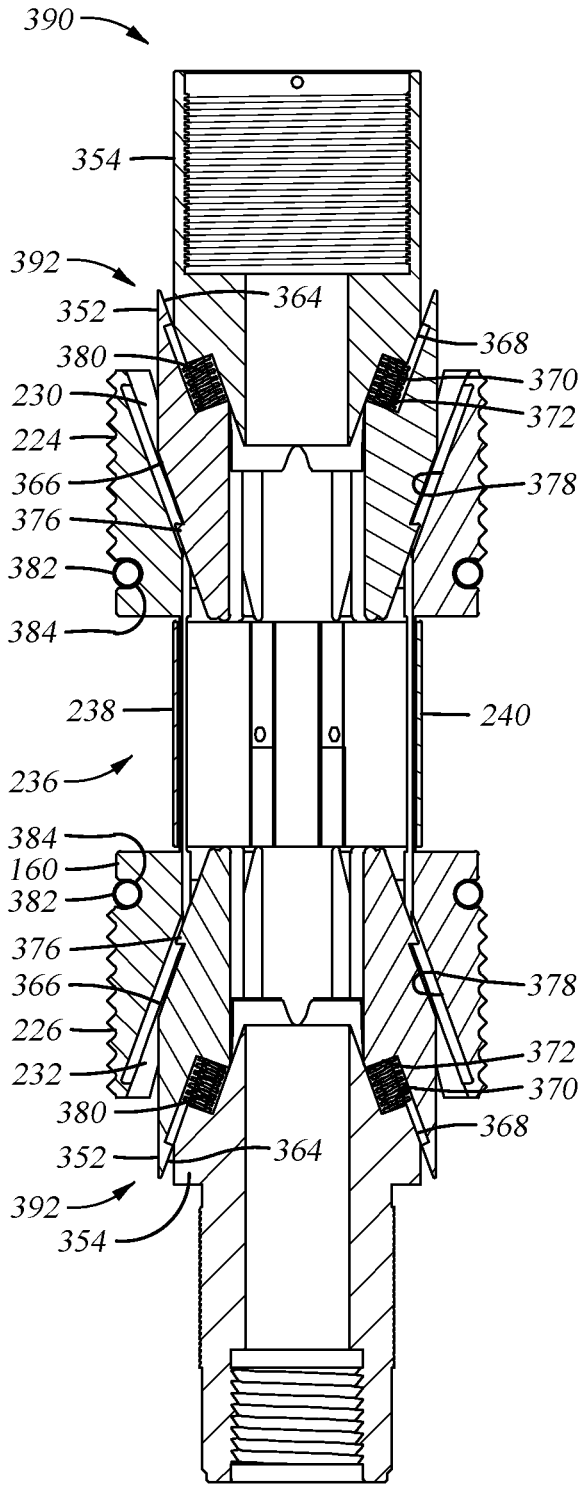
FIG. 14D is a longitudinal cross-sectional view taken through the center of the slip cone assembly of FIG. 14C.

In some embodiments, as shown in FIGS. 14A-14D, the base cone 356 may be omitted from slip cone assembly 350. FIGS. 14A and 14B show a slip assembly 390 incorporating two slip cone assemblies 392 in an unset configuration; FIGS. 14C and 14D show the slip assembly 390 in a set configuration. Slip cone assembly 392 may be utilized in place of slip cone assembly 350 or upper cone assembly 162 or lower cone assembly 164 in slip assembly 146. In each slip cone assembly 392, each extension ramp 352 may have a sloped outer surface 366 coupled to a sloped inner surface 230, 232 of a gripper 224, 226 of a slip member 160. Each extension ramp 352 may have a tang 376 that is configured to slide within a corresponding slot 378 of each gripper 224, 226 of each slip member 160. The tang 376 may cooperate with the slot 378 such that relative axial movement between each extension ramp 352 and each slip member 160 may result in radial movement of each slip member 160 between extended and retracted positions. The sloped outer surface 368 of each support cone 354 may include a concave portion at an interface with the sloped inner surface 364 of each extension ramp 352.

When transitioning from the running configuration to the set configuration, each support cone 354 of each slip cone assembly 392 may be moved towards the slip cage 236 of the slip assembly 390. Movement of each support cone 354 towards the slip cage 236 may cause movement of each extension ramp 352 towards the slip cage 236. The sloped inner surface 230, 232 of each gripper 224, 226 of each slip member 160 may slide along the sloped outer surface 366 of each extension ramp 352 when each extension ramp 352 is being moved toward the slip cage 236. Thus, each slip member 160 may move radially towards an extended position. In some embodiments, each extension ramp 352 may contact the slip cage 236. Continued movement of each support cone 354 towards the slip cage 236 may cause the sloped outer surface 368 of each support cone 354 to interact with the sloped inner surface 364 of each extension ramp 352, thereby causing each extension ramp 352 to move from a radially retracted position to a radially extended position. Such movement of each extension ramp 352 may cause each slip member 160 to move further towards the extended position. Thus, each slip member 160 may be moved from the retracted position to the extended by each extension ramp 352 first moving predominately in an axial direction, and then moving predominately in a radial direction.

In some embodiments, a biasing member 380, such as a spring or a mass of resilient deformable material, such as an elastomer, may be located between each support cone 354 and each extension ramp 352. In some embodiments, the biasing member 380 may be located between corresponding shoulders 370, 372 on each support cone 354 and on each extension ramp 352, respectively. The biasing member 380 may urge each extension ramp 352 toward the retracted position.

In some embodiments, as shown in FIGS. 14A-14D, the slip cage 236 may include one or more retainer 240 that is not radially movable with respect to the slip cage body 238. In some embodiments, as shown in FIGS. 14A-14D, a garter spring 382 may be located around the slip members 160. The garter spring 382 may be located within a recess 384 of each slip member 160. The garter spring 382 may bias the slip members 160 toward the retracted position. The garter spring 382 may be used in addition to or instead of the biasing member 248 located between each slip member 160 and each corresponding retainer 240.

Other Embodiments

In some embodiments, the bridge plug 2 may be configured to be transitioned from the set configuration to the released configuration, but the method of use may not involve releasing the bridge plug 2. In such embodiments, the steps that would be performed to achieve release of the bridge plug 2 may be omitted.

In some embodiments, the bridge plug 2 may not be configured to be transitioned from the set configuration to the released configuration. In such embodiments, the components that facilitate the release of the bridge plug 2 may be modified or omitted in order to avoid an inadvertent release of the bridge plug 2.

The various embodiments of the packer assembly 40, 340 of the present disclosure may be utilized with other tools and systems apart from the bridge plug 2. For example, the packer assembly 40, 340 may be used as a sealing system for a downhole/pipeline packer, a liner hanger, a straddle assembly, a whipstock, a pressure test tool, a production test tool (such as a drill stem test tool), a storm packer tool, a casing hanger, or any other downhole or pipeline service tool.

In some embodiments, the various embodiments of the packer assembly 40, 340 of the present disclosure may be configured to be transitioned from the set configuration to the released configuration, but the method of use may not involve releasing the packer assembly 40, 340. In such embodiments, the steps that would be performed to achieve release of the packer assembly 40, 340 may be omitted.

In some embodiments, the packer assembly 40, 340 may not be configured to be transitioned from the set configuration to the released configuration. In such embodiments, the components that facilitate the release of the packer assembly 40, 340 may be modified or omitted in order to avoid an inadvertent release of the packer assembly 40, 340.

The various embodiments of the slip assembly 146, 390 of the present disclosure may be utilized with other tools and systems apart from the bridge plug 2. For example, the slip assembly 146, 390 may be used as an anchoring system for a downhole/pipeline packer, a liner hanger, a straddle assembly, a whipstock, a pressure test tool, a production test tool (such as a drill stem test tool), a storm packer tool, a casing hanger, or any other downhole or pipeline service tool.

In some embodiments, the various embodiments of the slip assembly 146, 390 of the present disclosure may be configured to be transitioned from the set configuration to the released configuration, but the method of use may not involve releasing the slip assembly 146, 390. In such embodiments, the steps that would be performed to achieve release of the slip assembly 146, 390 may be omitted.

In some embodiments, the slip assembly 146, 390 may not be configured to be transitioned from the set configuration to the released configuration. In such embodiments, the components that facilitate the release of the slip assembly 146, 390 may be modified or omitted in order to avoid an inadvertent release of the slip assembly 146, 390.

In some embodiments of the present disclosure, a slip assembly includes a first support cone configured to move a first extension ramp between retracted and extended positions. The first extension ramp is biased towards the retracted position by a first biasing member. The slip assembly further includes a second support cone configured to move a second extension ramp between retracted and extended positions. The second extension ramp is biased towards the retracted position by a second biasing member. The slip assembly further includes a slip member disposed between the first extension ramp and the second extension ramp. The slip member is configured to slide between retracted and extended positions along an outer surface of the first extension ramp and along an outer surface of the second extension ramp.

In some embodiments of the present disclosure, a slip assembly includes a slip cage body having a radial opening. A retainer disposed in the radial opening is movable between a retracted position and an extended position. A slip member has a shank between first and second gripping elements, and the shank is disposed between the slip cage body and the retainer. A first biasing member is disposed between the retainer and the slip cage body, and a second biasing member is disposed between the shank and the retainer.

In some embodiments of the present disclosure, a slip assembly includes a slip cage body having a radial opening. A retainer disposed in the radial opening is movable between a retracted position and an extended position. A slip member has a shank between first and second gripping elements, and the shank is disposed between the slip cage body and the retainer. A first biasing member is disposed between the retainer and the slip cage body, and a second biasing member is disposed between the shank and the retainer. The slip member is movable between a retracted position and an extended position. When the slip member moves towards the extended position, the retainer moves towards the extended position.

In some embodiments of the present disclosure, a slip assembly includes a slip cage body having a radial opening. A retainer disposed in the radial opening is movable between a retracted position and an extended position. A slip member has a shank between first and second gripping elements, and the shank is disposed between the slip cage body and the retainer. A first biasing member is disposed between the retainer and the slip cage body, and a second biasing member is disposed between the shank and the retainer. A first cone assembly is configured to bear against the first gripping element, and a second cone assembly is configured to bear against the second gripping element. The first and second cone assemblies are configured to move the slip member from a retracted position to an extended position. When the slip member moves towards the extended position, the retainer moves towards the extended position.

While the foregoing is directed to embodiments of the present disclosure, other and further embodiments of the disclosure may be devised without departing from the basic scope thereof, and the scope thereof is determined by the claims that follow.

What is claimed is:

1. A packer assembly comprising:

a packer mandrel;

a packing element disposed about the packer mandrel, the packing element comprising a unitary structure of packing material;

an upper recovery sleeve disposed about the packer mandrel and extending from a first region above the packing element to a second region between the packer mandrel and an upper end of the packing element, the upper recovery sleeve having an upper recovery profile embedded within the packing element;

an upper backup assembly movably disposed about the upper recovery sleeve in the first region and adjacent to the upper end of the packing element;

a lower recovery sleeve disposed about the packer mandrel and extending from a third region below the packing element to a fourth region between the packer mandrel and a lower end of the packing element, the lower recovery sleeve having a lower recovery profile embedded within the packing element; and a lower backup assembly movably disposed about the lower recovery sleeve in the third region and adjacent to the lower end of the packing element.

2. The packer assembly of claim 1, further comprising a filler ring movably disposed between the packer mandrel and the packing element.

3. The packer assembly of claim 2, wherein the packing element is bonded to the filler ring.

4. The packer assembly of claim 1, further comprising a spacer ring disposed about the packing element.

5. The packer assembly of claim 4, wherein the spacer ring has a first maximum outer diameter before the packer assembly is transitioned from a running configuration to a set configuration, a second maximum outer diameter after the packer assembly is transitioned from the running configuration to the set configuration, and the second maximum outer diameter is substantially the same as the first maximum outer diameter.

6. The packer assembly of claim 5, wherein the spacer ring has a third maximum outer diameter after the packer assembly is transitioned from the set configuration to a released configuration, the third maximum outer diameter substantially the same as the first maximum outer diameter.

7. The packer assembly of claim 1, wherein the upper backup assembly comprises:

an upper inner backup sleeve disposed about the upper recovery sleeve and movable with respect to the upper recovery sleeve, the upper inner backup sleeve having a first annular shoulder;

an upper outer backup sleeve disposed about the upper inner backup sleeve and movable with respect to the upper inner backup sleeve, the upper outer backup sleeve having a second annular shoulder;

a first biasing member between the first and second annular shoulders;

an upper backup support coupled to the upper inner backup sleeve; and an upper backup ring assembly coupled to the upper backup support and configured to enclose an outer surface of the upper end of the packing element.

8. The packer assembly of claim 7, wherein:

the upper backup ring assembly further comprises a first inner backup ring adjacent the outer surface of the upper end of the packing element, and a first outer backup ring adjacent the first inner backup ring; and the upper backup support is configured to abut the first outer backup ring when the packer assembly is in a set configuration.

9. The packer assembly of claim 7, wherein the lower backup assembly comprises:

a lower inner backup sleeve disposed about the lower recovery sleeve and movable with respect to the lower recovery sleeve, the lower inner backup sleeve having a third annular shoulder;

a lower outer backup sleeve disposed about the lower inner backup sleeve and movable with respect to the lower inner backup sleeve, the lower outer backup sleeve having a fourth annular shoulder;

a second biasing member between the third and fourth annular shoulders;

a lower backup support coupled to the lower inner backup sleeve; and a lower backup ring assembly coupled to the lower backup support and configured to enclose an outer surface of the lower end of the packing element.

10. The packer assembly of claim 9, wherein:

the lower backup ring assembly further comprises a second inner backup ring adjacent the outer surface of the lower end of the packing element, and a second outer backup ring adjacent the second inner backup ring; and the lower backup support is configured to abut the second outer backup ring when the packer assembly is in a set configuration.

11. The packer assembly of claim 9, wherein:

the packer assembly is configured to transition from a running configuration to a set configuration, and from the set configuration to a released configuration;

and further wherein:

when the packer assembly is in the running configuration, the packing element has a first maximum outer diameter, when the packer assembly is in the set configuration, the packing element has a second maximum outer diameter greater than the first maximum outer diameter, and when the packer assembly is in the released configuration, the packing element has a third maximum outer diameter less than the second maximum outer diameter.

12. A method of manipulating a packing element in a bore, comprising:

providing a packer assembly comprising:

a packer mandrel;

a packing element disposed about the packer mandrel, the packing element comprising a unitary structure of packing material;

an upper recovery sleeve disposed about the packer mandrel and extending from a first region above the packing element to a second region between the packer mandrel and an upper end of the packing element, the upper recovery sleeve having an upper recovery profile embedded within the packing element;

an upper backup assembly movably disposed about the upper recovery sleeve in the first region and adjacent to the upper end of the packing element, the upper backup assembly having an upper inner backup sleeve disposed about the upper recovery sleeve and movable with respect to the upper recovery sleeve;

a lower recovery sleeve disposed about the packer mandrel and extending from a third region below the packing element to a fourth region between the packer mandrel and a lower end of the packing element, the lower recovery sleeve having a lower recovery profile embedded within the packing element; and a lower backup assembly movably disposed about the lower recovery sleeve in the third region and adjacent to the lower end of the packing element, the lower backup assembly having a lower inner backup sleeve disposed about the lower recovery sleeve and movable with respect to the lower recovery sleeve;

moving the upper inner backup sleeve with respect to the upper recovery sleeve toward the upper end of the packing element;

moving the lower inner backup sleeve with respect to the lower recovery sleeve toward the lower end of the packing element;

reducing an axial distance between the upper recovery sleeve and the lower recovery sleeve, thereby axially compressing the packing element; and deforming the packing element into contact with a surrounding wall of the bore.

13. The method of claim 12, wherein deforming the packing element into contact with a surrounding wall of the bore includes:

moving an upper backup ring coupled to the upper inner backup sleeve along an outer surface of the upper end of the packing element; and moving a lower backup ring coupled to the lower inner backup sleeve along an outer surface of the lower end of the packing element.

14. The method of claim 13, wherein after deforming the packing element into contact with a surrounding wall of the bore, the method further comprises:

increasing an axial distance between the upper backup ring and the lower backup ring by moving the upper inner backup sleeve with respect to the upper recovery sleeve away from the upper end of the packing element.

15. The method of claim 14, further comprising increasing an axial distance between the upper recovery sleeve and the lower recovery sleeve, thereby axially stretching the packing element.

16. A downhole tool comprising:

a central mandrel;

a slip assembly disposed about the central mandrel; and a packer assembly disposed about the central mandrel, the packer assembly comprising:

a packer mandrel;

a packing element disposed about the packer mandrel, the packing element comprising a unitary structure of packing material;

an upper recovery sleeve disposed about the packer mandrel and extending from a first region above the packing element to a second region between the packer mandrel and an upper end of the packing element, the upper recovery sleeve having an upper recovery profile embedded within the packing element;

an upper backup assembly movably disposed about the upper recovery sleeve in the first region and adjacent to the upper end of the packing element;

a lower recovery sleeve disposed about the packer mandrel and extending from a third region below the packing element to a fourth region between the packer mandrel and a lower end of the packing element, the lower recovery sleeve having a lower recovery profile embedded within the packing element; and a lower backup assembly movably disposed about the lower recovery sleeve in the third region and adjacent to the lower end of the packing element.

17. The downhole tool of claim 16, wherein the slip assembly further comprises:

a slip mandrel;

a cone assembly coupled to the slip mandrel, the cone assembly comprising:

a base cone, and an extension ramp coupled to the base cone, the extension ramp:

movable between a radially retracted position and a radially extended position, and biased toward the radially retracted position by a biasing member; and a slip member disposed adjacent the base cone, the slip member configured to slide between retracted and extended positions along an outer surface of the base cone and along an outer surface of the extension ramp.

18. The downhole tool of claim 16, wherein the slip assembly is configured to transition from a running configuration to a set configuration prior to the packer assembly transitioning from a running configuration to a set configuration.

19. The downhole tool of claim 18, wherein the packer assembly is configured to transition from the set configuration to a released configuration prior to the slip assembly transitioning from the set configuration to a released configuration.

20. The downhole tool of claim 19, further comprising:

a primary release mechanism configured to selectively permit the packer assembly to transition from the set configuration to the released configuration; and a secondary release mechanism configured to selectively permit the slip assembly to transition from the set configuration to the released configuration.

* * * * *